US006499402B1

(12) United States Patent
Sikes et al.

(10) Patent No.: US 6,499,402 B1
(45) Date of Patent: Dec. 31, 2002

(54) SYSTEM FOR DYNAMICALLY MONITORING AND CONTROLLING A WEB PRINTING PRESS

(75) Inventors: Dale R. Sikes, Lake Zurich, IL (US); Herman C. Gnuechtel, Arlington Heights, IL (US)

(73) Assignee: Web Printing Controls Co., Inc., Lake Barrington, IL (US)

( * ) Notice: Subject to any disclaimer, the term of this patent is extended or adjusted under 35 U.S.C. 154(b) by 0 days.

(21) Appl. No.: 09/573,984

(22) Filed: May 17, 2000

(51) Int. Cl.[7] ..... B41F 2/66
(52) U.S. Cl. ..... 101/484; 101/171
(58) Field of Search ..... 101/484, 171

(56) References Cited

U.S. PATENT DOCUMENTS

| | | | | |
|---|---|---|---|---|
| 4,003,660 A | | 1/1977 | Christie, Jr. et al. | |
| 4,505,589 A | | 3/1985 | Ott et al. | 356/402 |
| 4,564,860 A | | 1/1986 | Ohta | 358/107 |
| 4,602,160 A | | 7/1986 | Mactaggart | 250/341 |
| 4,637,728 A | | 1/1987 | Kipphan et al. | 356/402 |
| 4,649,566 A | | 3/1987 | Tsunoda et al. | 382/1 |
| 4,668,978 A | | 5/1987 | Gokita | 358/78 |
| 4,694,502 A | | 9/1987 | Ozawa | 382/17 |
| 4,752,892 A | | 6/1988 | Julian Lecha | 364/518 |
| 4,794,453 A | | 12/1988 | Gnuechtel et al. | 358/101 |
| 4,845,374 A | | 7/1989 | White et al. | 250/560 |
| 4,852,485 A | * | 8/1989 | Brunner | 101/211 |
| 4,993,405 A | * | 2/1991 | Takamura et al. | 128/6 |
| 5,025,676 A | * | 6/1991 | Perretta | 74/441 |
| 5,043,904 A | * | 8/1991 | Sikes et al. | 364/469 |
| 5,063,845 A | * | 11/1991 | Perretta | 101/484 |
| 5,125,037 A | * | 6/1992 | Lehtonen et al. | 382/8 |
| 5,155,005 A | * | 10/1992 | Sato et al. | 430/257 |
| 5,182,652 A | * | 1/1993 | Stephenson, III | 358/296 |
| 5,182,721 A | * | 1/1993 | Kipphan et al. | 364/526 |
| 5,216,521 A | * | 6/1993 | Birgmeir | 358/447 |
| 5,412,577 A | * | 5/1995 | Sainio et al. | 364/469 |
| 5,517,575 A | * | 5/1996 | Ladewski | 382/108 |
| 5,689,425 A | * | 11/1997 | Sainio et al. | 364/469.03 |
| 6,058,201 A | * | 5/2000 | Sikes et al. | 382/112 |
| 6,119,594 A | | 9/2000 | Kipphan et al. | |

FOREIGN PATENT DOCUMENTS

| | | |
|---|---|---|
| DE | 4321177 | 1/1995 |
| EP | 0598490 | 5/1994 |
| EP | 0741032 | 11/1996 |
| GB | 2271080 | 4/1994 |
| GB | 2300478 | 11/1996 |

* cited by examiner

*Primary Examiner*—Daniel J. Colilla
*Assistant Examiner*—Charles H. Nolan, Jr.
(74) *Attorney, Agent, or Firm*—Greer, Burns & Crain, Ltd.

(57) ABSTRACT

A system for use with a web printing press for providing overall control of the operations of multiple systems, including a system for measuring the reflective density of printed ink in real time during high speed operation and for controlling the color density and registration of the press. The system digitizes images of targets located in the test print area within an impression and analyzes the images to determine a multiplicity of print characteristics of multiple colors and also determines and controls registration among the various print stations. The system is adapted for use with modern presses having extremely small gap size and extremely small test print area size by initially searching for and locating a registration target pattern and after any necessary adjustment then analyzes digitized images of targets located across the web. The system measures and controls inking and registration of the web up to a key-by-key incremental basis and also includes a process manager for presetting jobs, efficiently carrying out press make-readies, building a database by gathering all necessary operating data on the press and its systems, monitoring press systems and equipment such as the color density and registration control system, web guides, ribbon slicing and convergence systems and the like.

15 Claims, 51 Drawing Sheets

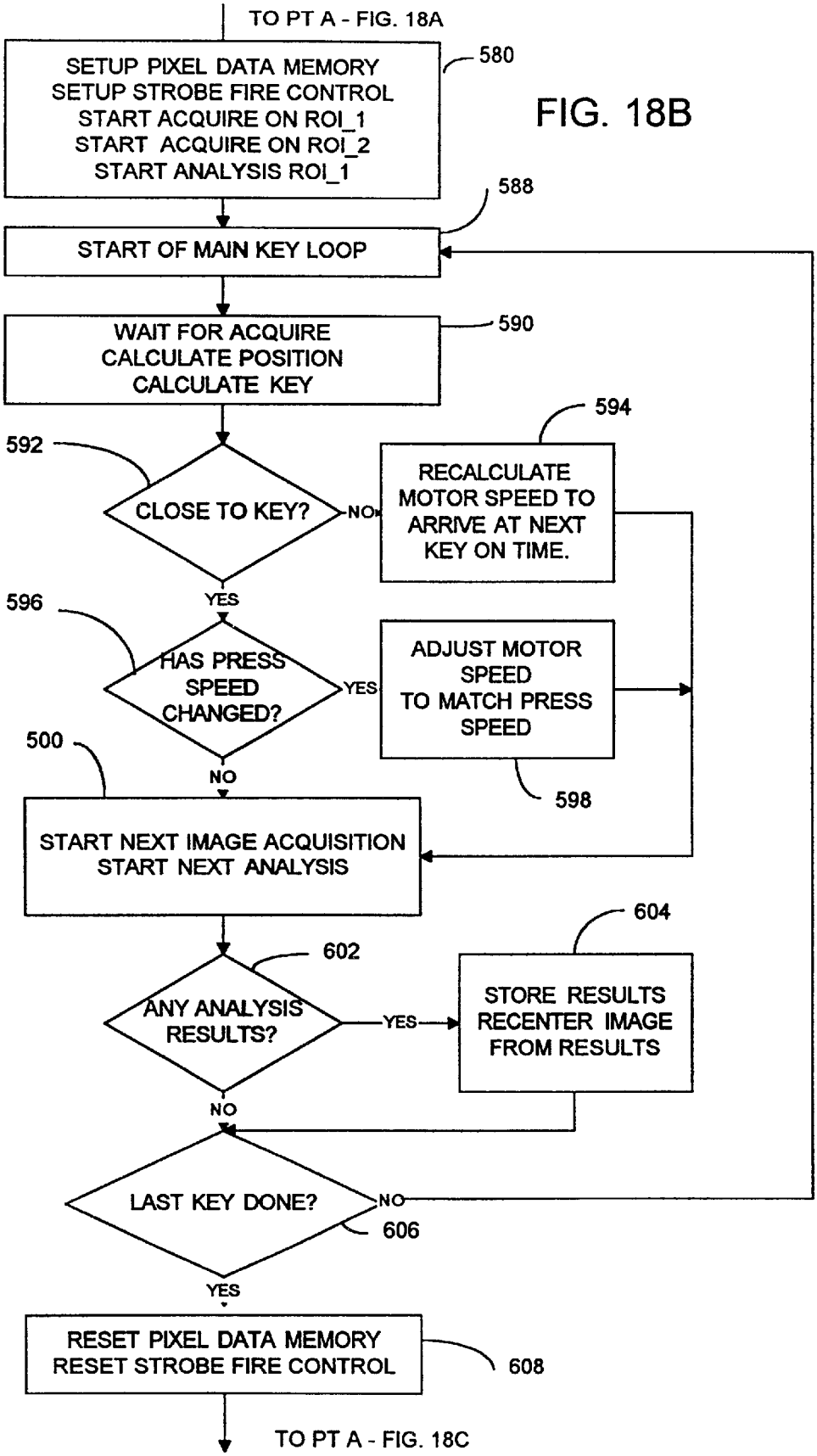
TO PT A - FIG. 18A
SETUP PIXEL DATA MEMORY
SETUP STROBE FIRE CONTROL
START ACQUIRE ON ROI_1
START ACQUIRE ON ROI_2
START ANALYSIS ROI_1
580
FIG. 18B
588
START OF MAIN KEY LOOP
WAIT FOR ACQUIRE
CALCULATE POSITION
CALCULATE KEY
590
594
592
CLOSE TO KEY?
NO
RECALCULATE MOTOR SPEED TO ARRIVE AT NEXT KEY ON TIME.
YES
596
HAS PRESS SPEED CHANGED?
YES
ADJUST MOTOR SPEED TO MATCH PRESS SPEED
500
NO
598
START NEXT IMAGE ACQUISITION
START NEXT ANALYSIS
604
602
ANY ANALYSIS RESULTS?
YES
STORE RESULTS
RECENTER IMAGE FROM RESULTS
NO
LAST KEY DONE?
NO
606
YES
RESET PIXEL DATA MEMORY
RESET STROBE FIRE CONTROL
608
TO PT A - FIG. 18C

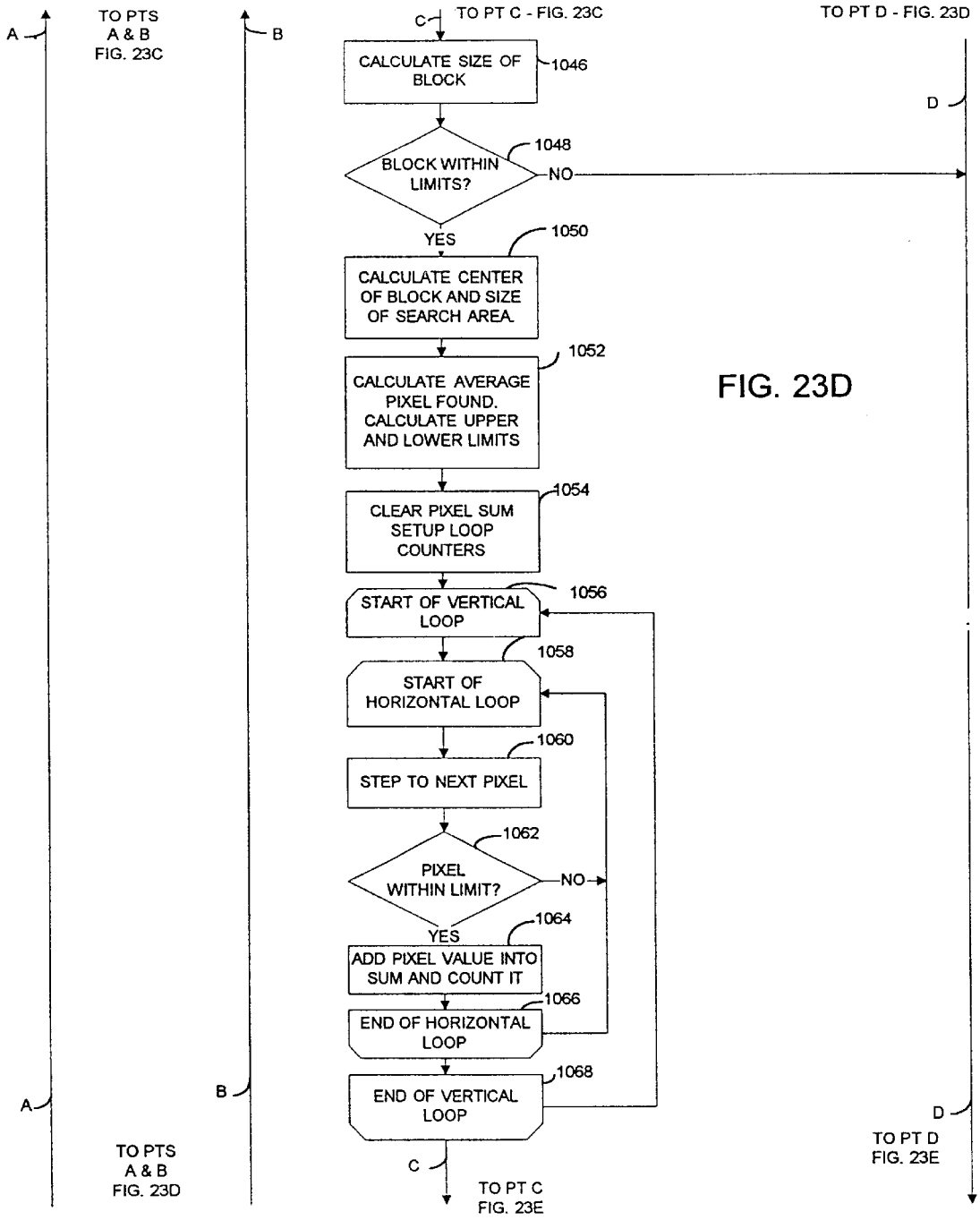
A
TO PTS A & B FIG. 23C
B
C
TO PT C - FIG. 23C
TO PT D - FIG. 23D
CALCULATE SIZE OF BLOCK
1046
D
BLOCK WITHIN LIMITS?
1048
NO
YES
1050
CALCULATE CENTER OF BLOCK AND SIZE OF SEARCH AREA
1052
CALCULATE AVERAGE PIXEL FOUND. CALCULATE UPPER AND LOWER LIMITS
FIG. 23D
1054
CLEAR PIXEL SUM SETUP LOOP COUNTERS
1056
START OF VERTICAL LOOP
1058
START OF HORIZONTAL LOOP
1060
STEP TO NEXT PIXEL
1062
PIXEL WITHIN LIMIT?
NO
YES
1064
ADD PIXEL VALUE INTO SUM AND COUNT IT
1066
END OF HORIZONTAL LOOP
1068
END OF VERTICAL LOOP
A
B
D
TO PTS A & B FIG. 23D
C
TO PT C FIG. 23E
TO PT D FIG. 23E

SYSTEM FOR DYNAMICALLY MONITORING AND CONTROLLING A WEB PRINTING PRESS

The present invention generally relates to a system for monitoring and controlling the operation of a web printing press and for providing superior operating efficiency and an operating history database. The system includes the capability of acquiring digitized images of predetermined areas printed patterns of ink and analyzing the images to determine reflective density and register misalignment and for generating control signals to make any necessary density and register corrections.

Web printing presses of the type which print full color magazines and other printed material at high speeds generally have a number of printing stations, each of which prints a different color on the web as the web passes through the press. Such presses generally have multiple printing stations which generally print the colors cyan, magenta yellow and often two other colors in addition to black. The quality of the printed matter is a function not only of the proper registration of each of the colors by the respective printing stations, but also by the amount of ink and its resultant pattern of distribution that is printed for each color by the printing stations.

The distribution of ink that is transferred to the web during a printing operation is fundamentally controlled by a number of ink zone control mechanisms, commonly referred to as "keys" that are spaced across the width of the printing press, typically at approximately every 1 to 2 inches, depending upon the press type, and these keys effectively determine zones that regulate the amount of ink that is available to be ultimately transferred to a web. For each color that is being printed, there may be very little or a relatively large amount of ink transferred at each key location of each printing station, depending upon the perceived color in the image that is printed. As is well known to those skilled in the art, a woman in a bright red dress that takes up a significant portion of the area of an impression would require a larger amount of magenta and yellow ink being applied at the magenta and yellow printing stations, since red is a combination of magenta and yellow. The keys in the area of the red dress would be controlled to provide more of such ink than in other areas of the impression being printed. As a general matter, the transfer of the ink being printed at each printing station is important to achieve the desired perceived color in the resulting product.

It has long been a practice in the operation of full color printing presses to print certain test targets of each color of ink in a test print area within an impression (such as pages of a magazine) for the purpose of qualifying the quality of the final finished product by measuring the reflective density of the final printed product using a small hand-held densitometer. Such densitometers give readings that range from approximately 0.5 to 2.5 with the larger number being substantially reduced reflectivity, i.e., black. Such densitometers are quite sensitive in their operation and must often be calibrated to give reliable reflective density readings. After a printing job has been set up, pressmen must take samples at periodic intervals during a press run and perform reflective density measurements to insure that the transfer of ink has not changed. If it has, then they make appropriate adjustments to the press to bring the measurements into conformance. It is also known in the art that adjustment of the press does not result in an immediate change in the transfer of ink. For example, adjustment of one ink key may have an effect on adjacent keys.

In our prior U.S. Pat. No. 6,058,201, there is described an extremely sophisticated system for generating dynamic reflective density measurements for a web printing press, which system acquires digitized images of particular web targets that are located in the test print area between adjacent impressions. Since the size of the test print area between adjacent impressions represents an area of wasted paper, modern presses continue to decrease the size of the test print area to minimize waste. With the test print area size becoming ever smaller, the targets that are used for densitometer measurements and also register control must necessarily be smaller. The compression of the test print area size also decreases the space between the targets and the actual printed matter which creates an increased technological challenge to providing a system which will reliably operate.

Modern presses are also becoming larger in the sense that they print a wider web which must then be slit into multiple ribbons in the longitudinal direction and then be converged to form a multi-layer composite product that is ultimately cut in the transverse direction to form magazines and other print material. Because of the increased width of the web, registration through the various print stations may vary across the web so that control of the registration on a key-by-key basis is necessary to achieve an acceptable printed product. Because of the flexibility and elasticity of the web, it is possible to introduce a small roller, push member or the like into contact with the narrow portion of the web to buckle that portion of the web and vary its path length relative to the remainder of the web and thereby accomplish register control on less than a web width basis and even on a key-by-key basis.

Many modern press installations have a complete complement of accessory control apparatus, including a web guide at the input of the web, a registration control mechanism, a color density measurement and adjustment apparatus, a ribbon slitting and converging mechanism, as well as a web guide at the upstream end of the same, and web break detectors that are adapted to shut down the press in the event of a web break. Overall control of all of these mechanisms and apparatus is highly desirable to achieve a reliable and efficient press operation.

Accordingly, it is a primary object of the present invention to provide an improved system for dynamically monitoring and controlling a web printing press, including apparatus for measuring and controlling reflective density as well as registration of print operations, in addition to monitoring and controlling other auxiliary equipment such as the ribbon slitting and converging apparatus.

It is another object of the present invention to provide such an improved system which includes a process manager that is adapted to provide the above apparatus with preset values that enables the press to be controlled whereby make ready operations are quickly accomplished which increases the operational efficiency of the press and concomitantly reduces waste.

Yet another object of the present invention is to provide such an improved system that includes a process manager which interfaces all of the apparatus that operate the press, receives job information from a printing company's pre-press department which is downloaded into the process manager, and generates the preset values for all of the apparatus for carrying out the printing job.

Still another object of the present invention is to provide such an improved system that enables registration to be reliably obtained even though the target pattern used to do so is extremely small and the test print area between successive impressions is extremely small.

A corollary object lies in the provision for obtaining of relatively close registration through use of the presets generated by the process manager and the use of a predetermined register target pattern printing at a specific location. This then enables the color density apparatus to reliably print the various color block sets in the test print area and be reliably located, acquired and analyzed.

Yet another object of the present invention is to provide such an improved system which has two or more target blocks at each key location across the width of the web which enables registration to be independently measured on a key-by-key basis so that accurate registration control can be achieved across the entire web.

A more specific object of the present invention is to provide such an improved system which determines and controls registration of the various print stations by initially using a register target pattern that is preferably printed in the test print area at the center line of the press, which when its digitized image is acquired, enables the apparatus to reliably acquire the image of each of a plurality of other color block sets located in the test print area along the width of the web for the purpose of determining color density. A corollary object lies in the provision for using such block sets for controlling registration at each key location on a continuing basis during a press run.

Other objects and advantages will become apparent upon reading the following detailed description, while referring to the attached drawings, in which:

DESCRIPTION OF THE DRAWINGS

FIG. 4A has three targets per key, while FIG. 4B has two targets per key. The density target or color block set is located at the center of each key.

FIGS. 18A, 18B and 18C together comprise a flow chart for a software routine that is used for acquiring data for the reflective density analysis.

FIGS. 23A, 23B, 23C, 23D and 23E together comprise a flow chart for another software routine for searching for the locations of the sides of a solid color block and performs the reflective density analysis on valid color blocks.

DETAILED DESCRIPTION

Figure 1:
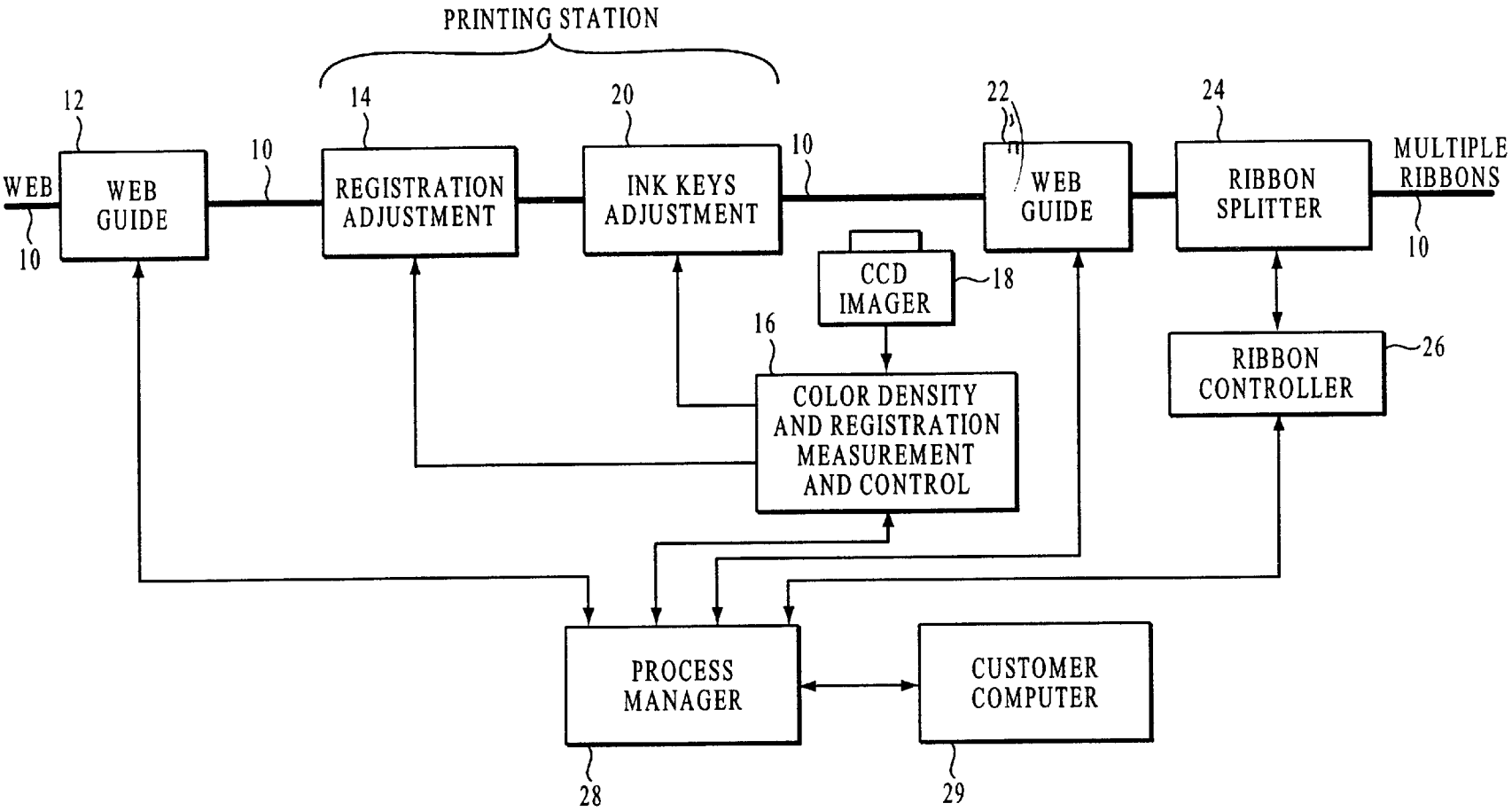
FIG. 1 is a block diagram of the system embodying the present invention together with a web printing press.

Broadly stated, the present invention is directed to a system for use with a web printing press for providing overall control of the operations of multiple subsystems or apparatus, including one for measuring the reflective density of printed ink in real time during high speed operation and for controlling the color density and registration of the press. The system digitizes images of targets located in the test print area within an impression and analyzes the images to determine reflective density of multiple colors and generates signals for making reflective density corrections. The system also determines register misalignment and generates control signals for correcting misregistration among the various print stations.

The system is adapted for use with modern presses having extremely small test print area size, i.e., on the order of 0.062 inch, because it utilizes an extremely small register target pattern and color block sets. The color block sets used for making density measurements have blocks that are less than 0.62 inches square. With such small targets, the present invention is adapted to operate in manner that insures reliability. The system utilizes preset initial values that will be close to the proper registration and then acquires images of the register target pattern and then becomes a closed loop control system. It is important that the initial searching be done for the register target pattern because without locking onto the register target pattern, it would be difficult to acquire reflective density measurements with any degree of reliability. Once the apparatus acquires images of the register target pattern and makes any necessary register corrections, the apparatus can then reliably acquire images of one or more color block sets which are preferably located at each key across the entire web.

In accordance with an important aspect of the present invention, the system measures and controls color density and registration of the web on a key-by-key incremental basis. This is achieved by using the acquired digitized images of the density target or color block set which is printed at each key location not only for an analysis of reflective density, but also to determine the relative positions of the various colors that comprise the color block set to measure any register misalignment. Thus, the system is adapted to provide register control on an incremental basis across the entire width of the web.

The system also includes a process manager for presetting jobs, efficiently carrying out press make-readies, building a database by gathering all necessary operating data on the press and its systems, monitoring press systems and equipment such as the color density and registration control apparatus, web guides, ribbon slitting and convergence apparatus and the like.

With respect to the reflective density measuring and control apparatus, it determines reflective density values of each color of ink that is printed on a web, preferably a paper web, by a web printing press of the type which has a number of printing stations, each of which is adapted to print impressions of an individual color. Full color printing presses generally print cyan, magenta and yellow, in addition to black, but modern presses may have additional printing stations for printing other colors. The apparatus is adapted to produce the reflective density values for each of the colors in a reliable and accurate manner in real time, while the web is moving at high speed during a printing operation.

The apparatus is adapted to produce the reflective density values by acquiring digitized images of the moving web using a stroboscopic illumination and thereafter analyzing the digitized images in various ways by examining the intensity of individual pixels of the image. The apparatus operates to acquire digitized images even while the press is running at speeds in excess of 3000 feet per minute and the reflective density values for each measurement can be produced in real time.

The apparatus utilizes a multiple color CCD matrix sensor which acquires a matrix image and which has an internal means such as a prism which separates or splits the light into the red, green and blue components which are then processed in separate channels. Thus, each matrix image that is acquired by the multiple color CCD matrix sensor produces a separate channel of the colors red, green and blue and these channels correspondingly measure the reflective density of the printed ink colors of cyan, magenta and yellow, respectively. It should be understood that the sensor may have other types of internal means for separating the light into the red, green and blue components, such as a mosaic filter or a striped filter, for example.

It is generally known to those skilled in the art that it is difficult to reliably and accurately measure printed ink reflective density, even using conventional hand-held densitometers that have existed for many decades. Such densitometers are prone to produce measurements that drift, and it is common for these devices to have to be manually recalibrated often. The apparatus provides reflective density measurements that are accurate and reliable as a result of automatic calibration, and is adapted to convert reflective density values to substantially the same readings that are measured by a densitometer. While the densitometer readings theoretically range between 0 and approximately 3, with the higher number representing minimum reflectivity and the lower number representing 100% reflectivity, the working range is generally within approximately 0.5 and 2.5, with the 2.5 value representing the darkest black that is generally capable of being printed.

The apparatus utilizes certain test print areas that may include several sets of small solid color blocks of cyan, magenta, yellow and black. The color block sets are printed across the width of the web at specific locations associated with the ink zone adjusting control mechanisms (often referred to as keys) of the printing press. The test print area can include sets of solid color blocks as well as sets of screen color blocks, combination screen and solid color blocks and multiple solid color blocks that have been overprinted. As is well known in the art, the control mechanisms adjust the ink feed in zones that extend across the web. The mechanism varies the quantity of the ink that is present and available to be ultimately transferred to the web during a printing operation. The mechanisms are spaced apart from one another approximately 1 to 2 inches, so that for a 38 inch wide press, there are approximately 24 zones. Modern presses can print webs that are 56 inches wide and may have 38 keys across the width of the press. The apparatus utilizes print test areas at each key location so that reflective density can be measured every 1 to 2 inches.

Each of the print test areas comprise color block sets which contain rectangular or square color blocks that are adjacent one another, with each color block set preferably having six color blocks, including color blocks of black, blue, magenta and yellow in a preferred sequence. The color blocks are sized relative to the digitized image that is acquired so that a well placed image acquisition will include all six color blocks which will necessarily result in at least one color block of each color including black. The digitized image is preferably comprised of 760 pixels by 480 pixels, with each pixel having an intensity value that can vary between 0 and at least 255. The correlation between the analog intensity value and digital density value can be either linear or nonlinear.

However, as a part of a calibration capability, the white level is preferably set at an intensity value of greater than 200 and less than 255 and the black level is preferably set to have an intensity value of greater than 0 and less than 63. The white level is set by acquiring an image of a certified white standard (preferably 99% reflective), and the black level is set by acquiring an image of a certified black standard (preferably 2% reflective). The apparatus also compensates for variations in the intensity and color temperature of light produced during individual firings of the strobe units which can be as much as 5%. This is done by measuring the illumination of each firing of the strobe units to yield a correction value which is used in such compensation. The apparatus also compensates for any discontinuity of illumination across the area of the field of view of which the image is being acquired, and is referred to as light field discontinuity compensation. This light field discontinuity compensation data is stored in memory for use in compensating for such unevenness during operation.

Additionally, because of the nature of the optics, there is some degree of light scattering in the apparatus. This creates what is known as a light scattering effect in that the intensity of the pixels measured within the area of analysis are influenced by the amount of and location of reflected light in the field, i.e., the printed matter itself, and depending upon the content of the printed matter, there can be a variation in the intensity reading of the area of analysis itself. The apparatus compensates for such light scattering characteristics. The calibration and compensation for the light scattering and light discontinuity variations, and strobe illumination variations, are important in producing an accurate reflective density value during operation.

It should also be appreciated that a significant amount of paper contamination exists in a printing press environment and such contamination can greatly influence the accuracy of measurements. Also, the printing process is less than perfect and various anomalies can result in unwanted spots and blemishes on the test print areas themselves. Arrows and other indicia are also printed on the web for reasons unrelated to the test print areas and such indicia is occasionally printed overlying the test print areas which can create problems in the proper operation of the apparatus. For these reasons, the apparatus includes analysis routines which insure accurate and reliable performance correcting for pixels that are not within intensity levels that are expected and performing analysis of measured values to provide a reliable resulting reflective density value.

Turning now to the drawings and particularly FIG. 1, which is a block diagram illustrating the system of the present invention in conjunction with a web printing press which has a plurality of printing stations which are not shown in detail, but which may number from generally 4 to 6 stations. Each of the stations is adapted to print a particular color which also typically includes cyan, magenta, yellow and black, together with specific auxiliary colors which may include green and burnt orange, for example. As shown in FIG. 1, a web 10 is introduced to a web printing press which substantially encompasses all of FIG. 1 and which initially includes a web guide 12 which positions the web laterally as it is introduced to the print stations. Each print station will print an individual color on the web during the printing process. Registration adjustments may be made at each printing station by apparatus 14 which is known to those of ordinary skill in the art.

The registration adjustment mechanism 14 is controlled by a color density and registration measurement and control apparatus 16 which generates signals for use by the registration adjustment subsystem 14 responsive to signals received from a CCD sensor or imager 18 that preferably includes a strobe mechanism to obtain images from the moving web during operation. The imager and strobe are hereinafter described in more detail. The control apparatus 16 generates signals for an ink feed adjustment apparatus 20 to control the color density of the various colors that are being printed on the web. As shown in FIG. 1, the registration adjustment mechanism 14 and the ink keys adjustment mechanism 20 are provided for each printing station, such as the representative printing station identified in FIG. 1. As is well known to those of ordinary skill in the art there will be such mechanism provided for each color that is printed by a separate printing station.

After printing, a second web guide 22 is often provided to align the web for entry into a ribbon slitter and convergence apparatus 24 that is controlled by a ribbon controller 26. With the advent of much wider webs being printed by modern printing presses, it is necessary to slit such a wide web into a plurality of ribbons that must then be converged into a single sheet width composite which is ultimately cut and formed into a magazine or the like. The ribbon controller 26 is connected to a process manager 28 that is in communication with a customer computer 29.

The process manager performs three main functions, to download preset data to the press control apparatus, to do so using a standard protocol, and to gather data relating to the operation of the press and its control apparatus for several purposes.

The data relating to the job is preferably in a standard protocol which is known in the industry as CIP-3. The CIP-3 parameters include such things as web width of the press, the location where paper is to be introduced to the press, the amount of coverage present, the settings for the ink keys, the ribbon configuration, the ribbon registration, among other items of information. The process manager receives this information and downloads it into the various apparatus for presetting the apparatus in accordance with the particular job being undertaken. The presets enable the press to be started and various independent apparatus are adapted to take over and fine tune the operation of the press based upon the operation and analysis that is carried out.

During start up of the press, the process manager receives information concerning the operation of each of the apparatus, i.e., the color density data, the register data and the ribbon control data and the process manager monitors the data to determine if it is within tolerances that are specified by the standard protocol. If the values go outside of the expected limits, then the press operator is alerted to such a condition and he can determine if there is a significant problem with regard to the operation of the press. The process manager also sees data continuously from the apparatus and thereby compiles a time based database relating to the operation of all of the apparatus, which can be used to determine the overall operation of the press, including the cause of any particular problems and their duration. This information can be of significant importance in terms of the press company dealing with its customers which may insist upon rebates because of inadequate quality or the like. All of the data that is gathered can then be used to generate selected reports that can be communicated to the customer if desired. The process manager also monitors the time base data to compare how long the desired results took for particular actions compared to the standard protocol.

It should be understood that the process manager is shown to be connected to the apparatus and mechanisms of the press, such as the web guides 12, 22, the ribbon controller 26 and the color density and registration measurement and control 16, all of which are preferably physically located on or near the press. However, the process manager may be located near the press or it may be installed at a remote location that may be thousands of miles away. The most significant requirement to having it, as well as the other controllers identified, in a remote location is that the communication link between the press location and the process manager must be reliable and have the necessary bandwidth to transfer massive amounts of data. When that exists, then the operations that are carried out by the process manager may become outsourced services that a press company would purchase from a vendor.

Figure 2:
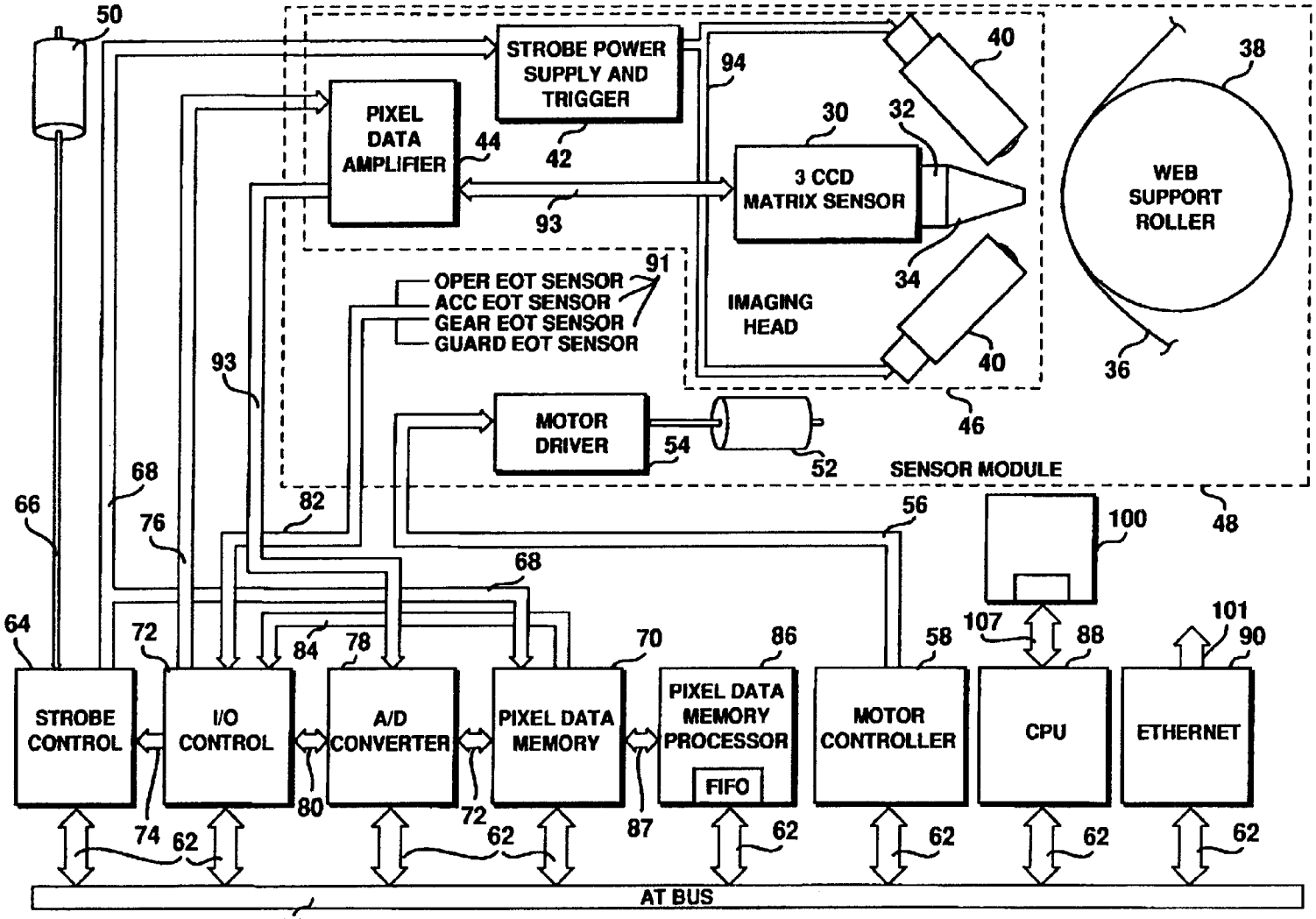
FIG. 2 is a block diagram of the reflective density measurement apparatus which monitors matter printed by a web printing press on one side of a web.

FIG. 2 which shows a block diagram of the reflective density measuring and control apparatus includes a CCD matrix sensor 30 having a lens 32 with a nozzle structure 34. The CCD matrix sensor 30 is adapted to acquire matrix images of a web 36 that is wrapped around a web support roller 38 so as to present the side of the web having indicia printed thereon so that the CCD matrix sensor 30 can acquire matrix images of portions of the web. A pair of strobe units 40 are provided adjacent to the CCD matrix sensor 30 which direct illumination toward the web from opposite sides and illuminate the area of the web 36 from which matrix images are acquired by the CCD matrix sensor during operation. The strobe units 40 effectively freeze the web so that matrix images can be acquired even though the web 36 may be traveling at high speed.

The CCD matrix sensor 30 and strobe units 40 as well as a strobe power supply and trigger module 42 and a cable interface and pixel data amplifier 44 are shown to be within a dotted line 46 which represents a carriage structure having an imaging head which is adapted to traverse the width of the scanner roll and beyond for the purpose of acquiring matrix images of the web. Another dotted line 48 represents the portion of the apparatus which is mounted on the sensor module. An encoder 50 is also interconnected with the press and measures the running speed of the press and is necessary to synchronize circumferential (the fire angle) so that the matrix images are acquired at the correct time to obtain the test print area in the view of the CCD matrix sensor.

A motor 52 is also mounted on the press so that it is adapted to drive the carriage back and forth to accurately control the position of the CCD matrix sensor. The motor 52 is preferably a stepping motor driven by a driver 54 which receives signals via lines 56 from a controller 58. The apparatus preferably includes a cabinet which contains the components and circuits that are shown near the bottom of FIG. 2. The motor controller 58 is connected to a 16 bit bus 60 via bus connection 62 which is similar to other bus connections to other components, including a fire control 64 which receives the encoder signals from the encoder 50 via lines 66 and which provides output signals to the strobe control 64 via lines 68 which also extend to a pixel data memory 70 which is adapted to receive the digitized images and perform some of the analysis steps with respect to the data in the digitized images.

A input/output (I/O) control 72 provides control for operation of the pixel data memory, the CCD matrix sensor, strobe control 64 and motor control portions of the apparatus. Lines 74 extend from the I/O control 72 to the strobe control 64 for controlling the synchronization of the firing of the strobes and acquiring of the matrix image by the CCD matrix sensor, the latter functionality being carried out by data that is sent over lines 76. The I/O control 72 also is interconnected with an analog-to-digital converter 78 via lines 80 and the I/O control 72 receives sensor information from the sensor module 48 via lines 82, as well as data relating to the operation of the pixel data memory 70 via lines 84. There is a pixel data memory processor 86 for the pixel data memory 70 and it is interconnected with the pixel data memory 70 by lines 87. Similarly, the A-to-D converter 78 which converts the analog matrix image acquired by the CCD matrix sensor to a digitized image in either a linear or nonlinear manner is interconnected with the pixel data memory 70 by lines 73. The converter 78 can be of the type which has a 32 bit processing capability. It should be understood that intensity levels from 0 to 255 for three colors occupies only 24 of the 32 bits, and therefore 2 additional bits could be utilized for the three colors to provide 10 bit resolution, i.e., 1024 intensity levels.

The main processing capability is performed by a CPU 88 with an Ethernet capability or with a separate Ethernet network card 90 is also provided for networking multiple apparatus. The sensor module 48 contains a number of sensors, including three end-of-travel (EOT) sensors 91 which provide signals indicating that the carriage has moved to a location that is at or near the end of its travel and which provides signals via lines 82 to the I/O control to stop the motor 52, further operation of which could cause damage to the apparatus. The CCD matrix sensor 30 provides analog signals of the acquired matrix image to the amplifier 44 via lines 93 and control signals for firing the strobes 40 are provided via lines 94.

Figure 3:
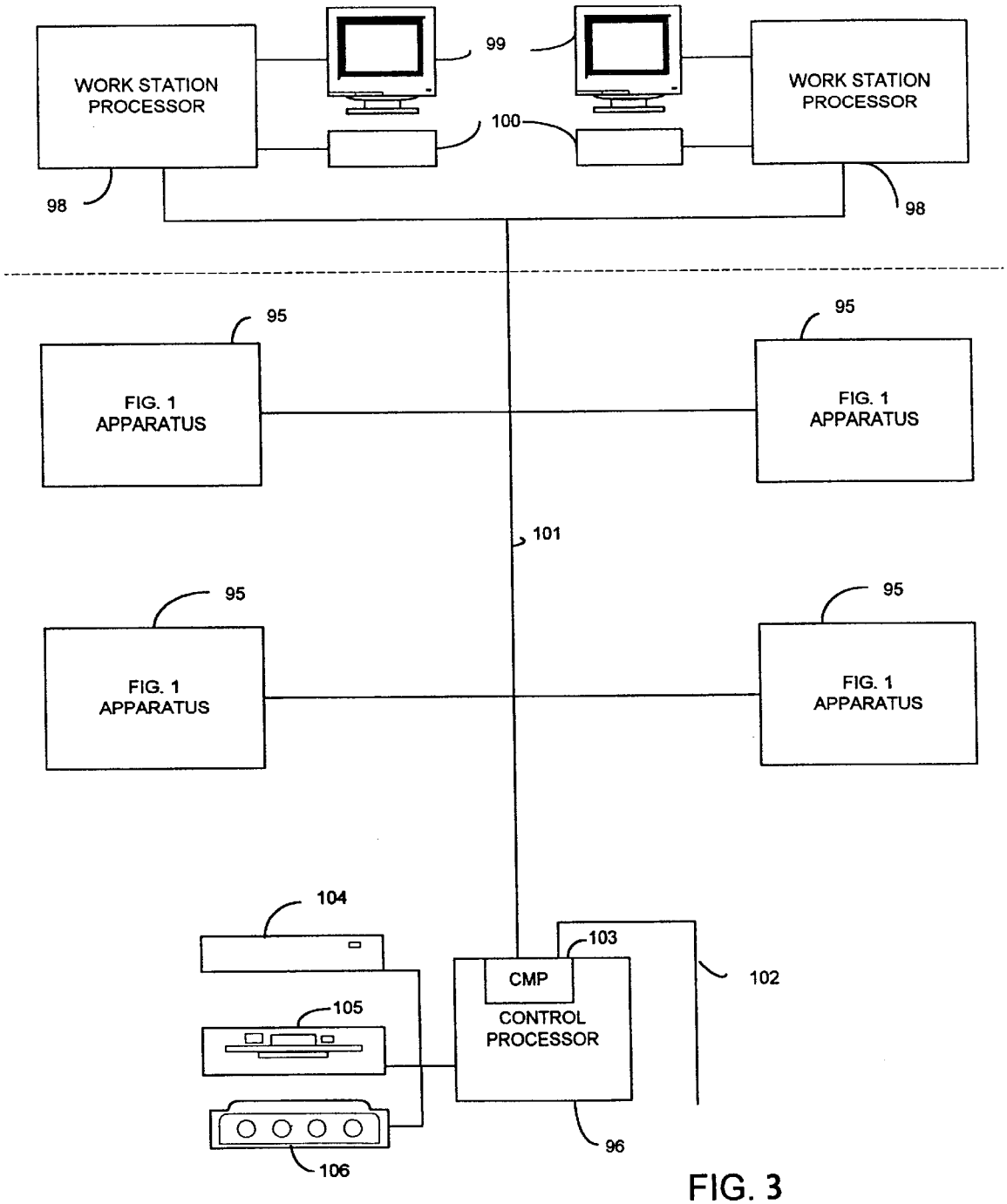
FIG. 3 is a block diagram of reflective density measurement apparatus which monitors matter printed on two sides of two webs.

While most of the operation of the apparatus is carried out by that shown in the block diagram of FIG. 2, it should be understood that this block diagram is only a part of a total installation on a printing press. The apparatus is adapted to measure the reflective density and make geometric measurements of print test areas, which may include a neutral gray test dot array, for a complete press that generally involves printing on both sides of a web. It is also adapted to measure the reflective density of print test areas on two sides of two webs, such a system is shown in FIG. 3, which has four of the apparatus shown in FIG. 2, identified at 95, a control processor 96, a work station 98 for each web, with each work station having a monitor 99 and a keyboard 100. The work stations 98, individual apparatus 95 and control processor 96 are interconnected with an Ethernet network 101, and the control processor 96 may have a network 102 to link the apparatus to the printing establishment network. The control processor includes a central message passer (CMP) module 103 which operates to communicate messages from each component on the network 101 to another of the components. Thus, all messages from any processor to any other processor are controlled by the CMP 103. The apparatus also has a hard disk 104, a floppy disk 105 and a modem 106 connected to the control processor 96. Data relating to the status and operation of the apparatus can be stored on the hard disk 104, and data can be loaded and unloaded using the floppy disk. The modem 106 permits long distance diagnostic and maintenance work to be done on the apparatus.

It should also be understood that the CPU 88 of the apparatus of FIG. 2 as well as the other processors of the system are preferably Pentium class or equivalent microprocessors. As will be hereinafter described, there are microcode operations that are performed in the pixel data memory processor 86 which could be carried out by the CPU 88. Similarly, there may be functional operations performed by a particular component in FIG. 2 that may be carried out in other components. It is also expected that as the speed of processing continues to increase through advances in computer technology, fewer microprocessors may be necessary than are shown in FIG. 2.

The present invention essentially involves the implementation of concepts that are described herein, including particular routines and subroutines that are described herein which implement the invention as claimed. While unquestionably essential in that it must perform the calculations to carry out the routines in a very rapid manner, the particular hardware configurations may appear to be quite different from that shown in FIG. 1. For example, certain subroutines can be carried out in dedicated hardware.

Figures 4A, 4B:
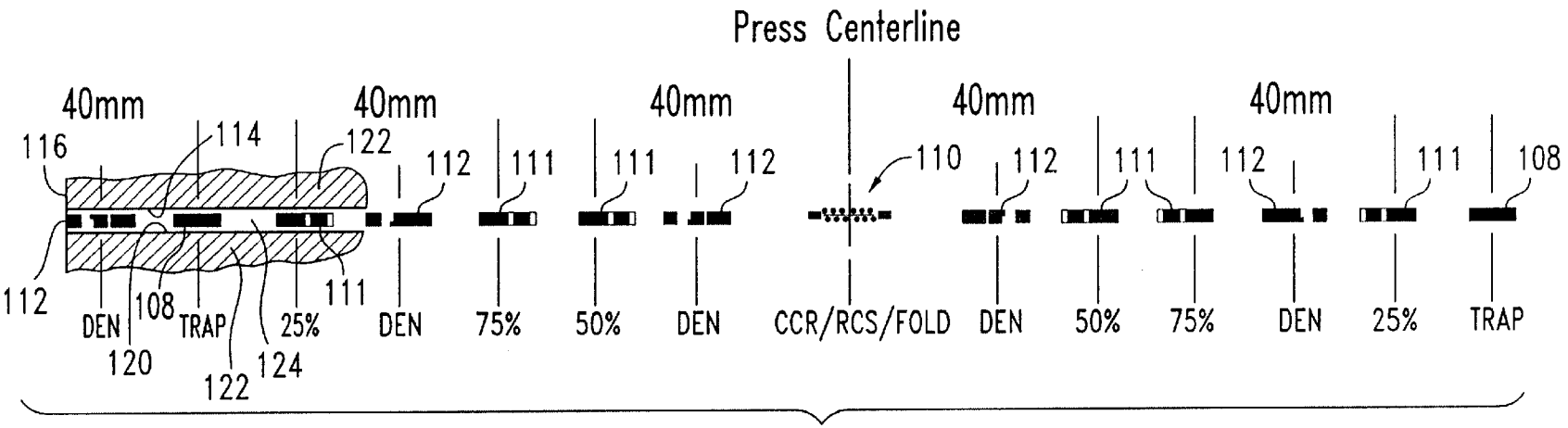
FIGS. 4A and 4B are drawings of a portion of a web where various targets are printed across the width of the web.
Figure 5A:
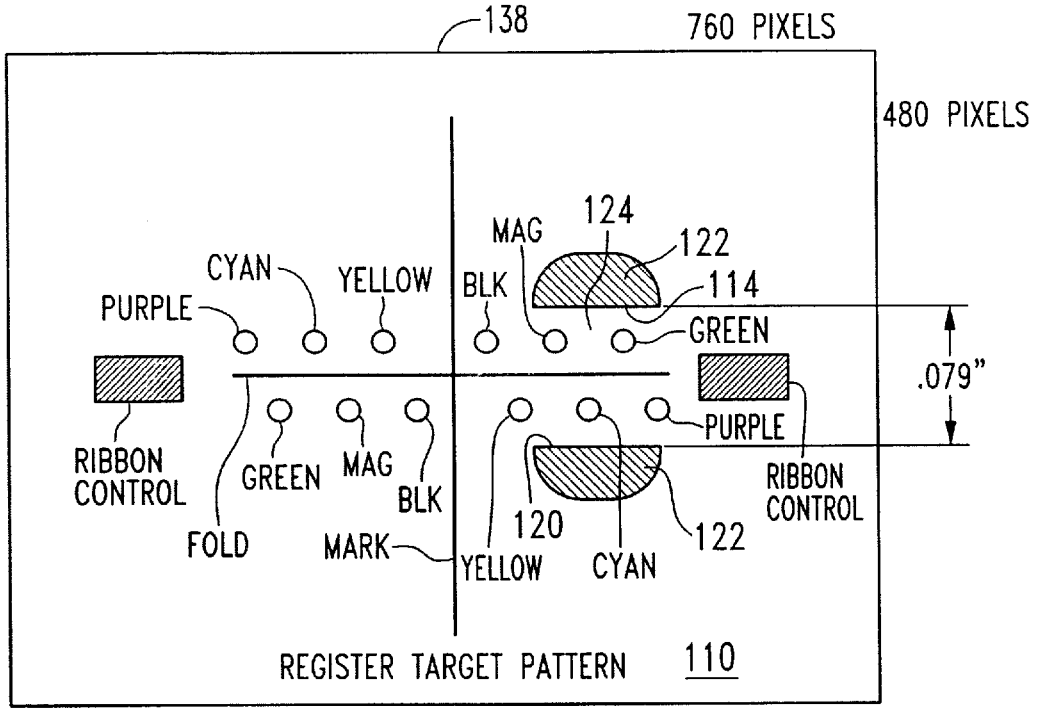
FIG. 5A is a drawing of a register target pattern used in the present invention.
Figure 5B:
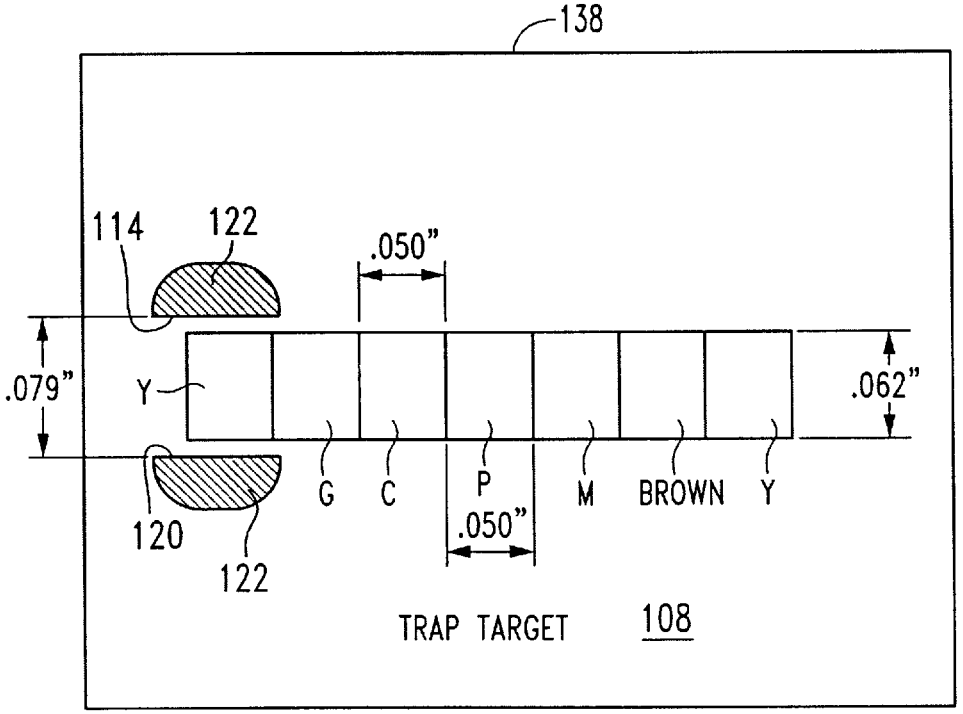
FIG. 5B is a drawing of a trap target used in the present invention.
Figure 5C:
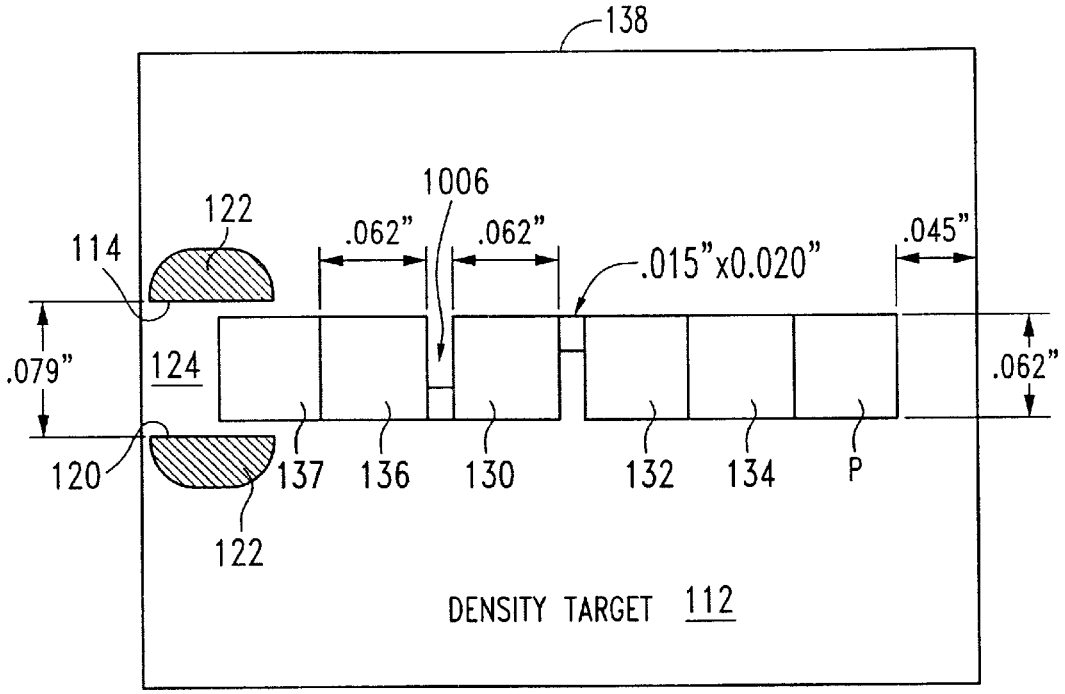
FIG. 5C is a drawing of a density target or density color block set used in the present invention.
Figure 5D:
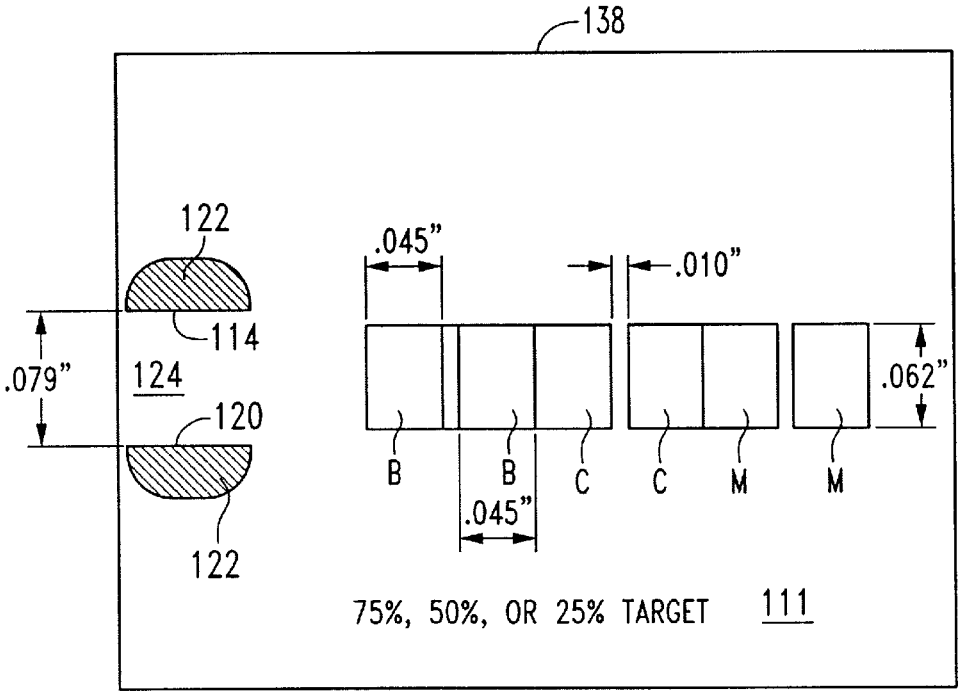
FIG. 5D is a drawing of a screen target or screen color block set used in the present invention.
Figure 5E:
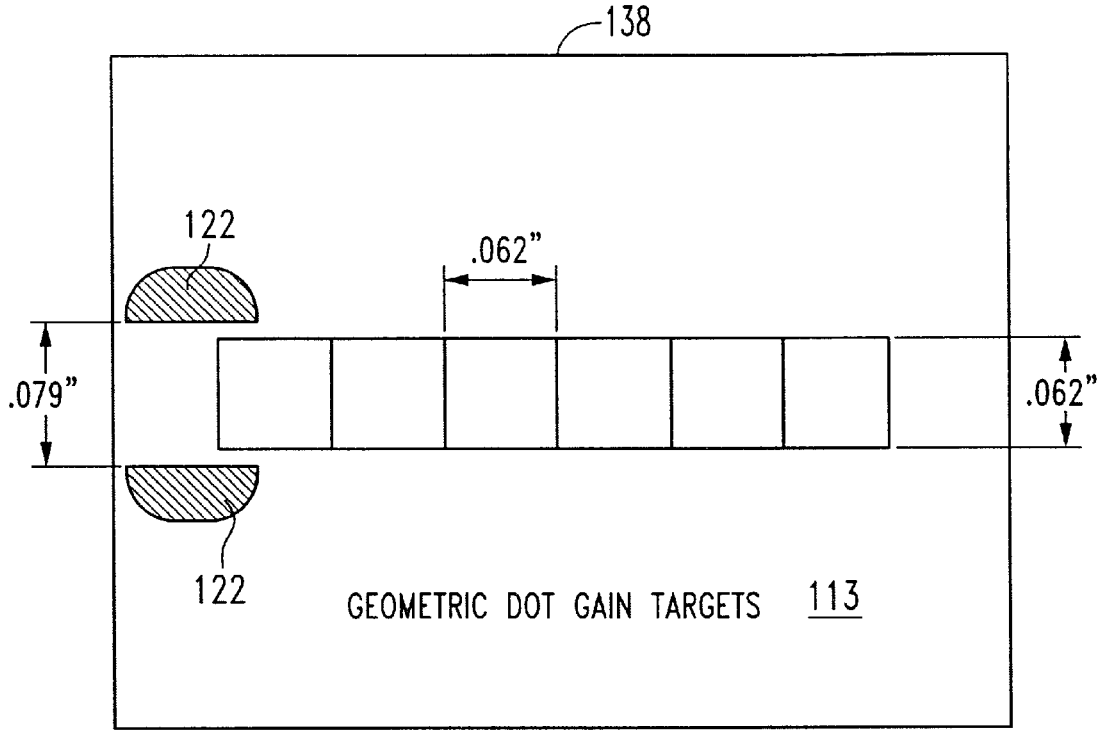
FIG. 5E is a drawing of a geometric dot gain target or color block set used in the present invention.

The apparatus utilizes test print areas that are printed on the web as shown in FIGS. 4A, 4B, and 5A–5E. The configuration of that shown in FIG. 4A provides a greater amount of information per key, because it has three target blocks per key across the width of the press, while the FIG. 4B configuration has two target blocks per key. The incremental width of each key is typically 40 mm, and in both configurations, the density color block set 112 is located in the center of each key. Both of the FIGS. 4A and 4B configurations include a trap target block 108 (shown in detail in FIG. 5B) that is made by overprinting portions within the target block with ink combinations of the colors of magenta, cyan and yellow. FIGS. 4A and 4B also have a unique target pattern 110 which comprises six pairs of dots, a pair of ribbon control blocks and a horizontal and vertical lined fold mark, which is shown in detail in FIG. 5A. The target pattern 110 is preferably located on the centerline of the press and is important during startup of the press to obtain initial registration as will be described. Other block sets 111 include various screens such as 25, 50 and 75 percent screen portions as shown in FIG. 5D and block set 113 which is used to measure dot gain and is shown in FIG. 5E. FIGS. 4A and 4B include the trap target block 108 as well as screen and solid blocks 111, and particularly illustrate solid color block sets 112 that are used for determining the reflective density of the various color blocks that are a part of the set and for controlling the registration of the press. A particular color block set 112 is shown in FIG. 5C, and it should be understood that other color blocks 112 may have the same general configuration, but that the location of the small extensions 131 on the black block may vary along the web. This can enable easy independent identification of the color blocks 112 along the width of the web.

Referring to the illustration of FIGS. 4A and 4B, they have the line 114 which represents the bottom of the printed matter of the page, the left edge 116 as well as a line 120 which represents the beginning of the printed matter for the following page. The printed matter is indicated generally by the hatched lines and is identified at 122. Each of the color block sets comprises six color blocks located adjacent one another and each color block set 112 is positioned adjacent a control zone or key of the press which in FIGS. 4A and 4B is shown to be on centers of 40 millimeters or about 1.575 inches. The area between the lines 114 and 120 represents a test print area 124 which contains indicia such as the color block sets 112 as well as other indicia for measuring and controlling cut lines, for example.

Referring to the enlarged illustration of a single color block set shown in FIG. 5C, the set comprises six color blocks of the colors cyan, magenta, green, purple, yellow and black. While the particular number and type of color blocks may vary from the six shown, the number illustrated in the color block set of FIG. 5C has proven to be an effective number. More particularly, there is a black color block 130 located in the center, a cyan color block 132 to the right of the black color block, a magenta color block 134 is located adjacent the cyan, a purple block 133 located adjacent the magenta block 134, a yellow color block 136 is positioned adjacent to the black color block and a green block 137 at the left end. The black color block 130 has a tab 131 in the upper right and lower left comers as shown in FIG. 5C and the tab is located at a different comer in sequence for each color block set that is printed on the web as shown in FIGS. 4A and 4B. The tabs provide information as to which color block set has been located, and enables the apparatus to determine if a color block set has been skipped during a pass of the CCD matrix sensor.

Figure 6:
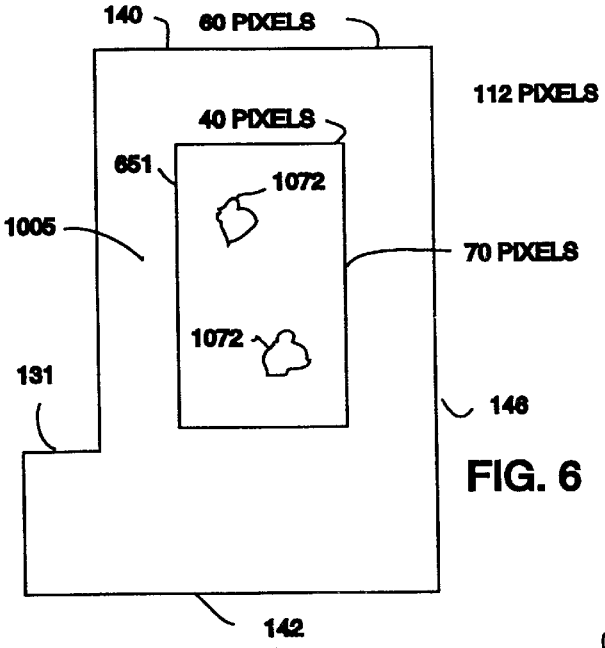
FIG. 6 is a view of a representation of a single color block from a density color block set, together with two spots.

The CCD matrix sensor 30 is positioned close enough to the web 36 that it obtains a matrix image that is approximately 500 thousandths by 380 thousandths of an inch. In FIGS. 5A–5E, a rectangle 138 represents the approximate size of the matrix image that is acquired by the CCD matrix sensor 30 relative to the size of a color block set 112. This physical size produces a matrix image, which when digitized results in a matrix of individual pixels of 760 pixels by 480 pixels. The apparatus actually produces three of such matrix images, one for each of the colors of red, blue and green. With such a physical to pixel ratio, each pixel represents approximately 0.0006 inches. This ratio enables the apparatus to determine the shape and size of printed objects, including the size of dots printed in various screens, and particularly the dots that are printed in screen targets used for calculating print contrast and dot gain. Additionally, with respect to the color blocks 112 shown in FIG. 4A, their measurement in pixels is approximately 95 by 95 pixels and a single solid color block 136 is shown in FIG. 6. The outer boundaries of the color block 136 shown in FIG. 6 include a top end 140, a bottom end 142, a left end 144, a right end 146 and the tab 131.

For a block set 111 that has a 75 percent screen, which is used to determine print contrast, an image of the block set 111 can be acquired and the size of the individual dots can be accurately measured. This enables the apparatus to measure dot gain and print contrast by geometric measurement of the pixels of the known blocks. Such geometric measurements on known sized targets permits more accurate control of be made between the balance between inking and water dampening so that superior sharpness can be achieved in this type of offset printing.

Utilizing reflective density, dot gain can be calculated by the well known Murray-Davies equation $$\%\text{apparent dot area}=100\times(1-10^{-(D9t)-D(p)})/(1-10^{-(D(s)-D(p))})-50$$

where D(s) is density of the solid, D(t) is density of the screen, and D(p) is density of the paper.

With respect to the trap target 108, the apparatus is adapted to analyze an image of it and determine the apparent trap according to the equation $$\%\text{ apparent trap}=100\times(Dop-D1)/D2$$

where Dop is the density of overprint minus paper density, D1 is the density of first-down ink minus paper density and D2 is the density of second-down ink minus paper density.

Similarly, print contrast can be determined by acquiring and analyzing a digitized image of the 75 percent screen/solid combination block and using the following equation $$\%\text{ print contrast}=100\times(D(s)-D(t))/D(s)$$

where D(s) is the major filter density of the solid and D(t) is the major filter density of the screen. The orientation of the combination screen and solid block 110 with the screen and solid portions being adjacent one another in the web direction provides more accurate print contrast measurements, because the comparison is done using the screen and solid portions that are in the same circumferential line, and there will be less potential for ink takeoff to change the inking of a screen portion relative to an adjacent solid portion.

Figure 11:
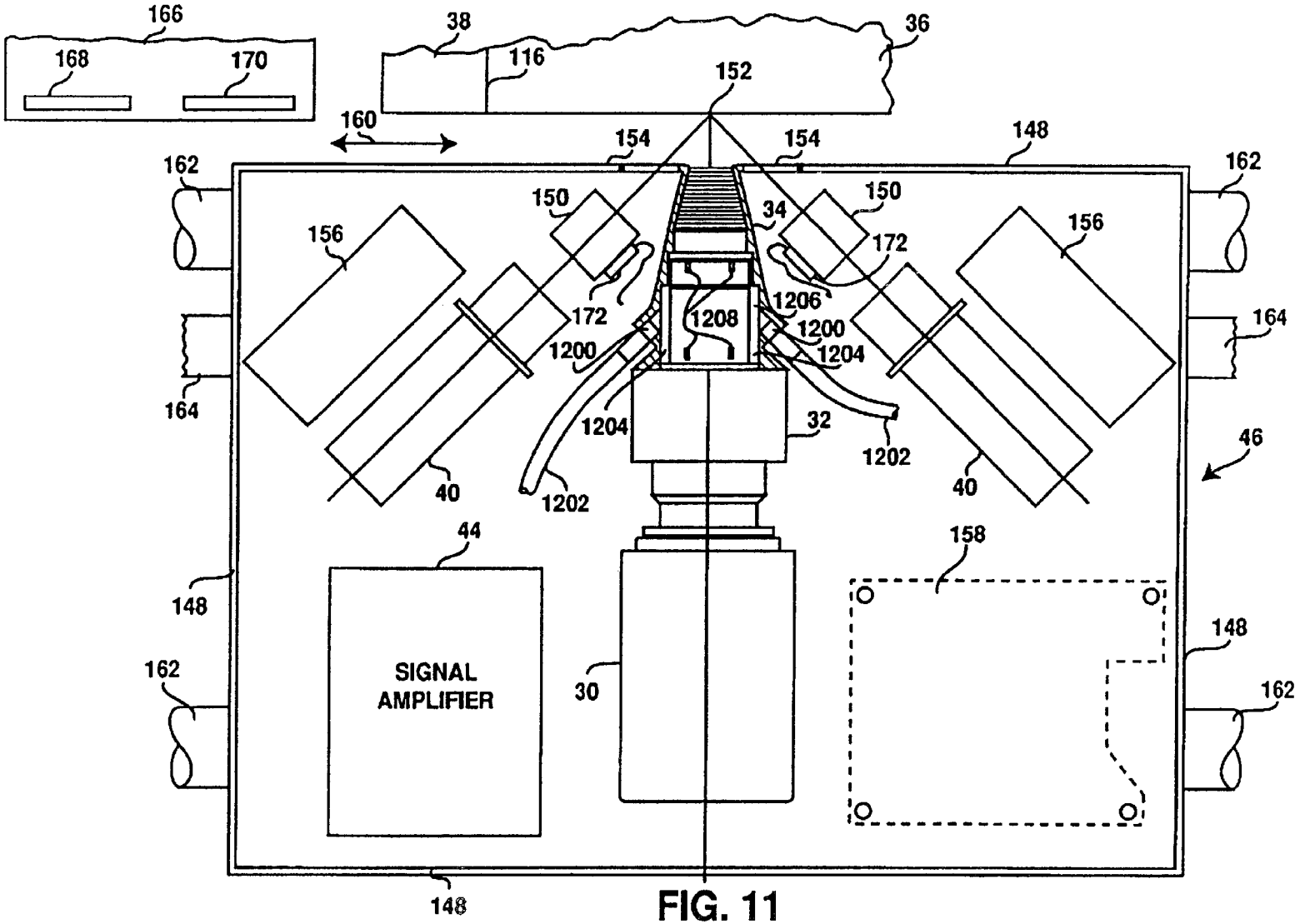
FIG. 11 is a plan view with portions removed and partially in cross section illustrating the imaging head, the head being shown in position to acquire a matrix image of a portion of a web.

With respect to the carriage mechanism 46, it is shown in more detail in FIG. 11 and comprises an enclosure having outer walls 148, which enclosure holds the CCD matrix sensor 30 and strobe units 40. While the illustration of FIG. 11 is greatly simplified, the strobe units 40 are shown to have collimating lenses 150 positioned near the output and direct the center of the strobe light to a point 152 that is also coincident with the center line of the CCD matrix sensor 30. Thus, the strobe illuminates the area of the image on the web 36. The light from the strobe units exits the wall 148 through transparent windows 154 that are located adjacent an opening through which the CCD matrix sensor nozzle 34 extends. Capacitors 156 are positioned adjacent the strobe units 40 and a power supply 158 for the strobe units is positioned in the lower right corner as illustrated. While the top of the enclosure is not illustrated, it should be understood that it is completely enclosed and preferably substantially sealed from the exterior so that dust particles cannot be admitted into the interior thereof. In this regard, the only opening is the opening in the end of the cone 34 which is air purged of the CCD matrix sensor 30 so that the matrix images can be acquired of the web 36.

The carriage structure is moved laterally relative to the web, i.e., left and right as indicated by the arrows 160 by moving along a pair of rails 162 that are associated with cooperative mounting structures (not shown) on the underside of the carriage 46. The carriage is moved laterally by a belt drive 164 that is connected to a drive sprocket or the like connected to the motor 52 of FIG. 2. The exact structure of the rails 162 and belt 164 is well known to those of ordinary skill in the art. The carriage 46 is adapted to move laterally along the web 36 and also may extend to the end of the web 116 as well as beyond the edge onto the web support roller 38 itself.

The carriage 46 may also be moved to an enclosure 166 that is schematically illustrated and which contains a white standard 168, and a black standard 170 which may be located near the end of the range of travel of the carriage 46. While not illustrated in FIG. 11, it is preferred that the standards 168 and 170 be contained in a dust free environment which means that the enclosure 166 is substantially sealed except for those times when images are acquired of the standards. It is preferred that the normal end of travel not extend to the enclosure 166, but that if images are to be acquired of the standards, then the carriage can be moved farther to the left and suitable actuation being accomplished to open substantially sealed doors or the like to expose the standards 168 and 170 so that images of them can be acquired.

In this regard, the operation end of travel sensor provides a signal indicating that the carriage 46 has moved to the end of the web support roller 38. The ACC end of travel sensor indicates the end of travel at the enclosure 166, with the opposite end of the roller 38 being controlled by the end of travel sensor 91. As will be explained hereinafter, photodiodes 172 are provided adjacent the collimating lenses 150 and are in position to provide a signal that is proportional to the output of the strobe units 40 and this signal is part of the information that is transmitted to the A-to-D converter 78 via lines 93 for use in adjusting the intensity values of pixels that are a part of the acquired digitized image after the analog matrix image has been digitized.

The CCD matrix sensor 30 is of the type which includes an internal prism that splits the light into three paths or channels, i.e., red, green and blue. Thus, each acquired matrix image provides three matrix images, one for each of these colors and the three matrix images are sent to the A-to-D converter 78 where they are digitized into three separate digitized images. The intensity values of the individual pixels of the digitized image will be low for the channel in which the ink color is of interest. It is desirable to provide a photodiode responsive to the color of each channel to compensate for variations in total intensity as well as color temperature, and in such event, there would be additional sensors provided, which are similar to the sensors 172 shown in FIG. 11. Such sensors may be manufactured to be responsive to individual colors of red, green and blue, or there may be filters attached to them to make them responsive to such individual colors.

While the red, green and blue components of the signal represent an additive process for producing the full range of the color spectrum, the printing of colors on a web is a subtractive process and there is a relationship between the CCD matrix sensor channels and the ink color being processed. For example, yellow takes away one of the channels, as does magenta and cyan take away one of the other two channels. Black is a color that takes away all three channels. Yellow is the absence of blue, so a blue channel of perfect yellow ink would yield no blue and 100% red and green. With cyan there is no red, so the red channel would be zero, and the green and blue channels would be approximately 100%. The magenta channel will have no green, but approximately 100% red and blue. Black is the absence of all 3 channels, so that perfect black would yield no red, green or blue. When yellow is printed on top of cyan, the blue and red channels are taken away and green is left. Thus, as is well known to those skilled in the art, when ink is printed, it is a subtractive process, whereas with light when red and green are added, yellow is obtained which is an additive process.

With the present apparatus, it is necessary to only look at one channel at a time and if its signal level is low, it will reveal a reflective density valuation because reflective density is the lack of reflectance of a color. A high density ink is very dark which means that it reflects less of that color. The reflective density is what is being determined by the apparatus and it is only necessary to analyze the three channels individually to determine the reflective density of each of the three colors of cyan, magenta and yellow. Black reflective density is determined by a single channel or the average of all three channels.

Figure 12:
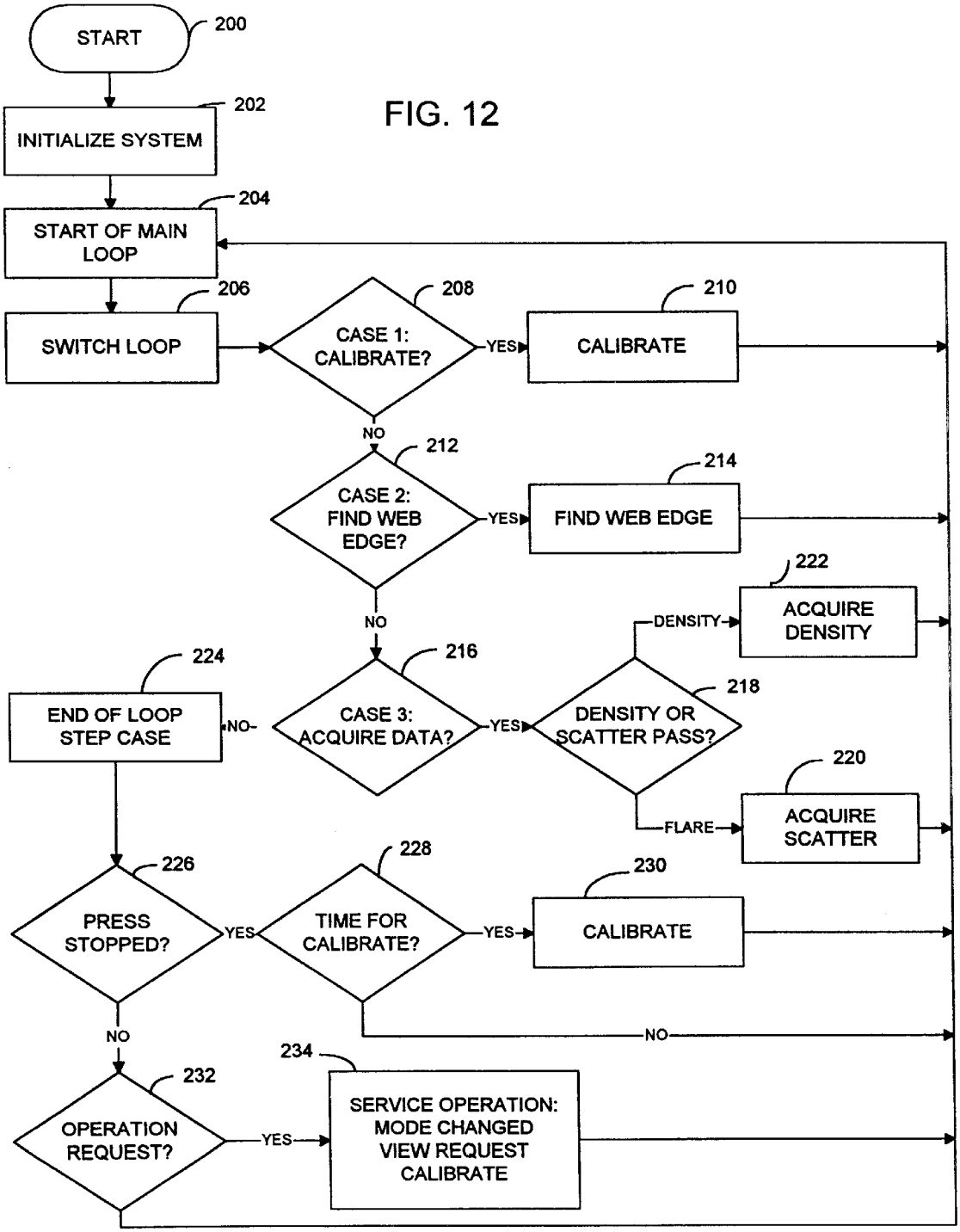
FIG. 12 is a flow chart illustrating the operation of the main image control program.

With respect to the operation of the apparatus, and referring to FIG. 12 which is a flow chart illustrating an overview of the operation of the apparatus, a start block 200 causes initialization of the system as shown by block 202 and this results in starting of the main loop (block 204) which results in a multiplexing function (block 206) which switches among various cases which control various aspects of the operation of the apparatus. The routine inquires whether it should calibrate the CCD matrix sensor (block 208) and does so during start-up (block 210). If the CCD matrix sensor has been recently calibrated, the routine then inquires if the edge of the web has been found (block 212) and if it needs to be found, then it executes a routine for finding the web edge (block 214).

As will be hereinafter described, there is more than one subroutine for finding the web edge, which generally is a function of whether there is printed material on the web or not. If the web is unprinted, then the determination of the edge of the web is more easily accomplished than if it is printed. In any event, once the web edge is found, the routine returns to the start of the main loop 204. If there is no need to find the web edge, i.e., it is known, then the routine sequences to case to determine whether data should be acquired (block 216) and if so, a determination is made as to whether reflective density data should be acquired or light scattering data acquired (block 218). If the press run is new so that light scattering data has not been acquired, the apparatus acquires light scattering data (block 220).

During this operation, the apparatus traverses the entire web and acquires images of color block sets and necessarily includes the register target pattern 110 shown in FIG. 5A. As previously mentioned, this target pattern is preferably printed on the centerline of the press, but can be printed at a multiplicity of other predetermined locations, and is used to initially determine the condition of the registration of the press. When all printing stations are in register, the target pattern 110 shown in FIG. 5A is printed. If any station is out of register, the dot pair printed by that station will be out of position relative to the other dots. Because of the small size of the test print area in which the color bar sets and register target pattern are printed, it is necessary to make any necessary register adjustments, and have those adjustments propagate through the printed web before reliable image acquisitions can be made for the purposes of performing reflective density measurements and utilizing the color block sets to perform register correction at each key across the width of the web.

Once light scattering data has been acquired, then the apparatus is set up to acquire reflective density data (block 222). As will be described, during light scattering data acquisition, the apparatus sequences the CCD matrix sensor to acquired matrix images at each key location sequentially across the web, digitized the matrix image and performs an analysis to determine the content of the degree of whiteness in the acquired digitized image, with all pixels in the digitized image being measured with respect to a threshold white value to determine the amount of light scattering compensation that should be performed with respect to each particular image. This is a function of a printed matter adjacent to each key.

After reflective density data has been acquired, the end of loop block is reached (block 224) and the routine inquires as to whether the press is stopped (block 226). If the press is stopped, then the routine inquires as to whether it is time to calibrate the CCD matrix sensor again and if it is, then the CCD matrix sensor is again calibrated (block 230). If it is not time to calibrate, the routine returns to the start of the main loop 204. It is generally advisable to recalibrate the CCD matrix sensor if the press has stopped for a period in excess of 10 minutes. If the press has not been stopped, then the routine inquires as to whether there has been an operation request made (block 232). If such a request has been made, several service operations may be carried out (block 234). Service operations or normal printing operations may include a view request where an operator may request that an image be acquired of a particular location on the web that may be independent of the images that are acquired of the color block sets. In this regard, a press operator may wish to monitor a particularly critical area of an impression, such as a highlight, for example. Such an operation can be carried out generally concurrently with many of the other data acquisition operations by controlling the CCD matrix sensor to go to a particular location and acquire the data when time permits and then return to the normal operation of the apparatus. An operator can also request calibration of the CCD matrix sensor which is determined by the operator and is done independently of the calibrate CCD matrix sensor routines that occur during operation of the routine, such as shown at blocks 210 and 230.

With respect to the operation of the apparatus, it can operate in one of several modes including idle, start-up, sample and maintain. During idle mode, the apparatus is ready to acquire data, but is not commanded to do so. During initialization of a press run, the apparatus may be ready to operate, but once the CCD matrix sensor is calibrated, for example, it cannot acquire light scattering data until printed matter appears on the web which can be analyzed for light scattering compensation. The apparatus can determine the edge of the web before printed matter appears, and can determine the width of the web and then the system waits for printed matter to appear. Once the printed matter appears, the operator can change to a start-up mode. During light scattering passes, the CCD matrix sensor does a slow traverse to acquire light scattering data that is used to compensate for the light scattering. The slow passes for acquiring light scattering data is necessary because more data is analyzed, i.e., every pixel of the 760 by 480 pixel matrix is analyzed to determine the light scattering compensation. Once several passes are made for acquiring light scattering data, i.e., preferably approximately 6 passes, the data that is acquired is averaged over the 6 passes to provide a reliable light scattering compensation factor for use in determining reflective density.

It should be understood that during light scattering passes, images of the color block sets printed in each key across the web are acquired for the purposes of determining the light scattering compensation factor as previously mentioned. However, since the configuration of the color blocks is part of the acquired data, the configuration position data of the individual color blocks in each color block set can be analyzed to determine register measurement and control.

It should be understood that light scattering compensation data must be acquired for each of the three channels of red, green and blue, and these three compensation factors are generated for each key location across the web. The resulting light scattering compensation factors are stored in memory for use during the printing of the job. It should be understood that real time scattering correction on an acquisition by acquisition basis is possible. To carry out such functionality, an inline dedicated processor may be required.

It is generally necessary to print 500 to 20,000 impressions to set color on a press. With the present apparatus, such set up can be accomplished with substantially fewer impressions, i.e., approximately 750 to 1,000 impressions.

After the start-up mode, the apparatus is switched into a run mode where reflective density data is acquired by taking a preferably minimum number of passes of data approximately every 500 impressions. These reflective density values are stored in memory. In the maintain mode, the apparatus takes multiple passes of data approximately every 500 impressions and also stores that data in memory for use in the preparation of press run reports.

During the reflective density data acquisition, the CCD matrix sensor is traversed across the web. The apparatus can acquire a digitized image of each color block and calculate reflective density in less than approximately 70 milliseconds so the traverse speed is synchronized to the web speed of the press so that the CCD matrix sensor moves approximately 1-½ inch during each revolution. In the preferred embodiment illustrated and described herein, at press setup press speeds, the apparatus can acquire a digitized image every revolution of the impression roller so that during every second, there are may be up to 38 locations of the color keys in modern presses that may be nearly 56 inches wide from which digitized images are acquired and analyzed.

As is well known to those in the printing industry, it has often been necessary to save samples of printing jobs for possible future use in the event that the customer has a complaint about the quality of the printing of a publication or the like and it is not uncommon that a substantial area be set aside in a printing plant where such samples are accumulated. It is an expensive use of valuable floor space within a printing plant.

The reflective density data that is acquired during the sample and maintain modes provide a detailed record of the color densities of each of the colors being printed approximately every 500 impressions throughout the course of the printing run. Such data can be used to generate reports which provide frequent "snapshots" of the reflective density and therefore provide a history of the print run which can be used to satisfy the customer about the quality of the printing.

The apparatus essentially eliminates the need to save samples of a press run for the reason that the reflective density data is accumulated in memory and can be printed out after the job in the form of a report which indicates the quality of the printing essentially approximately every 500th impression. The apparatus has three lines in which the customer can identify the job including a six digit job number, a three digit form number, a three digit run number, a job name, job description and publication code.

The report also provides useful information for a press house in that it provides a record of changes that were made to the keys from the beginning until the end, including the corrections that were made in the course of reaching the point where the press was stable. This can be used as a teaching tool to keep pressmen from making unnecessary corrections in the beginning of the run. It is common for another piece of equipment in a press house to provide preset values for keys from which corrections can be made to reach a stable press operation. It is common for pressmen to make initial corrections that prove to be unnecessary in that they are premature and reflect reflective density key settings that are not stabilized before such corrections are made. With the reflective density data that is available from the present apparatus, it can be clearly shown to the pressmen that many of the initial early corrections were in fact unnecessary and that the keys were returned to a position or setting that was close to the presets, albeit many thousands of impressions later.

Figure 10A:
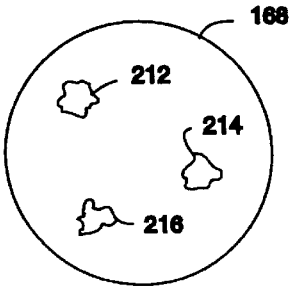
FIG. 10A is a side view of a highly reflective standard used for calibration of the digitizing portion of the apparatus of the present invention.
Figure 10B:
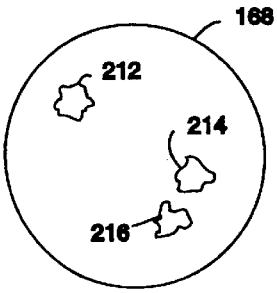
FIG. 10B is another side view of the highly reflective standard used for calibration of the digitizing portion of the apparatus of the present invention.

Referring to FIG. 11, the carrier 46 can be moved to the left as shown so that the CCD matrix sensor 30 is in position to acquire a matrix image of either the white standard 168 or the black standard 170 for the purpose of calibrating the CCD matrix sensor and the digitizing portion of the apparatus. The standards are of a generally flat circular shape as shown in FIGS. 10A and 10B and are Spectralon color standards manufactured by Labsphere, Inc., P.O. Box 70, North Sutton, N.H. 03260. The standards are calibrated and are measured for 8 degrees/hemispherical spectral reflectance factor using a double beam ratio recording integrating sphere reflectometer. As previously mentioned, it is preferred that the standards 168 and 170 be housed in a protective enclosure 166 so that dust particles will not be present on the surface of the standards which can dramatically affect the intensity readings that are obtained for each pixel during the image acquisition by the CCD matrix sensor 30. It is for this reason that the carriage preferably has a mechanism that will open a cover or the like to enable the CCD matrix sensor to acquire a matrix image of the standards 168 and 170.

To calibrate the digitizing portion of the apparatus, the CCD matrix sensor acquires matrix images of the black and white standards and the matrix image is digitized so that each pixel of the digitized image has an the intensity level that can be within the possible range of 0 to 255. However, the calibration process sets the intensity value of the black standard to the value of preferably approximately 8 and sets the value for the white standard at approximately 240. This is accomplished on three independent channels of red, green and blue and all are handled individually.

Figure 13A:
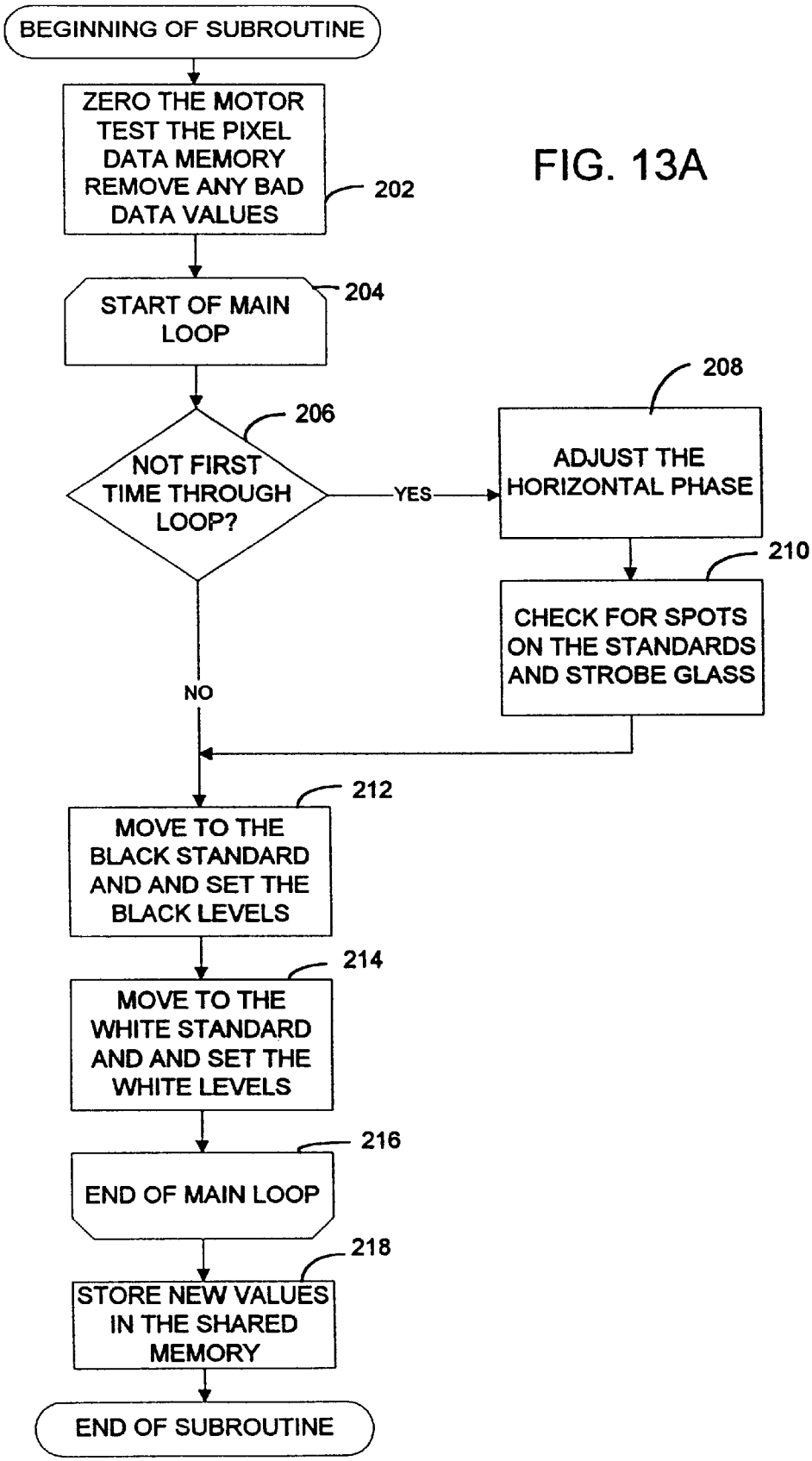
FIGS. 13A, 13B and 13C together comprise a flow chart for a software routine that is used in calibrating the digitizing portion of the apparatus at the maximum and minimum intensity levels for white and black, respectively.
Figure 13B:
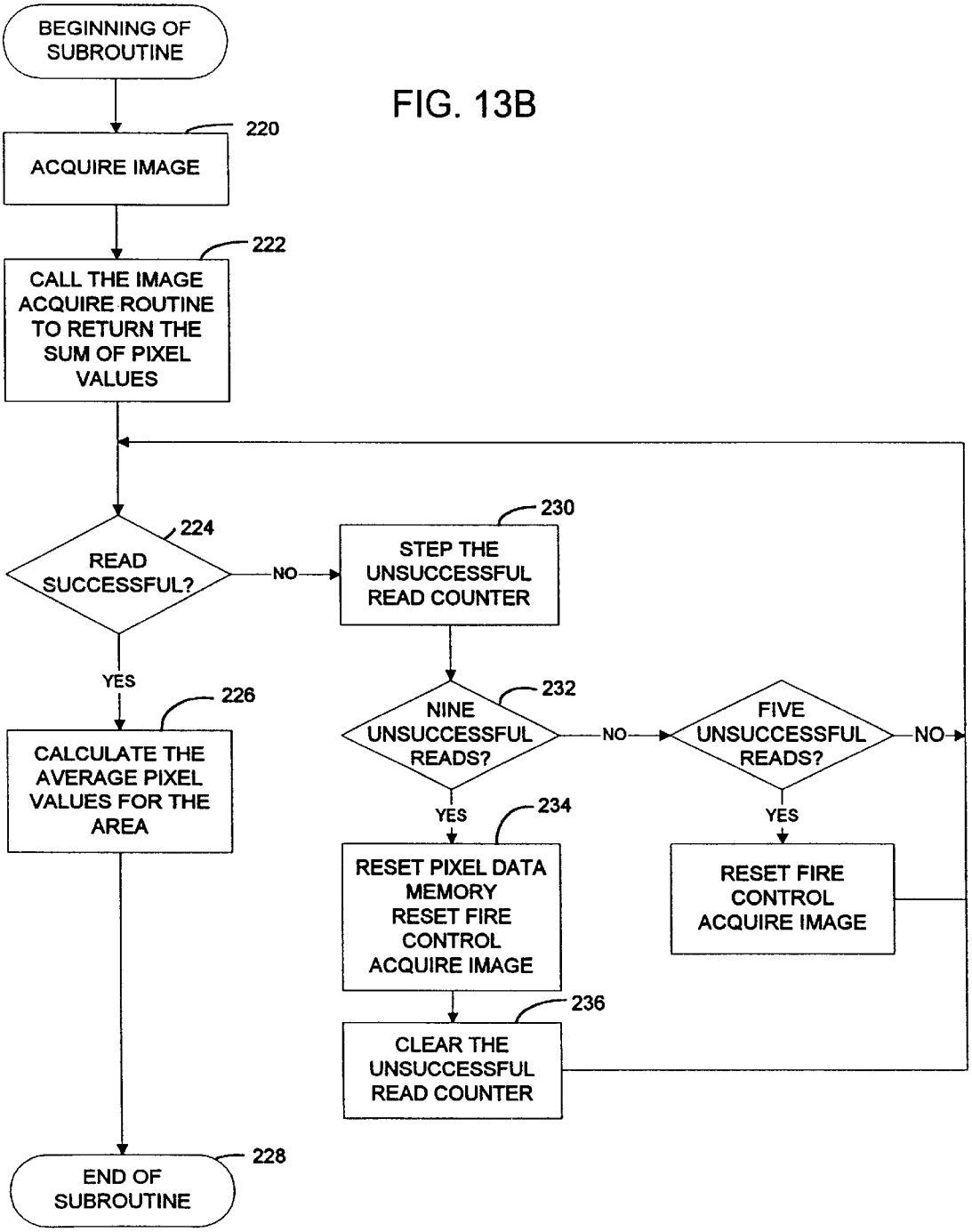
Figure 13C:
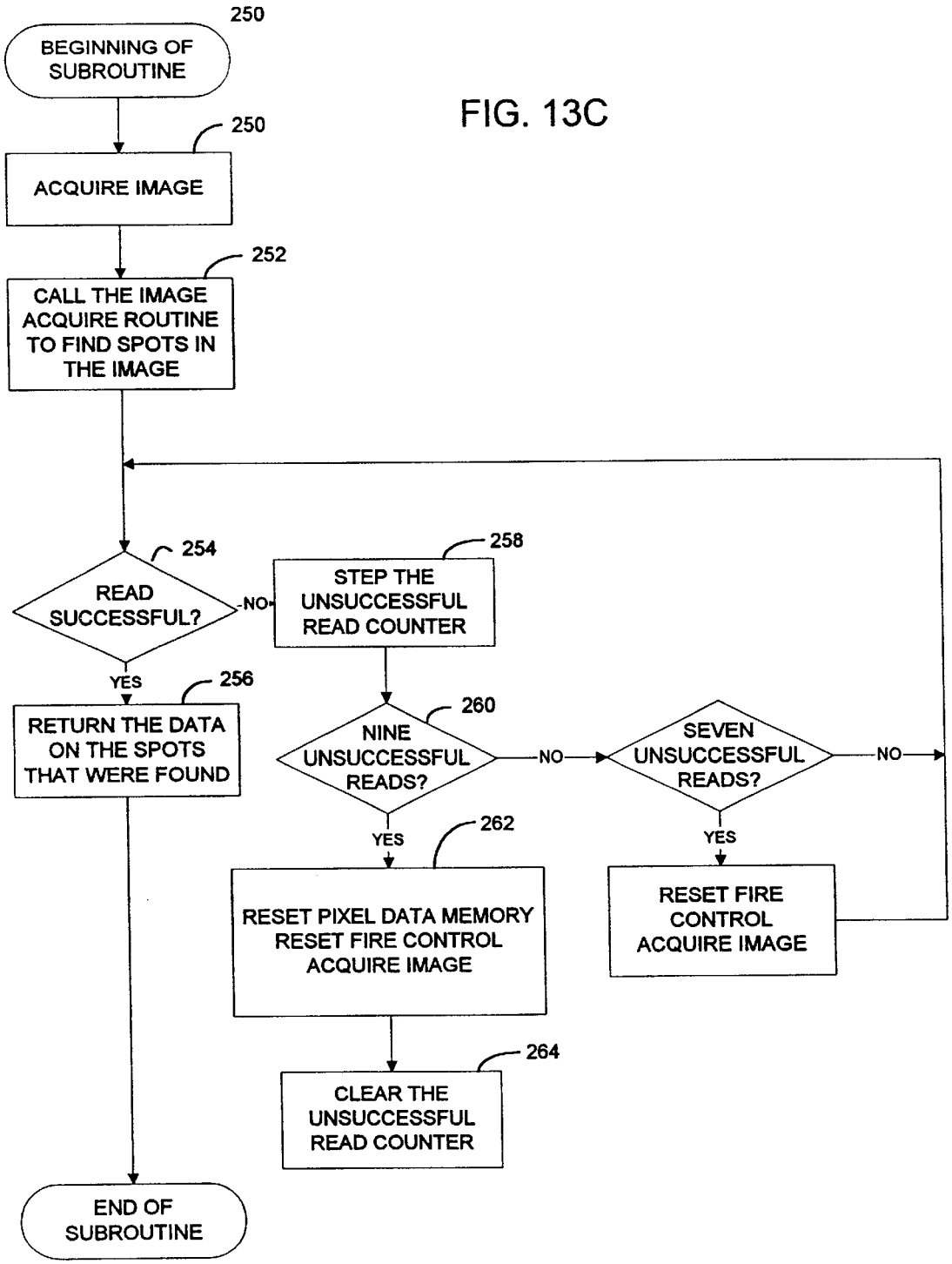

To start the calibration process, the carriage 46 is moved to the location of the standards so that matrix images can be acquired. Referring to FIGS. 13A through 13C, which is a flow chart for obtaining the white level and the black level, the motor 52 (FIG. 1) is moved to its zero position which is the end of travel limit (block 202) of FIG. 13A and the pixel data memory 70 (FIG. 1) is tested and any bad data values are removed. After this is done, the main loop is started (block 204) and the routine determines if it is the second time through the loop (block 206). If it is the first time through the loop, it merely determines whether the pixel data memory 70 is not nonfunctional. If it is the second time through the loop, then the routine adjusts the horizontal phase (block 208). This is done to make sure that the acquired matrix image includes the active video portion rather than timing information such as the horizontal pulse. The phase is adjusted so that active video is acquired.

The routine checks for spots (block 210) on the standards as well as the strobe glass window 154. This can be appreciated by referring to FIGS. 10A and 10B which illustrate two matrix images of the white standard 168 which has spots 212, 214 and 216. The matrix image shown in FIG. 10B is an exaggeration of what would be acquired after having moved the CCD matrix sensor 0.020 to 0.030 inches relative to the matrix image of FIG. 10A. The apparatus is adapted to logically determine that the spot 216, by virtue of having moved to the right in FIG. 10B relative to its location in FIG. 10A was a result of dust being located on the window 154 rather than on the standard 168 itself. Since many of these spots will detrimentally affect the accuracy of the standards, the standards and the glass windows 154 should be cleaned when such spots are detected.

However, even though the standards and windows can be cleaned, the apparatus also ignores the pixels where the spots are located during its analysis and does so by measuring the pixel intensity of each pixel and disregards the pixel if it is not within predetermined threshold values. In other words, if the matrix image is of the black standard, then the reflectance should be very low and a spot that has an intensity value above 40, for example, would be thrown out. Similarly, if the matrix image is of the white standard, then reflectance values below approximately 200 would be thrown out or disregarded during the calculation of the average of the pixel values for that standard.

After the spots are located as indicated from block 210, the routine causes the CCD matrix sensor to be moved to the black standard (block 212) and acquires a matrix image which is digitized and set to a predetermined level, which is preferably approximately 8. The CCD matrix sensor and associated components acquire successive digitized images until the level is at 8 plus or minus 0.25 pixels. If not within the range, there are adjustments made until that tolerance is met, and it may require about 8 acquisitions. The carriage 46 then moves the CCD matrix sensor to acquire a matrix image of the white standard 168 and the system is set to have the white level at 240 plus or minus 0.95 (block 214). There are successive digitized images acquired of the white standard until the white level is also within this tolerance. When this is completed (block 216), the routine returns to the start of the main loop (block 204) and the routine is repeated twice more, for a total of three times. Once this is completed, the apparatus returns to the black standard and acquires 10 digitized images which it averages to provide a value for use by the apparatus. It then does the same for the white standard and the averages are stored in memory 218.

The values that are used by the apparatus consists of only the average of the 10 digitized images for each standard that are acquired after the last pass through the routine. The reason for using these values is that there is an interaction between the black level and the white level, particularly when the black level is set to 8 and the white level to 240. Because of the slight interaction with each other, it is desirable to iteratively set the levels by going back and forth between the standards so that the resulting levels are accurate.

It should be understood that the calibration routine is run when the power to the apparatus is initially turned on, and is required to be recalibrated more frequently until the apparatus reaches stable running temperature. However, if the press is stopped, for example, the CCD matrix sensor is recalibrated to make sure that the levels are accurately set. Also, the calibration only requires approximately 30 seconds to one minute to complete.

The routine of FIG. 13A also employs some subroutines, particularly those of FIGS. 13B and 13C. The subroutine of FIG. 13C relates to acquiring a digitized image (block 220) which results in the pixel data memory 70 providing a sum of the pixel values (block 222) which is analyzed to determine if it has been successful (block 224) and if so calculates the average pixel values for the area (block 226) which results in the end of the subroutine (block 228). However, if the read successful determination (block 224) is no, then the subroutine steps the unsuccessful read counter (block 230) to attempt to find an area of good pixels, preferably an area of 300 by 300 pixels, and if it is unsuccessful in doing so after nine attempts (block 232), it resets the pixel data memory and strobe control 64 to acquire another digitized image (block 234). When that is done, the unsuccessful read counter is cleared (block 236).

With respect to the subroutine shown in FIG. 13C, the routine acquires a digitized image (block 250) and the pixel data memory 70 routine locates the spots in the digitized image (block 252) which if successfully completed (block 254) results in data identifying the spots being forwarded to memory (block 256). If the read was not successful, then the read counter is stepped (block 258) and if there are nine unsuccessful reads (block 260), the pixel data memory 70 is reset as is the strobe control 64 and another image is acquired (block 262). Once this is done, the read counter is cleared (block 264).

Referring to FIG. 11, it is apparent that the strobe units 40 are positioned to direct the center of the light to a point 152 which is also the center line for the CCD matrix sensor 30. The light passes through the windows 154 to the area of the web and illuminates the web from two directions. Since the intensity of the pixels of an acquired matrix image is a function of the amount of light that is produced by the strobe units, it is important that the area of the acquired matrix image be uniformly illuminated or that the illumination of each area be known so that any variations can be compensated for.

The apparatus does an analysis of the intensity of the light produced by the two strobe units to determine what the light discontinuity characteristic is and provides compensation for any unevenness in light across the matrix image. The apparatus does this by analyzing areas of the total acquired digitized image taken from the white standard, with the areas being preferably about 64 by 64 pixels. The apparatus averages the intensity of the pixels within each area and then stores the average value with the address or location of each area so that during compensation, any compensation factor will be applied to the measured intensity values for the pixels that are located within each area. The compensation analysis is only required to be performed during initial alignment, and perhaps if optical components are adjusted or changed thereafter.

Figure 14:
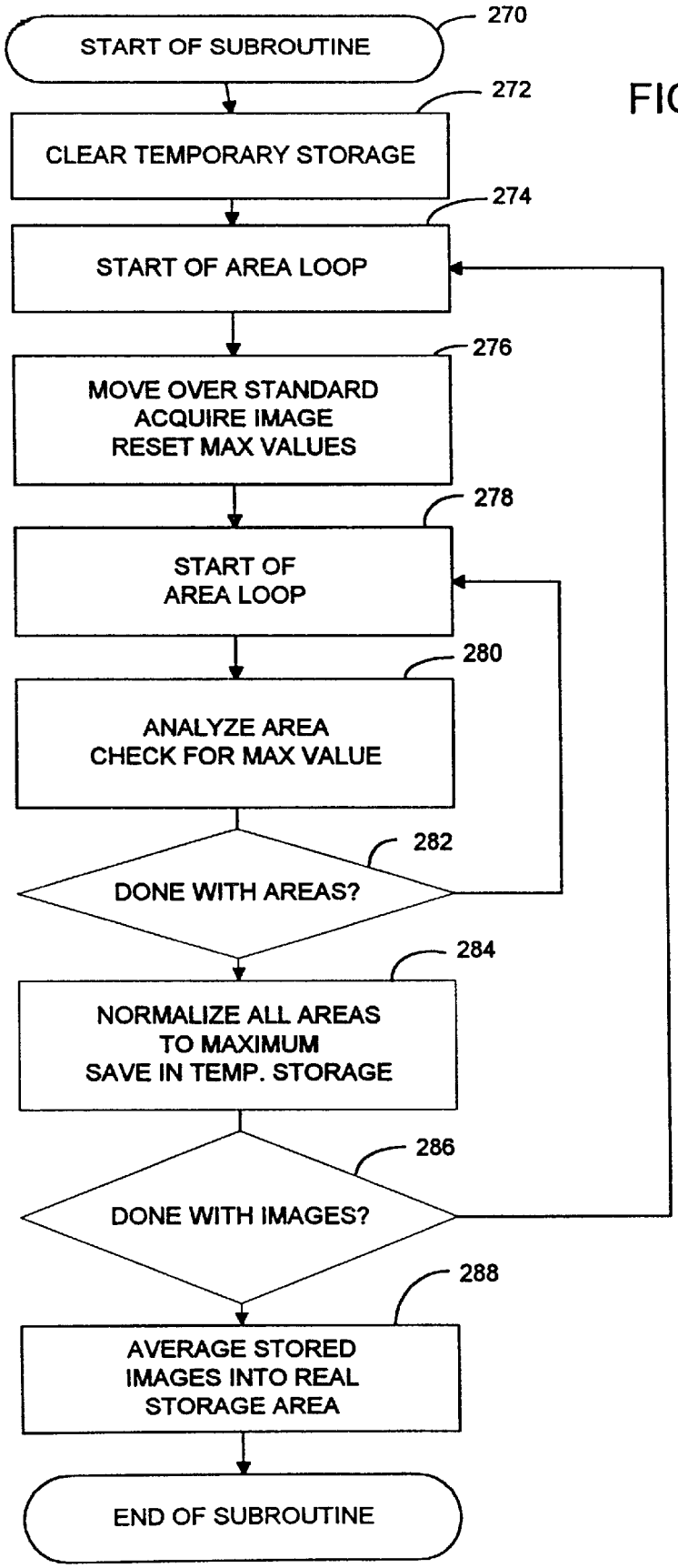
FIG. 14 is a flow chart of a routine which is used to acquire data for compensating the measurement resulting from discontinuity of illumination from the strobe means.

The software routine for performing the light discontinuity compensation is illustrated in FIG. 14 beginning at block 270. The first thing that is done is to clear the temporary storage values (block 272) and then start an image analysis loop which results in the CCD matrix sensor moving to the white standard to acquire a digitized image thereof (block 276) and reset maximum intensity values. The routine then starts an area loop 278 where sequential areas of 64 by 64 pixels are analyzed (block 280) and the average intensity value for each area is compared to noise measured and a maximum value is checked for. There are 12 by 7 of such 64 by 64 pixel areas and the light field discontinuity compensation factor is calculated by averaging the intensities in each of the areas approximately 20 times. The routine sequences through the entire acquired digitized image and continues to run through the loop until it is done with all of the 64 by 64 areas in the acquired digitized image (block 282). When it is, then the areas are normalized to the maximum and the normalized values are saved in memory (block 284). When all images have been completed (block 286), the average stored images are then stored in permanent memory.

It should be understood that there is a light discontinuity analysis done for each channel of the CCD matrix sensor system, i.e., the red, green and blue channels will each have a light discontinuity compensation factor for each of the 64 by 64 pixel areas within the image. The brightest intensity is then set at 1 and all others are then calculated relative to the brightest and are typically values such as 0.97, 0.98, 0.99 or 1.0.

The accuracy of the reflective density measurements is also influenced by the phenomenon that is referred to herein as light scattering, which means that the reflective density determination can be influenced by the relative location and content of the printed matter adjacent to the color blocks of the color block set 112 that is part of the matrix image that is acquired. As shown in FIGS. 3 and 4, the region 122 above the line 114 can and probably will contain printed matter, as will the region 122 below the line 120. The acquired matrix image 138 shown in FIG. 5C includes approximately six color blocks that also necessarily includes a portion of the areas 122 of the acquired matrix image.

Since each color block set 112 may have printed matter 122 that varies in overall lightness depending upon the content of the printed material in the image, the number of light and dark pixels can vary at each key across the width of the web. Light scattering effects are substantially produced by higher reflective values, i.e., higher pixel intensity, located in the field of view. However, within the field of view, such higher intensity pixels have more effect, the closer the pixels are to the pixels being measured. Both of these effects, i.e., the amount of high intensity pixels and their closeness to the pixels being measured, are asymptotic in character. The CCD matrix sensor has a focusing lens and a CCD matrix sensor prism which splits the matrix image into red, green and blue channels and depending upon the amount of white that is present in the matrix image that was acquired, a small area such as a color block will produce one reading if it is surrounded by black and another reading if it is surrounded by white. The light scatters when it goes through the lenses and ends up changing the reading of the color block of interest.

It has been found that if a color block set is being analyzed and the area 122 around it is all white, it is generally measured to be about 94% white. This is due to the fact that of the six color blocks, only black and the color block of interest in each channel are dark. Considering the three channels, there are therefore only 9 dark blocks in the three digitized images. If the areas 122 are black, the total white area drops to approximately 80% white.

A light scattering compensation must be determined for each of the three channels because the readings that are obtained from each of the red, green and blue channels varies relative to one another, depending on the content of the printed matter of the image being acquired. This is partly due to the fact that the strobe units are very bright in blue light, which makes yellow stand out. The strobe units are preferably Xenon strobes which have a predominant blue light component. While the output of the Xenon strobes are relatively constant, they can vary up to plus or minus 5% from one strobe firing to another and for this reason, the photo diodes 172 (FIG. 11) are positioned to measure the output of the strobe units 40 and the actual output for each strobe is fed back to the pixel data memory 70 and is used to compensate the intensity values that are obtained for the individual color blocks during the reflective density analysis. The photo diodes integrate the light put out by both strobes. While the intensity of light produced during individual firings of the strobe units can vary as much as 5%, it has been found that the variations are random and are generally about 1%. Such variations do not result in substantial variations in the intensity values produced, i.e., perhaps 0.75 pixels of intensity. However, compensation for such variations is desirable, and it may be advantageous to have three sensors for each strobe unit, with suitable filters positioned in front of the sensors, so that the intensity of the strobe unit can be measured for each color channel to have a more accurate measurement of the variations of the strobe firing for each color.

Figure 7:
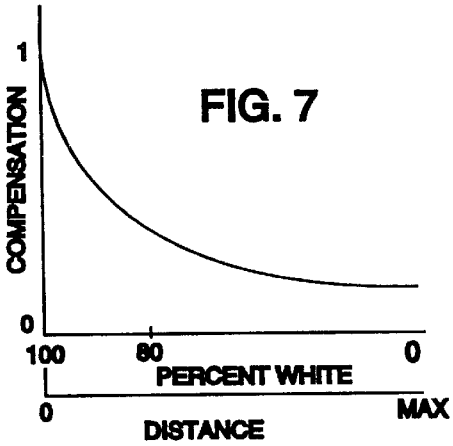
FIG. 7 is a graph of an approximate representative light scattering compensation curve.

To quantify the light scattering phenomenon, print test patterns can be used to model the scattering effect and obtain data that will approximate the light scattering compensation curve such as that shown in FIG. 7. The compensation for the light scattering phenomenon may be as much as 4 to 5 within the range of 8 to 240 and is enough that inaccurate readings would result if compensation were not made. This data is stored in memory for each color. This produced a series of data that resulted in an asymptotic chart as shown in FIG. 7 which produces intensity compensation factors that may be unity down to approximately 0.9, as the percentage of white pixels to the total pixels ranges from 100% to 0. The development of data that defines such a curve needs to be done only once for each color, and the curves are then used for each apparatus that is manufactured. However, it should be understood that the amount of light scattering compensation is done for each print job, and a point on the curve for each color for each key is stored in memory for use in compensating for the light scattering that is measured.

To develop the light scattering compensation data and light scattering curve shown in FIG. 7, the apparatus analyzes the acquired digitized image of each channel and counts the total number of white pixels within the total image to determine the percentage of white in the total image. The pixels are considered white if they have an intensity value that is greater than half way within the total range. Once the percentage is determined by averaging 6 light scattering passes of data, the light scattering data is stored in memory and is used to compensate the reflective density data that is measured during a reflective density analysis of each color block at each key during operation. It should be appreciated that the lowest percentage of white pixels possible is 80%, so the area of the curve that is actually used is the left portion of the curve shown in FIG. 7.

Figure 15A:
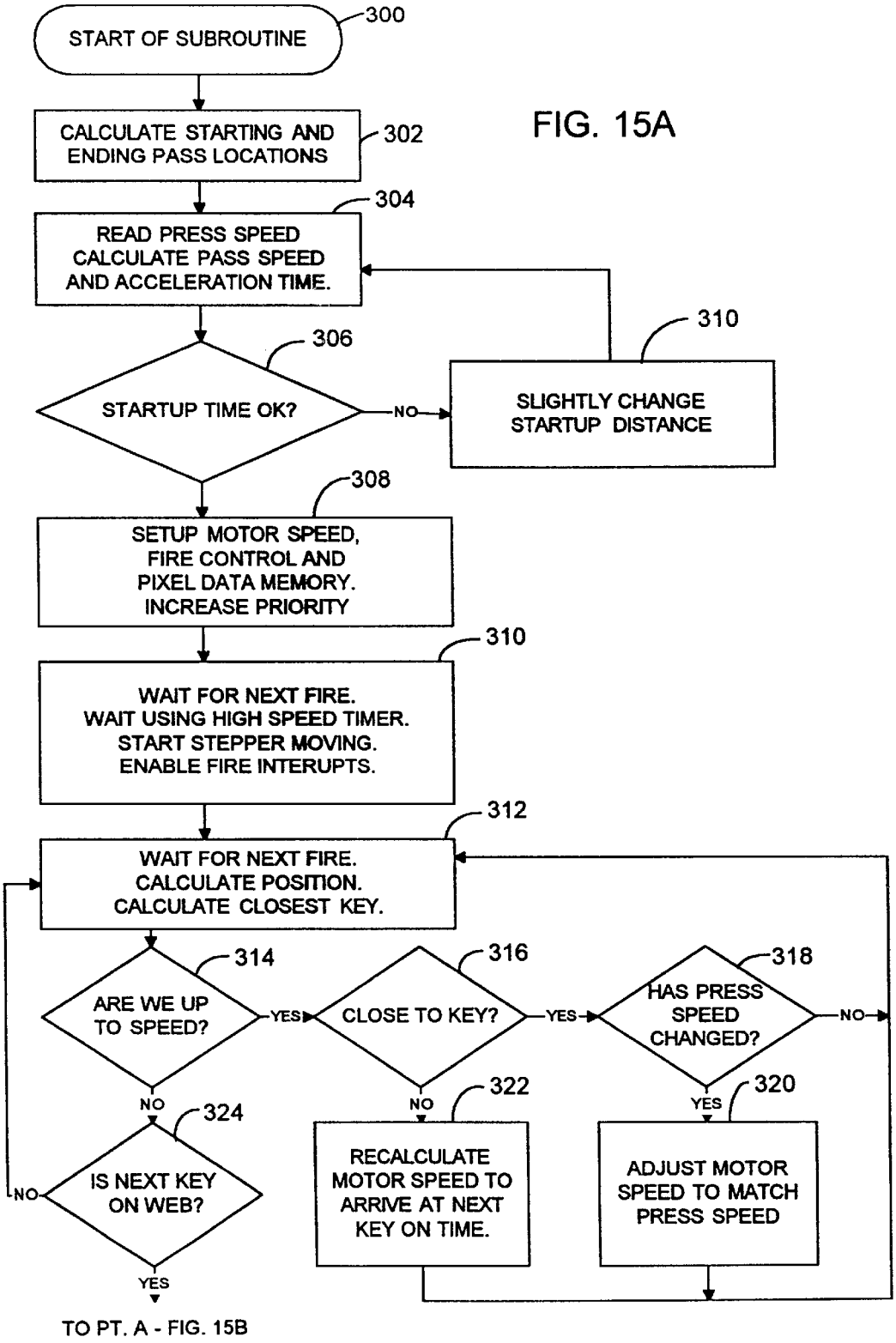
FIGS. 15A, 15B and 15C together comprise a flow chart for a software routine that is used for determining light scattering compensation.
Figure 15B:
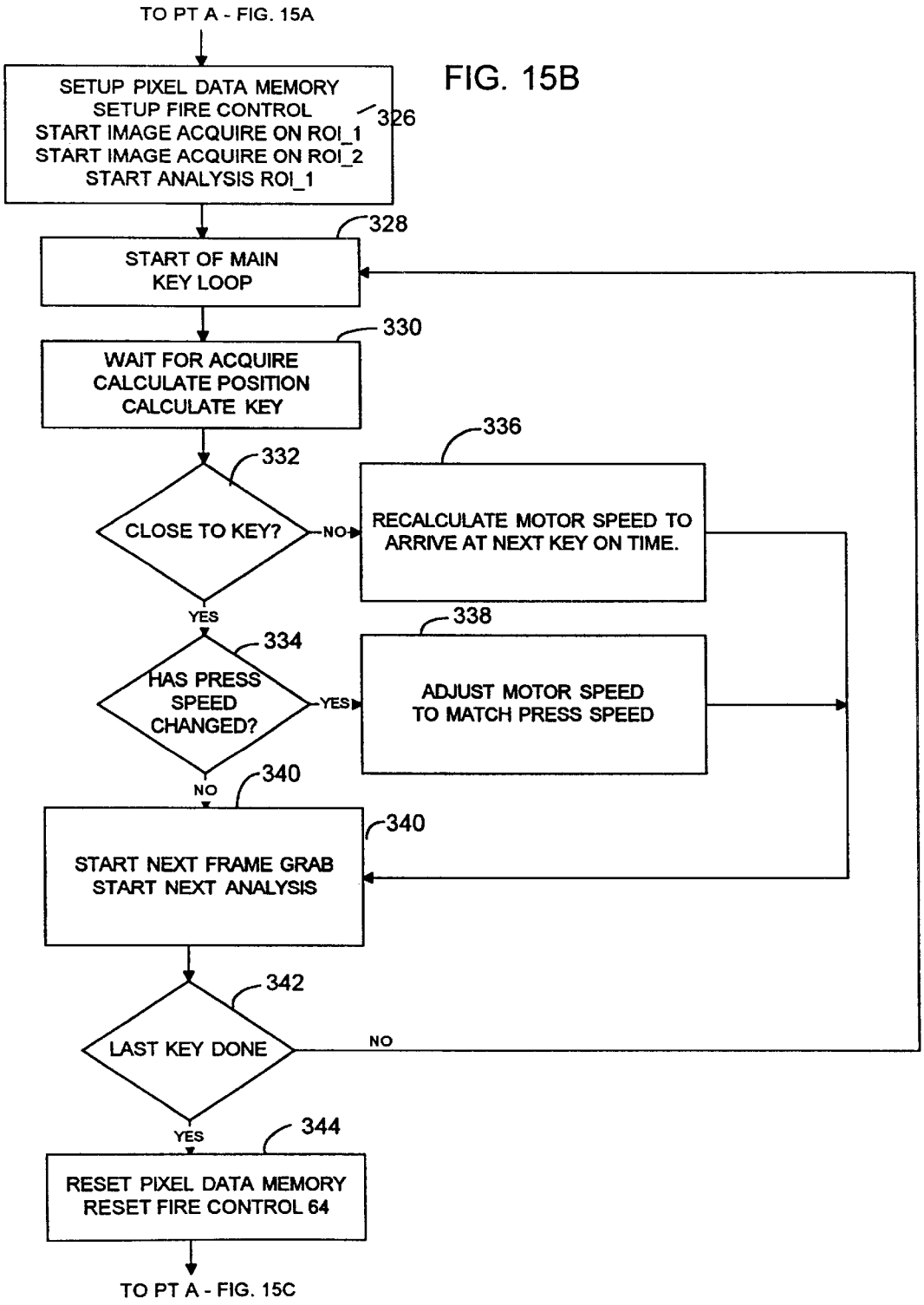
Figure 15C:
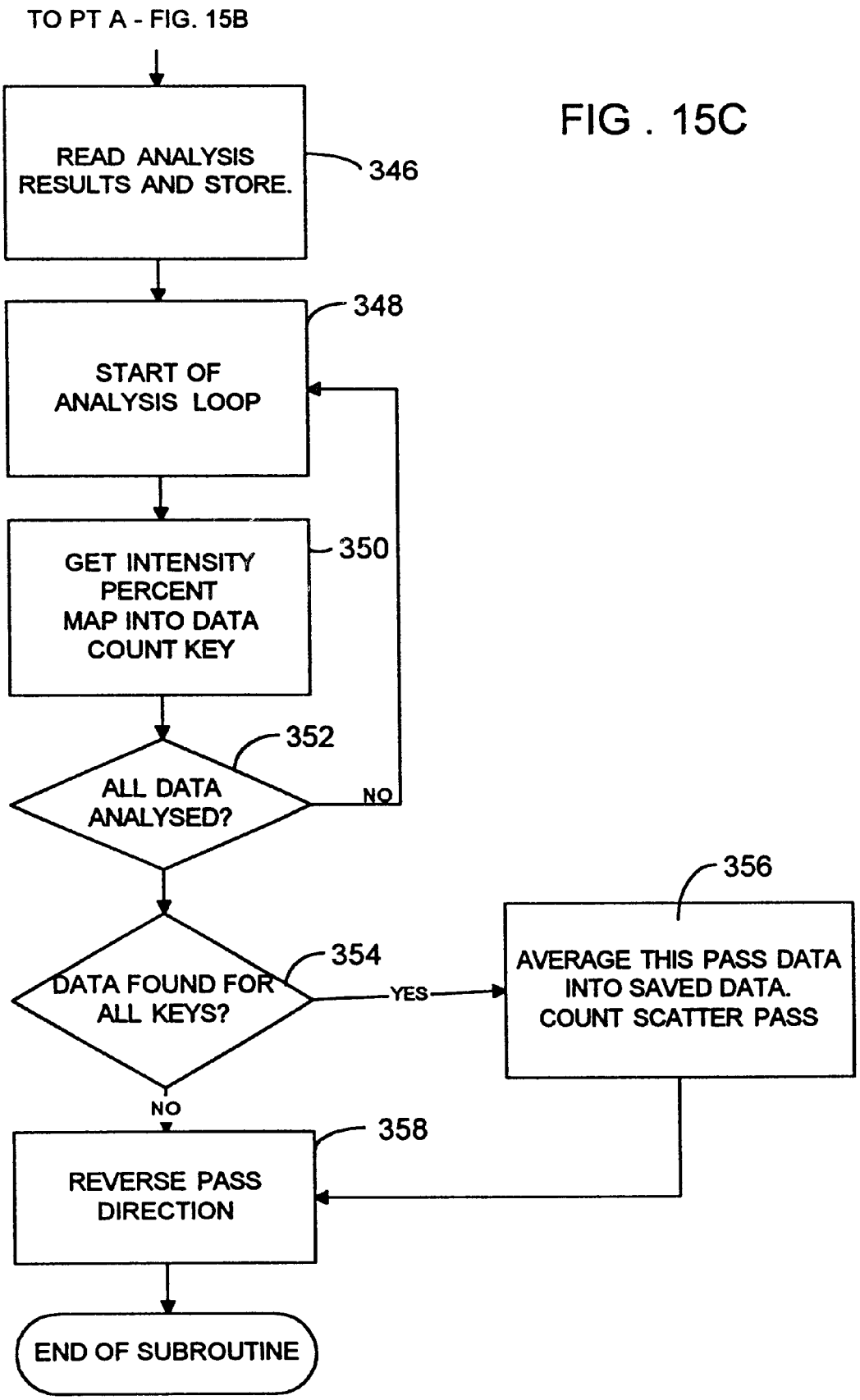

The routine that is used to acquire light scattering data is illustrated in FIGS. 15A, 15B and 15C, with starting block 300. The routine initially calculates the starting and ending locations for the pass of the CCD matrix sensor across the web. The manner in which the apparatus locates the edges of the web and the calculation of the width of the web will be described. Once the starting and ending locations are calculated (block 302), the apparatus reads the press speed and calculates the speed that is necessary to acquire images of the color block sets at each key location (block 304). The apparatus also calculates the acceleration time which is the time required for the carriage 46 to be ramped up to speed starting from a stopped position at a location that is left of the actual web edge 116 shown in FIG. 4A. The press speed is obtained from the encoder 50. If the acceleration time is acceptable (block 306) then the routine sets up the motor speed, the strobe control 64 and pixel data memory 70 and priority is established for this operation (block 308). If the start up time is not acceptable (block 306), then the motor controller 58 changes the location of the carriage 46 so that it will be accelerated and be at the proper path speed by the time it reaches the first key (block 310). If the location is changed, then the press speed is read again, and the path speed and acceleration time recalculated. After the strobe control motor speed and pixel data memory has been set up, the routine then waits for the next strobe firing opportunity as well as waits for a calculated time using a high speed timer to delay and then starts the motor 52 moving and enables strobe interrupts (block 310).

With regard to the timing of the firing of the strobe, it should be understood that for each revolution of the encoder 50, there are 3600 counts. It is known that the apparatus wants to fire the strobe at a particular encoder count of 2000, for example, and that this time is 8 milliseconds, but depending upon how fast the encoder is rotating, it may or may not require a different number of earlier counts to get the strobe to fire at the appropriate time. To determine what the count should be, the apparatus counts up for ¼ of a revolution using a fixed speed clock and it times how long that takes and determines how many counts it needs to equal 8 milliseconds. When that is determined, it resets the CCD matrix sensor and then down counts and fires the strobe at the 2000 count.

The apparatus then calculates the position and calculates the distance to the closest key (block 312), confirms whether the carriage 46 is up to speed (block 314), which if yes, inquires as to whether the CCD matrix sensor is close to the key (block 316), and inquires whether the press speed has changed (block 318), and if not, it then does the next fire of the strobe and acquires an image (block 312). If the press speed has changed, then the motor speed must be adjusted to match the press speed (block 320). If the CCD matrix sensor is not close to a key (block 316), then the motor speed is recalculated to arrive at the next key on time (block 322).

Also, if the carriage is not up to speed (block 314), the routine inquires as to whether the next key is on the web (block 324), and if not, returns to block 312. If the key is on the web, then the apparatus sets up the pixel data memory 70 and the strobe control 64 and it fires the CCD matrix sensor to acquire two images (block 326) and starts the analysis of the first image.

The routine then starts the main key loop (block 328) and calculates the position and the key number (block 330), determines whether it is close to the key (block 332), inquires if the press speed is changed if it is close to the key (block 334) and recalculates the motor speed to arrive at the next key on time if it is not (block 336). If the press speed has changed, it adjusts the motor speed to match the press speed (block 338) and if it has not, it starts the next acquire of an image (block 340) and analysis. The routine then determines if the previous key was the last key on the web (block 342) and if not, returns to block 328 to execute the loop until the last key has been acquired and then resets the pixel data memory 70 and the strobe control 64 (block 344).

The routine then stores the data acquired (block 346) and starts an analysis loop 348 which includes getting a intensity percentage which is mapped into the light scattering data (FIG. 7) and determines the compensation for each particular key (block 350). This loop is continued until all data has been analyzed (block 352) and the routine inquires whether data was found for all of the keys (block 354) and if has, it averages the past data into prior saved data and counts that particular light scattering pass (block 356). If it is not the final, i.e., the 6th light scattering pass, the routine reverses the path direction (block 358) and restarts the subroutine at block 300 until the sixth light scattering pass is completed which then ends the subroutine.

It is important to initially locate the edges of the actual web during operation to confirm the width of the web. This is done at the beginning of a press run, and does not need to be done again for that run. Knowing the width is important in order to determine the number of keys that are used in the control of the reflective density by the printing units across the web, with it being understood that there is a color block set 112 to be found for each key. It is also important to monitor at least one edge of the web after the width has been calculated so that the apparatus can determine whether the web has moved laterally relative to the roller 38 during operation of the press.

It is particularly important when the press running in either the maintain mode or the run mode wherein reflective density passes are made only approximately every 500 impressions and the apparatus is idle between the taking of such reflective density passes. However, the apparatus will track the edge of the web during its waiting state so that it can accurately calculate the location of the color block sets, and enable the color block sets to be located when it takes a reflective density pass.

The presence of printed matter at the edge of the web can complicate the finding of the location of the edge of the web. Given the fact that printed matter may be printed up to the very edges of the web, it is often difficult to distinguish printed matter on the web from the roller 38 surface. While the roller is typically made of steel which is highly reflective, in actuality, ink is often present on the roller surface adjacent the web so that it is difficult to distinguish the web from the roller. Basically, the edge of the web is determined by acquiring images of a known position in the web and then generally stepping toward the edge and analyzing the pixels to locate the edge, with the analysis relying on the fact that white paper, which is typically what the web is, has an intensity value which is known to be between 240 and approximately 128. If the roller has no ink on its surface, it generally produces intensity values of the maximum of 255. Therefore, if the intensity is over 240, it is known that the roller surface is being analyzed and if it is between 240 and 128, it is the web itself. If it is below 128, then it is determined to be the printed matter on the web or ink on the roller.

Figure 8:
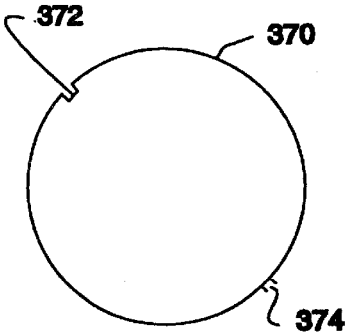
FIG. 8 is a simplified diagrammatic end view of a printing roller of a printing press.
Figure 9:
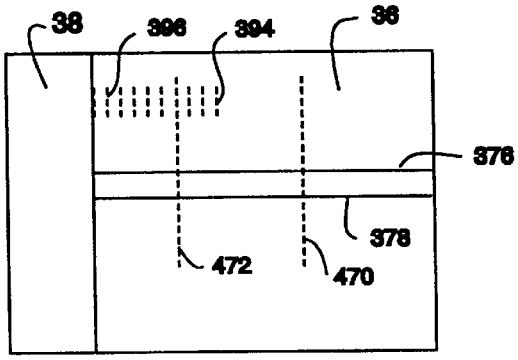
FIG. 9 is a simplified representational side view of a portion of a web on a roller.

The apparatus takes advantage of the fact that all printing presses have printing cylinders to which printing plates are attached. Referring to FIG. 8, which is an end view of a printing cylinder 370, the printing cylinder 370 has a gap 372 which is used to attach printing plates to the cylinder 370 and the printing plates extend from one side of the gap around the circumference of the cylinder 370 to the other side of the gap where it is attached. The importance of the gap is that it is present on every impression cylinder and provides a printing gap on the web because printed matter cannot be printed on the portion of the web that overlies the gap 372. The portion of the web that would be present in the area is represented by the area that results from the gap 372 is shown between the lines 376 and 378 as shown in FIG. 9.

The gaps 372 are becoming smaller in state of the art printing presses, and some presses now have a gap of only 0.040 inches, compared to a full 0.25 inches in many previous presses. The printing plates print two pages with the space between the impressions being identified at 124 where the color block sets are printed. In addition to reducing the dimension of the gap 372, the state of the art presses are also reducing the test print area 124 shown in FIGS. 3 and 4, and may be only 0.062 inches. This requires the height of the blocks to be less than 0.062 inches.

Figure 16A:
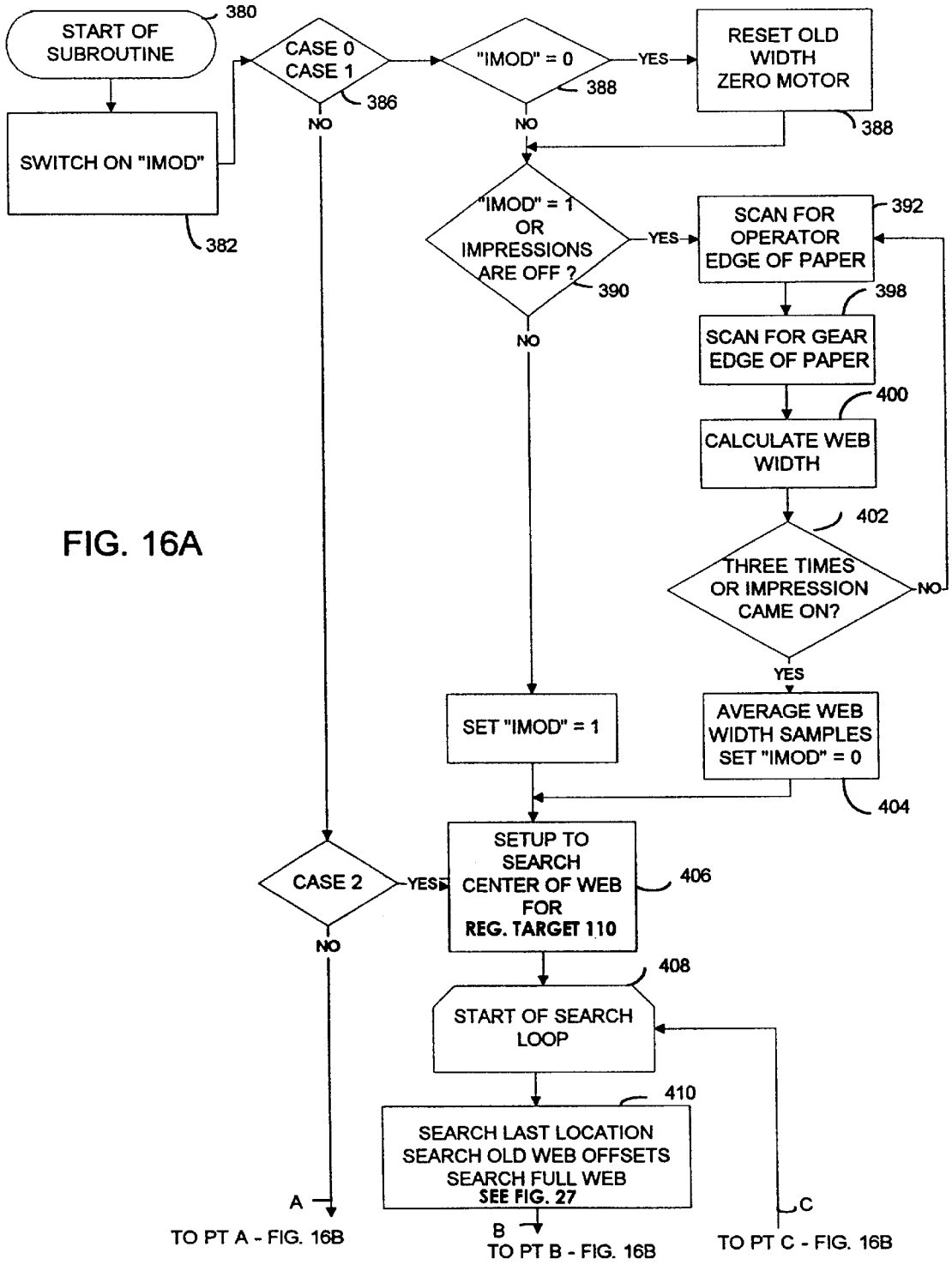
FIGS. 16A, 16B and 16C together comprise a flow chart of the routine which calculates the width of the web, locates the edge of the web and controls the execution of other edge finding routines in the event that the edge cannot be found by locating printed test areas.
Figure 16B:
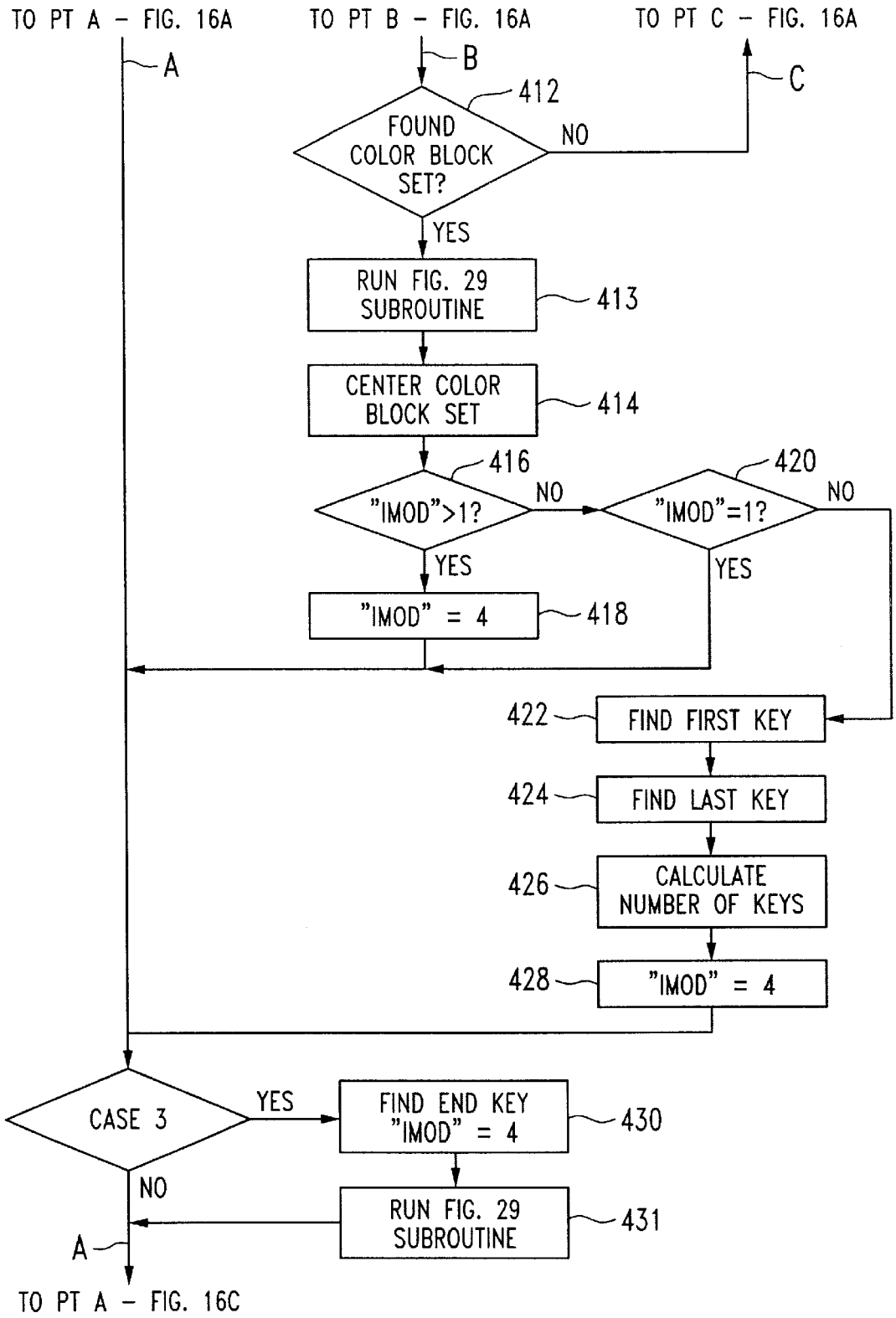
Figure 16C:
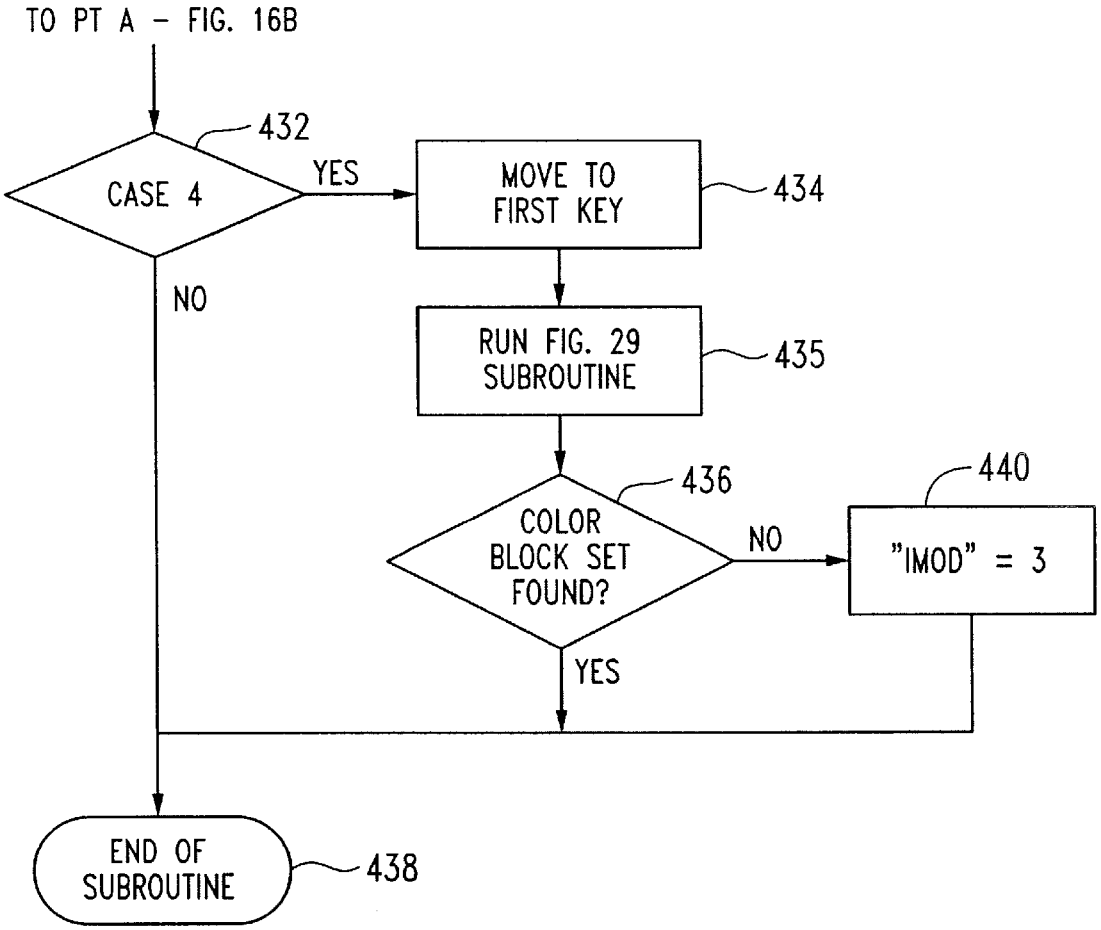
Figure 17A:
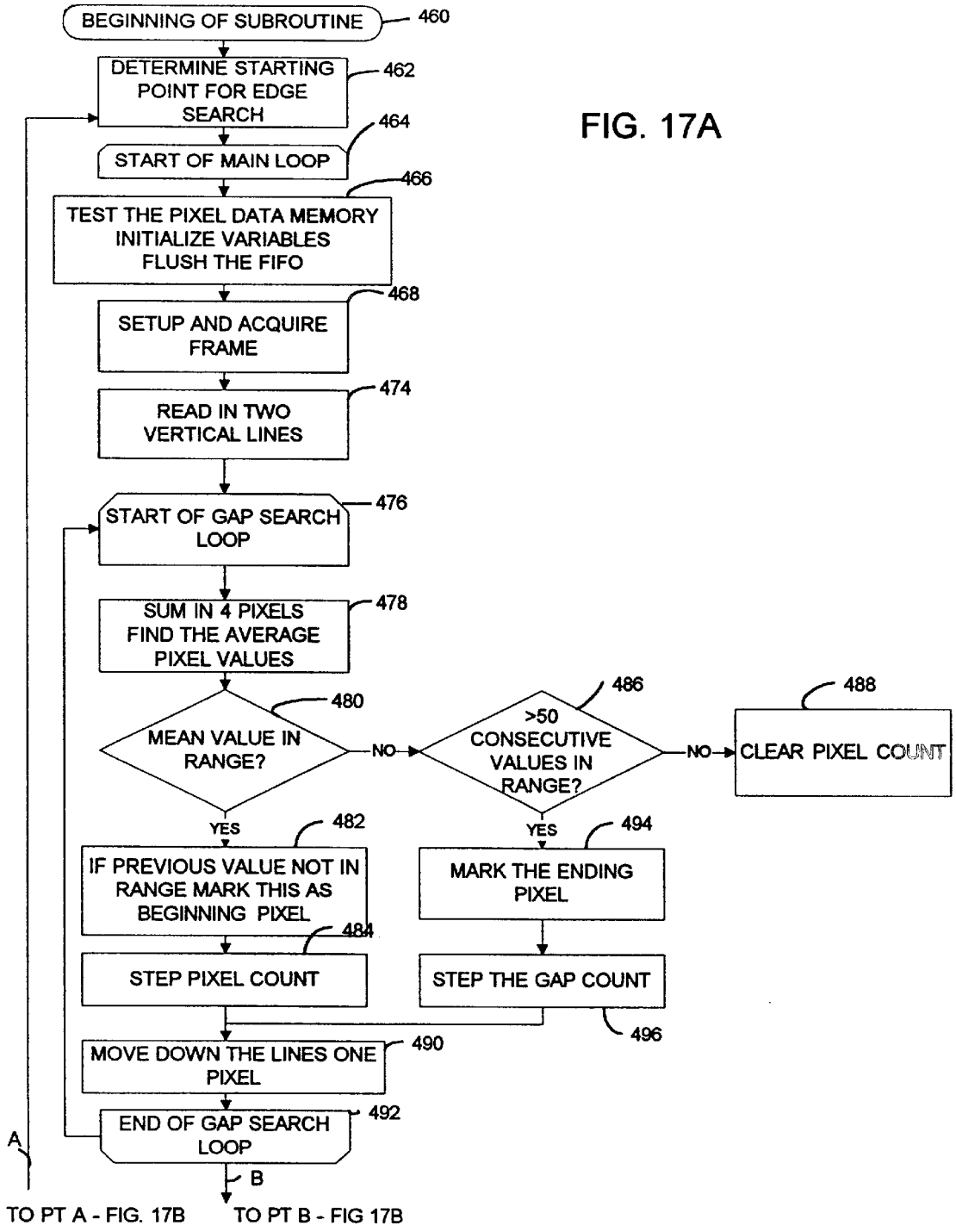
FIGS. 17A, 17B and 17C together comprise a flow chart for another software routine that is used to find the edge of the web if the web contains printed matter.
Figure 17B:
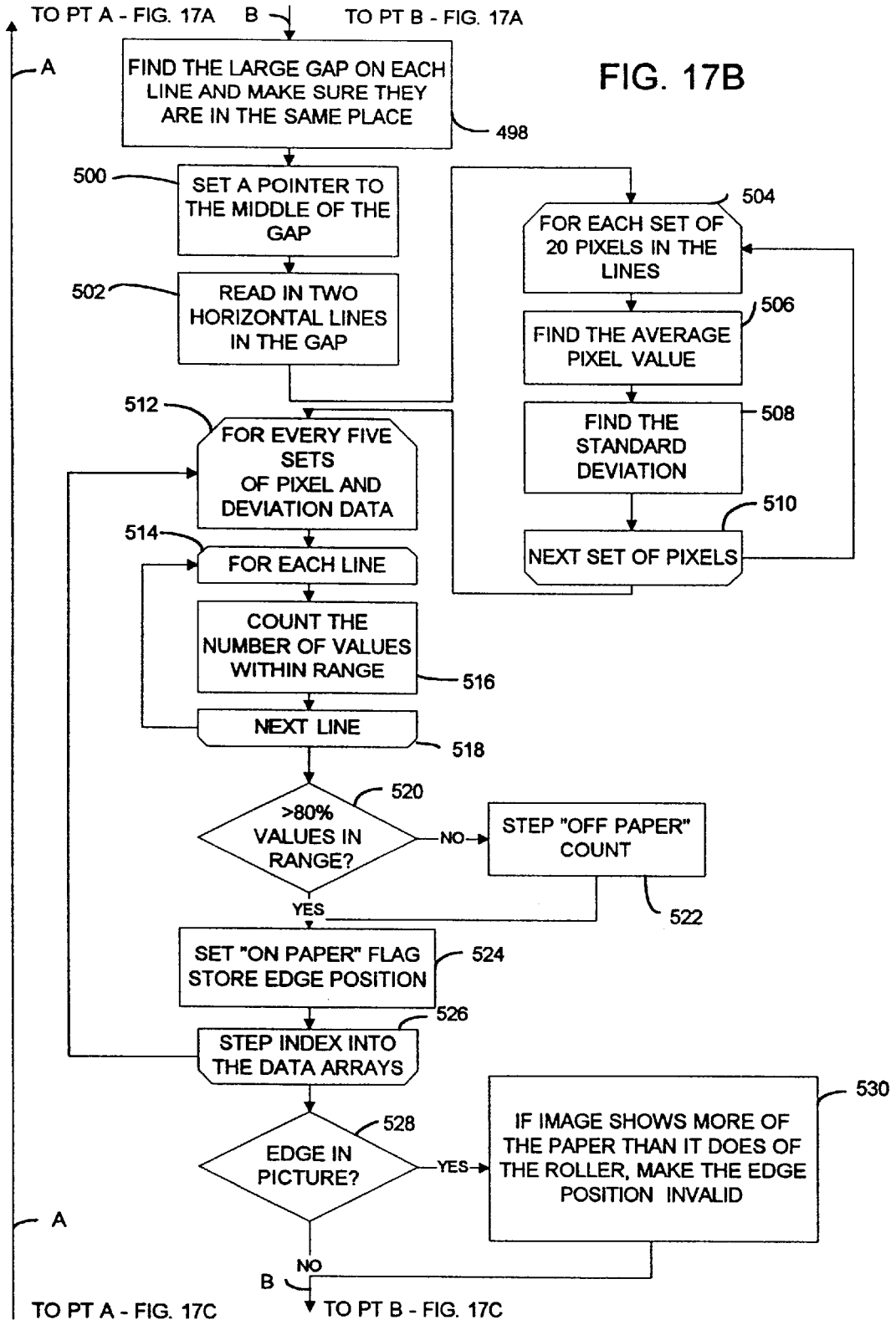
Figure 17C:
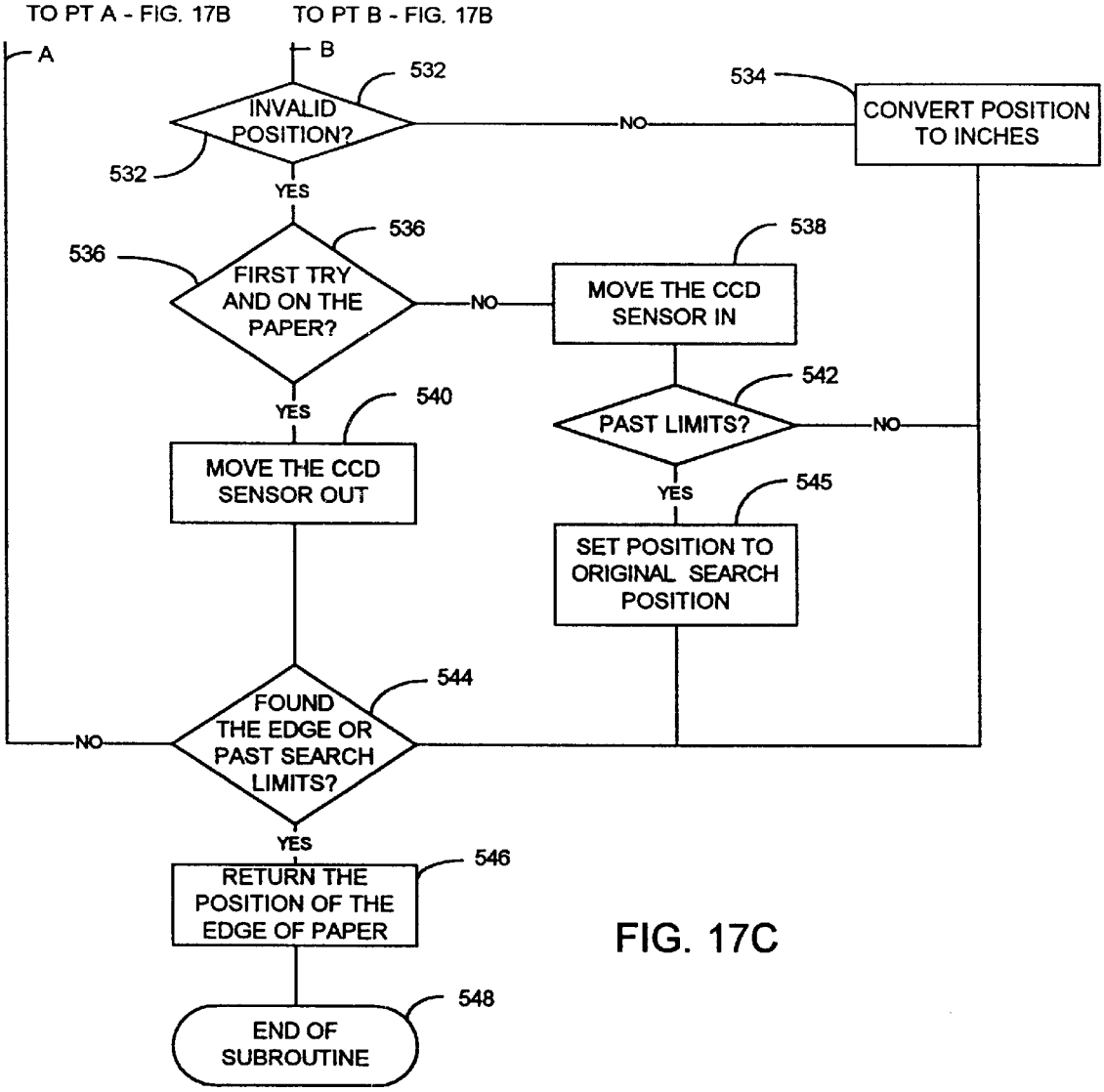

The apparatus locates the edge of the web using routines shown in FIGS. 16A, 16B and 16C as well as FIGS. 17A, 17B and 17C. Referring to the routine of FIG. 16A, it starts at block 380 and switches on a i-mod mode selection (block 382) and sets it to either case 1 or 2 (block 384) and if it is the first time through the routine, it initially sets a i-mod equal to 0 (block 386). When the routine is started, it is important that the apparatus know where it is and for that reason, the motor is moved to the left-most stop position so that it then can be moved to the correct position for starting the analysis.

The general scheme of this routine is to locate a color block which then enables it to verify the size of the paper and determine the color block set locations. This is for the purpose of making sure that the apparatus is acquiring images of the color block sets. Once it finds the end color block sets, it uses their existence to check how wide the paper is. If a press run is continuing in a maintain mode, the apparatus is continually scanning by looking for one of the color block sets on the edge of the paper to see if the web is moving either horizontally or circumferentially, i.e., it is tracking the web.

The routine runs in three modes, i.e., the start up mode where the first time it is run, it is attempting to locate the color block set and determine the width of the paper. Once it has done that successfully, it checks to make sure that the keys on the edge of the web are usable. The reason for this is that sometimes indicia is printed over the top of the color block sets or the end color block set may be half on or half off the web and is not capable of being used. Thus, the routine checks the outermost keys to see if the keys are valid and if the outermost key is not, it moves to the next key and uses that key color block set to track the web. Thus, in the start up mode, the apparatus locates the color block set, determines the width of the paper, and finds valid keys and once that has been accomplished, it merely analyzes the edge key during operation and if it loses the edge key, then it jumps back into a search loop looking for it. If that fails for some reason, the apparatus starts the whole process over by looking for the original color block set.

Returning to the routine shown in FIG. 16A, once i-mod is set to zero (block 386) the apparatus resets the old width and zeros the motor (block 388) and moves to i-mod equal 1 (block 390). This block inquires whether the impressions are off, meaning that there is no printed matter on the web and the web is therefore white. If this is the case, the routine scans the operator edge of the web (block 392) by examining pixels that are acquired in an image at locations such as beginning at location 394 (FIG. 8) using a routine that will be hereinafter described, and determines if the area of interest is at the edge of the web. If it is not, then it requires additional images and analyzes the pixels within those images such as at 396 of FIG. 9 until it reaches the edge 116. After having located the edge of the web 116, it identifies the location and then moves to the opposite edge of the paper (block 398) of FIG. 16A and determines the location of that edge. It then calculates the width of the web (block 400) and does so three times if possible (block 402) and calculates the average web width (block 404).

If impressions appear before the third time, the apparatus must switch to the routine that will be described in connection with FIGS. 17A, 17B and 17C. The above described portion of the routine is carried out whenever the press starts and it also runs constantly during the maintain mode of the apparatus where a sample is taken approximately every 500 impressions and this routine tracks the edge of the web. Returning to FIG. 16A, if the press is printing so that impressions are on the web, the apparatus initially searches for a color block set in the center of the web (block 406) and starts the search loop (block 408) which is a subroutine that will be described in connection with the flow chart shown in FIG. 20.

The first time that the routine is run it starts with i-mod equals 0 but then moves to i-mod equals 1. The routine attempts to initially locate a color block set which cannot be done if the impressions are off, i.e., no printing is occurring. However, if the impressions are on, it attempts to locate the color block set by moving the CCD matrix sensor to the last known location of a color block set and acquires an image. If the color block set is acquired, then it can continue the analysis (block 410) which is actually carried out in FIG. 27. If the last known location does not produce a color block set, then it searches nine other previously known locations sequentially in an attempt to locate the color block set and if none of those locations reveals a color block set, then it performs a search of the full web to find a color block set (block 412).

Figure 29:
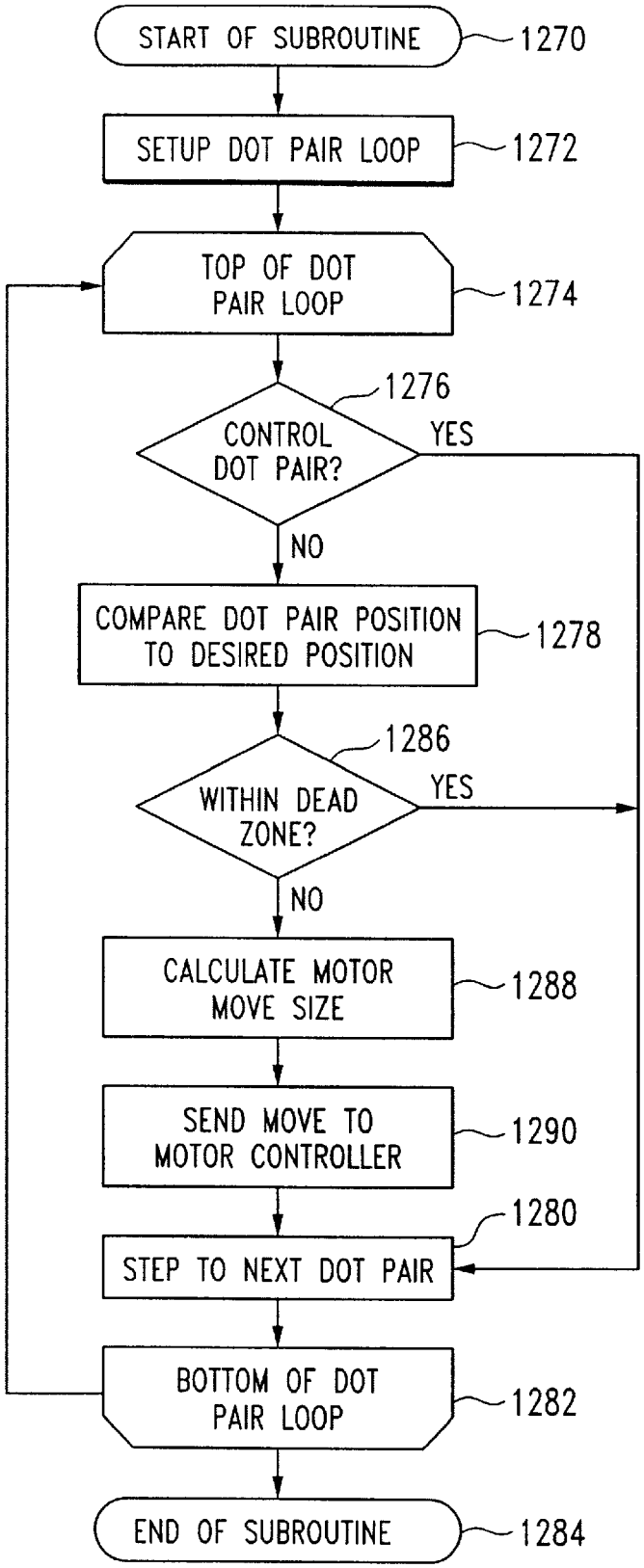
FIG. 29 is a flow chart for another software routine for determining if a register adjusting motor needs to be activated to make register corrections.

Once a color block set is located, then the subroutine described in FIG. 29 is run for determining if register adjusting motor needs to be activated to make register corrections and making any such moves (block 413). The subroutine then causes the apparatus to move the CCD matrix sensor to center the color block set (block 414) then inquires whether the i-mod is greater than 1 (block 416). If it is greater than 1, it sets i-mod equal to 4 (block 418) and if not, it inquires whether it is equal to 1 (block 420). If i-mod is not 1, the routine attempts to find the first key (mode 422), then the last key (block 424) and it calculates the number of keys (block 426) and sets i-mod equal to 4 (block 28) which is the running mode of the apparatus. At i-mod equals 4, the end key is monitored as described above. Thus, the routine finds the end key (block 430), runs the FIG. 29 subroutine again (block 431) and then moves to case 4 (block 432) where it moves to the first key (block 434), runs the FIG. 29 subroutine again (block 435) and inquires whether the color block set has been found (block 436) which if yes, ends the routine (block 438). However if it does not find the color block set, the routine is switched to i-mod equals 3 (block 440) where it attempts to find the color block set.

In accordance with yet another important aspect and referring to the routine illustrated in the flow charts of FIGS. 17A, 17B and 17C, this flow chart illustrates a routine for finding the edge of the web in the event that the impressions are on, i.e., there is printed matter on the web and none of the color block sets can be located. Basically the subroutine shown in FIGS. 17A through 17C operates to locate the edge of the web by locating the gap between lines 376 and 378 (FIG. 9) on the web and then finding the edge of the web using the gap area because it is known that no printed matter will be on the web at this location.

Referring to FIG. 17A, the routine begins at block 460 and it first determines the starting point for the edge search which is near the center of the web (block 462). The main loop is then started (block 464) and the pixel data memory 70 is tested and the FIFO buffers are cleared (block 466). The routine then acquires a image 468 and it analyzes the acquired image by reading two vertical lines of the acquired image, such as is shown at 470 and 472 of FIG. 9. The exercise is to acquire images and analyze vertically until there is concurrence in the analysis from traveling along the lines 470 and 472 until the gap between lines 376 and 378 is reached and confirmation that the images are indeed in the gap. At this point then the routine can move toward the edge as was described with respect to the points 394 and 396 described previously with respect to FIG. 9.

Returning to FIG. 17A, two vertical lines are read (block 474) and the search for the gap is started (block 476). The routine uses groups of four pixels to find an average pixel value throughout the analysis (block 478). The reason for using four pixels is that some paper webs have a texture which is very rough and can provide distorted readings because of the unevenness of the surface. When four pixels are averaged, there is good assurance that the value will be consistent regardless of the roughness of the paper.

The summed values are then analyzed to determine if the mean value is within a predetermined range (block 480) and if so, it is then marked as the beginning pixel in the gap (block 482) and the pixel count is then stepped (block 484). If the mean value is not within range, it determines whether there are more than 50 consecutive values previously in the range (block 486) and if not, it clears the pixel count (block 488) and causes the analysis to move down the vertical lines 470 and 472 of FIG. 9 by one pixel (block 490). If there were greater than 50 consecutive values in the range, then the pixel is marked as the end pixel (block 494) and the gap count is then stepped (block 496). After the analysis moves down the lines one pixel, it has reached the end of the gap search loop (block 492) and if it has not located the gap, the gap search loop is again started (block 476).

The routine makes sure that the gap is found on each of the lines 470 and 472 and also confirms that the gap 112 is in the same place for each of the lines (block 498). The routine then sets a pointer in the middle of the gap (block 500) and then analyzes two horizontal lines in the gap (block 502) and for each set of 20 pixels in the lines (block 504) finds the average pixel value (506) as well as the standard deviation (block 508) and then proceeds to the next set of pixels (block 510).

For every five sets of pixel and deviation data (block 512), it analyzes each line (block 514) and counts the number of values within the predetermined range (block 516) and then proceeds to the next line (block 518). The routine then determines if more than 80% of the values are within the range (block 520) and if not, determines that the analysis has stepped off of the web (block 522). If it is greater than 80%, then it sets an "on web" flag and stores the edge position (block 524).

The routine then indexes to other data arrays (block 526) and returns to block 512. The routine then determines whether the edge is within the acquired image (block 528) and if it is, analyzes whether there is more of the web shown than that of the roller, it invalidates the edge position. If the edge is not in the image, it inquires as to whether it is an invalid position (block 532). If it is an invalid position, it converts the position to inches (block 534). If it is not an invalid position, it inquires whether it was the first attempt and if the position is on the web (block 536). If it is not on the web, then the routine moves the CCD matrix sensor in (block 538) but if it is, it moves the CCD matrix sensor out (block 540). If the CCD matrix sensor is moved in, the routine inquires whether it is past the limits (542) and if not, it determines if the edge of the web has been found (block 544). If the CCD matrix sensor is past limits (block 542), it is set to the original search position (block 546). If the edge is found, it then returns the position of the edge of the web (block 546) and the routine is ended (block 548).

The aforementioned software routines are necessary in setting up the apparatus to acquire the actual reflective density data during operation and accurately determine a reflective density value. The routines effectively locate the color blocks of the color block sets for each key and calibrate the digitizing portion of the apparatus, as well as compensate for intensity of the strobe units, discontinuity of the light over the area of the image and compensate for light scattering.

Figure 18A:
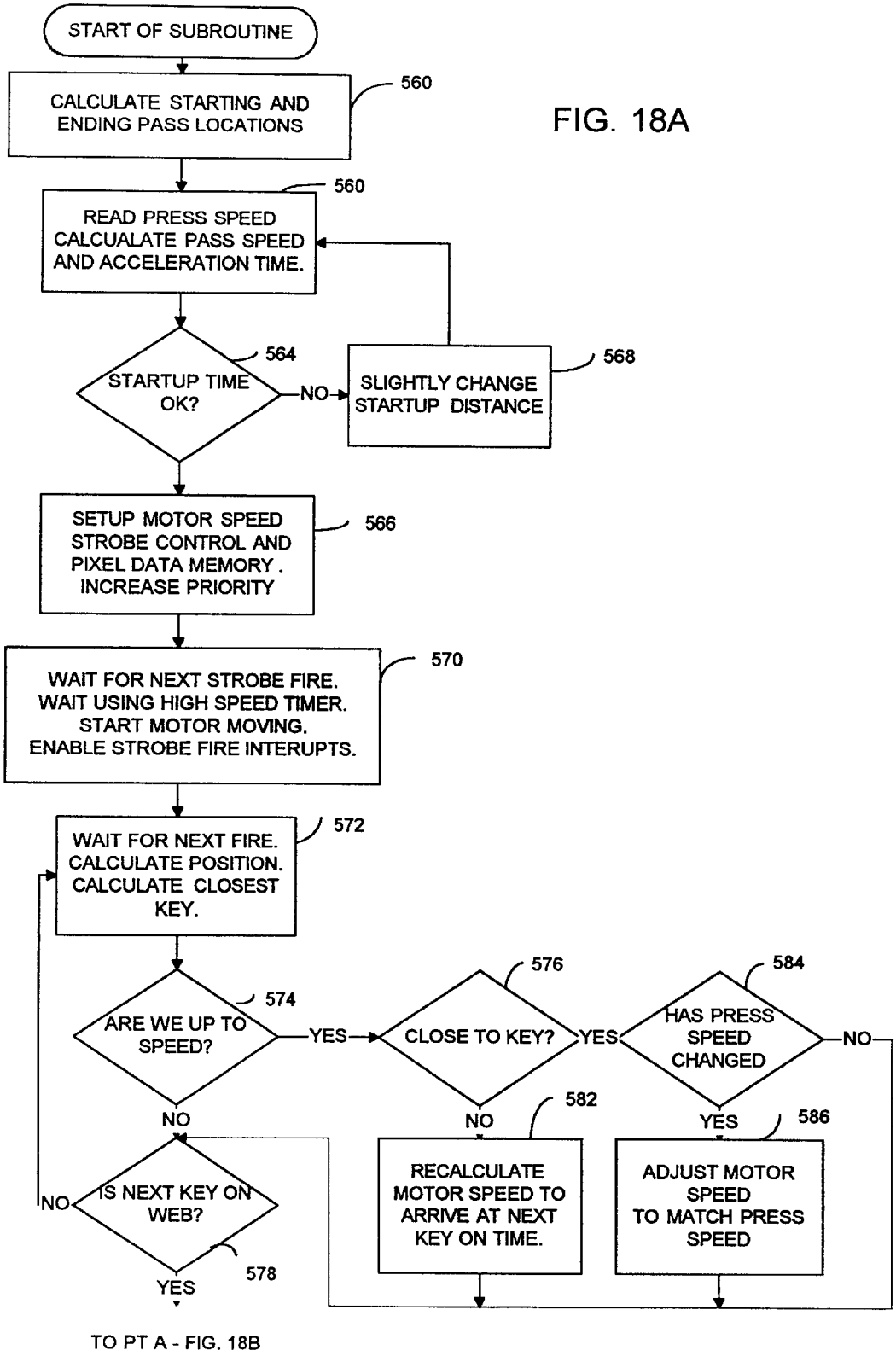
Figure 18C:
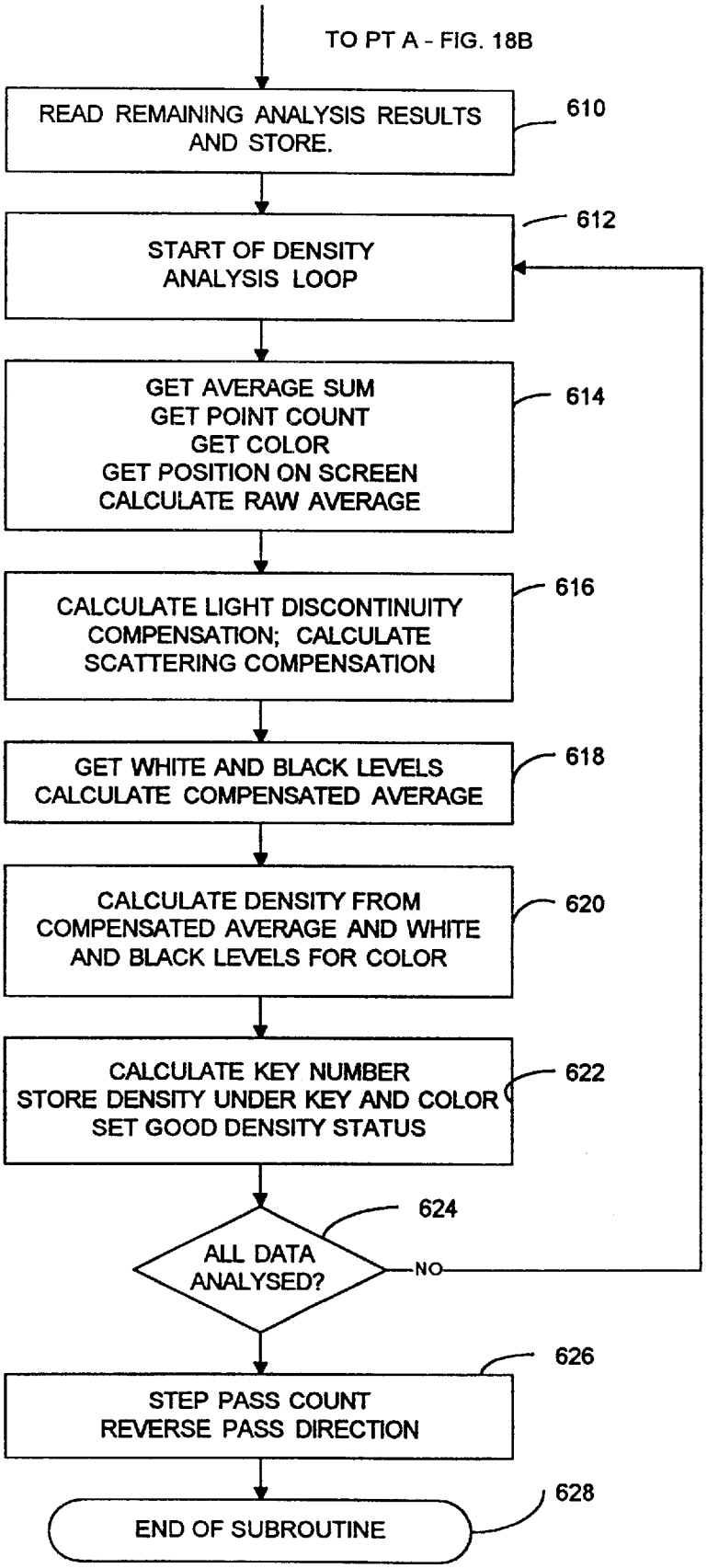

The routine that is used to acquire reflective density data is illustrated in FIGS. 18A, 18B and 18C which after being started, calculates the starting and ending locations for each pass (block 560), reads the press speed and calculates the pass speed and acceleration time that is required (block 562). If the start up time is okay (block 564), it sets up the motor 52 speed, the strobe control 64, and the pixel data memory 70 and increases the priority of the acquisition of reflective density data so that the operation will not be interrupted (block 566). If the start up time was not okay, then the start-up distance is changed (block 568) in the same manner that has been previously described in connection with FIG. 15A when light scattering data is acquired. Assuming that the start up time was okay and the motor speed, strobe control and pixel data memory have been set up, the apparatus waits for the next strobe firing, waits to use the high speed timer, and starts the motor 52 moving and enables the fire interrupts (block 570).

The routine then calculates the position and the next closest key (block 572), inquires whether the carriage is moving at the desired speed (block 574) which if yes, then determines if the CCD matrix sensor is close to the key (block 576). If the motor is not up to speed, then the program inquires whether the next key is on the web (block 578) and if not, returns to block 572. If the next key is on the web, then the routine sets up the pixel data memory 70, the strobe control 64 and acquires two images and starts the analysis of the first block (block 580, FIG. 18B). From block 576, if the routine determines that the CCD matrix sensor is not close to the key, it recalculates the motor's speed to arrive at the next key at the right time (block 582). If the CCD matrix sensor is close to a key, the routine then inquires as to whether the press speed has changed (block 584) and if it has, it adjusts the motor speed to match the press speed (block 586) and if not, it makes the inquiry (block 578) as to whether the next key is on the web.

Once the image has been acquired for the initial key, the program starts the main key loop (block 588) and calculates the position it is in as well as the location of the next key (block 590), inquires whether it is close to the key (block 592) and if not, recalculates the motor speed to arrive at the next key on time (block 594), but if it is, it then inquires as to whether the press speed is changed (block 596). If it has, it adjusts the motor speed to match the press speed (block 598), but if it has not, it acquires another image and starts the next analysis (block 600). If the previous analysis results are done (block 602) it stores those results and uses the results to recenter the image (block 604). If there are not any results, it inquires whether the last key has been done (block 606) which if not, returns to the start of the main key loop (block 588). If the last key has been done, then it resets the pixel data memory 70 and the strobe control 64 (block 608) and reads the remaining analysis results and stores them in memory (block 610).

At this point, the routine starts the reflective density analysis loop and initially provides the average sum, the number of pixels, the color that is being analyzed, the position on the screen, and the calculated raw average of the reflective density (block 614). It then calculates the compensation for the light discontinuity that is required for the particular pixels of interest as well as the light scattering compensation (block 616) and obtains the white and black levels for the color being analyzed and calculates a compensated average (block 618). It then calculates the reflective density from the compensated average and white and black levels for the color being analyzed (block 620). It calculates the key number and stores the reflective density value under the key number and the color and sets a good reflective density status (block 622). It then inquires as to whether all data has been analyzed (block 624) and if not, returns to the start of the analysis loop (block 612). If it has, then it steps the number of the paths and reverses direction (block 626) and the subroutine is ended (block 628).

The data that is obtained from the reflective density analysis loop is the color that is being analyzed, the x and y coordinate positions on the image, the height and width of the area being analyzed, the sum of all the pixels in the area and the number of pixels that were summed.

Figure 19A:
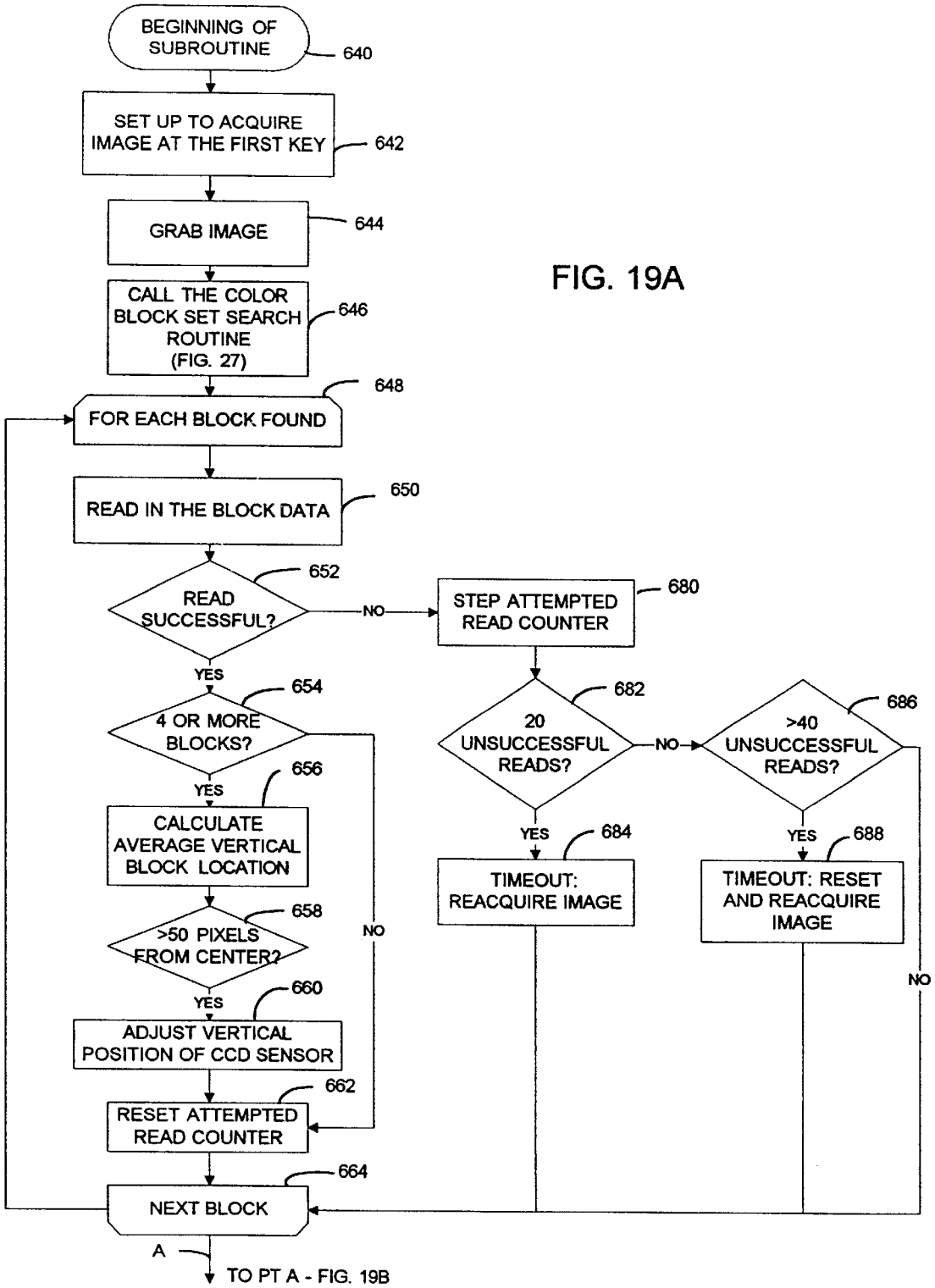
FIGS. 19A and 19B together comprise a flow chart of a software routine for locating a minimum number of color blocks within a digitized image.
Figure 19B:
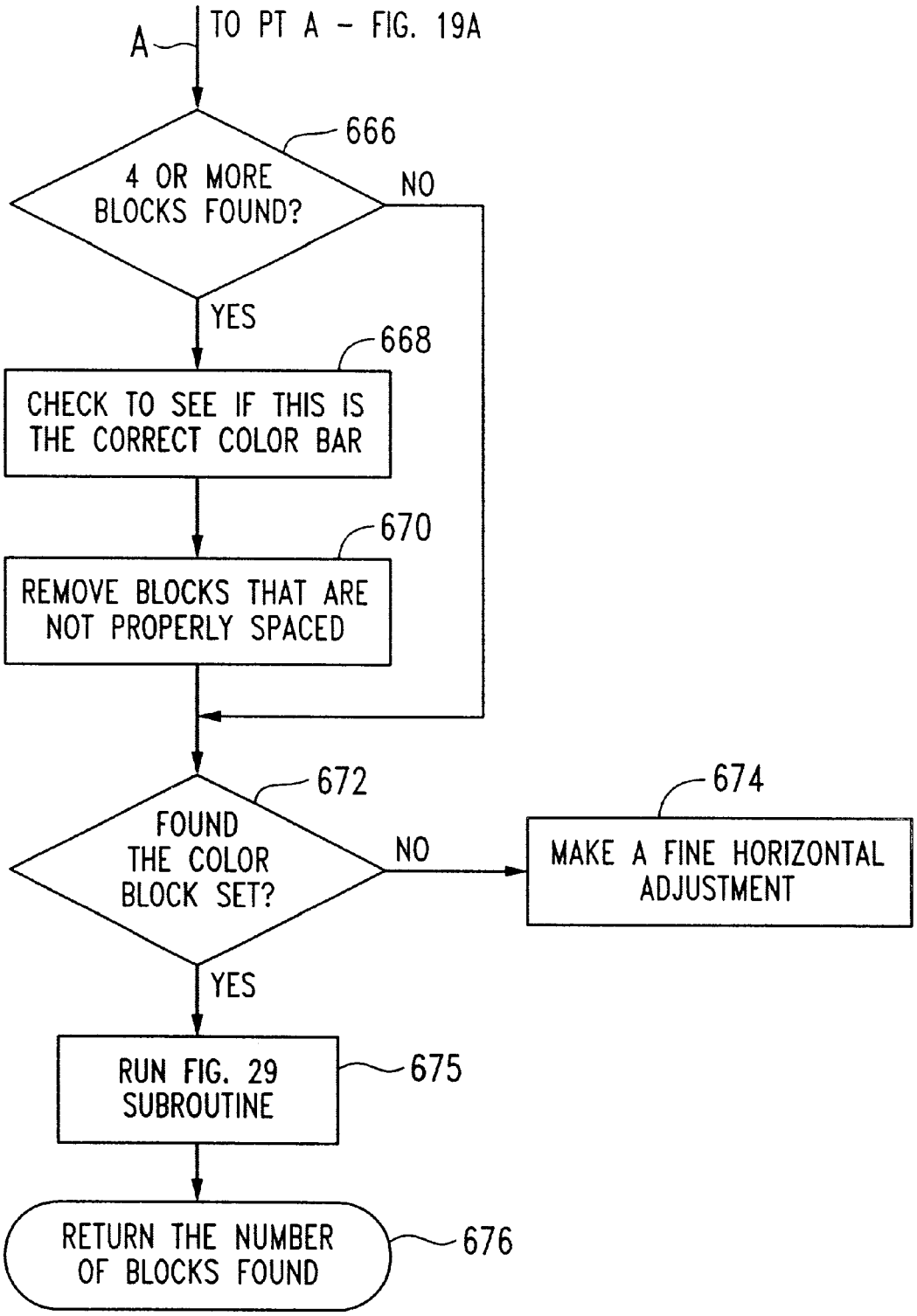

The subroutine that is used to locate the color blocks within the color block set such as shown in FIGS. 3 and 4 is set forth in the flow chart of FIGS. 19A and 19B. The subroutine begins at block 640 and the apparatus is set up to acquire an image at the first key location (block 642). The image is acquired (block 644) and the color block set search routine hereinafter described with respect to FIG. 27 is invoked to locate all color blocks 130-136 that are present in the image (block 646). For each color block that is found (block 648), the routine reads the data for a block (block 650).

As shown in FIG. 6, the color blocks are approximately 95 pixels by 95 pixels in size and the analysis area is a rectangle 651 that is preferably located within the center of the color blocks and is preferably of a 52 by 52 pixel size. The routine then determines if the read is successful (block 652) which if it was, inquires whether there were four or more blocks (block 564) and the average vertical block location is calculated (block 656). It then determines if the block is greater than 50 pixels from the center of the color block (block 658) and if yes, adjusts the vertical position of the CCD matrix sensor (block 660) and resets the read counters (block 662). The apparatus then proceeds to the next block (block 664) which either returns to block 648 or proceeds to block 666 in FIG. 19B and inquires whether four or more blocks have been found. If four or more blocks have been found, the routine checks to see if the correct color block is being analyzed (block 668). This is done by verifying the correct order of the blocks, determining that the spacing is reasonable, confirming that every fourth block is the same color and confirming that the black block has a tab. The routine removes blocks that are not properly spaced (block 670). The routine then inquires to determine if the correct color block has been found (block 672) and if not, makes a horizontal adjustment of the CCD matrix sensor (block 674). If yes, the routine returns the number of blocks that were found (block 676).

Returning to FIG. 19A, if the read was not successful in block 652, the read counter is stepped (block 680) and if there are 20 unsuccessful reads (block 682), the routine times out and reacquires another image (block 684). If there are not 20 unsuccessful reads, the routine inquires there were greater than 40 unsuccessful reads (block 686) and if there were, it also resets and reacquires the image (block 688).

Figure 20A:
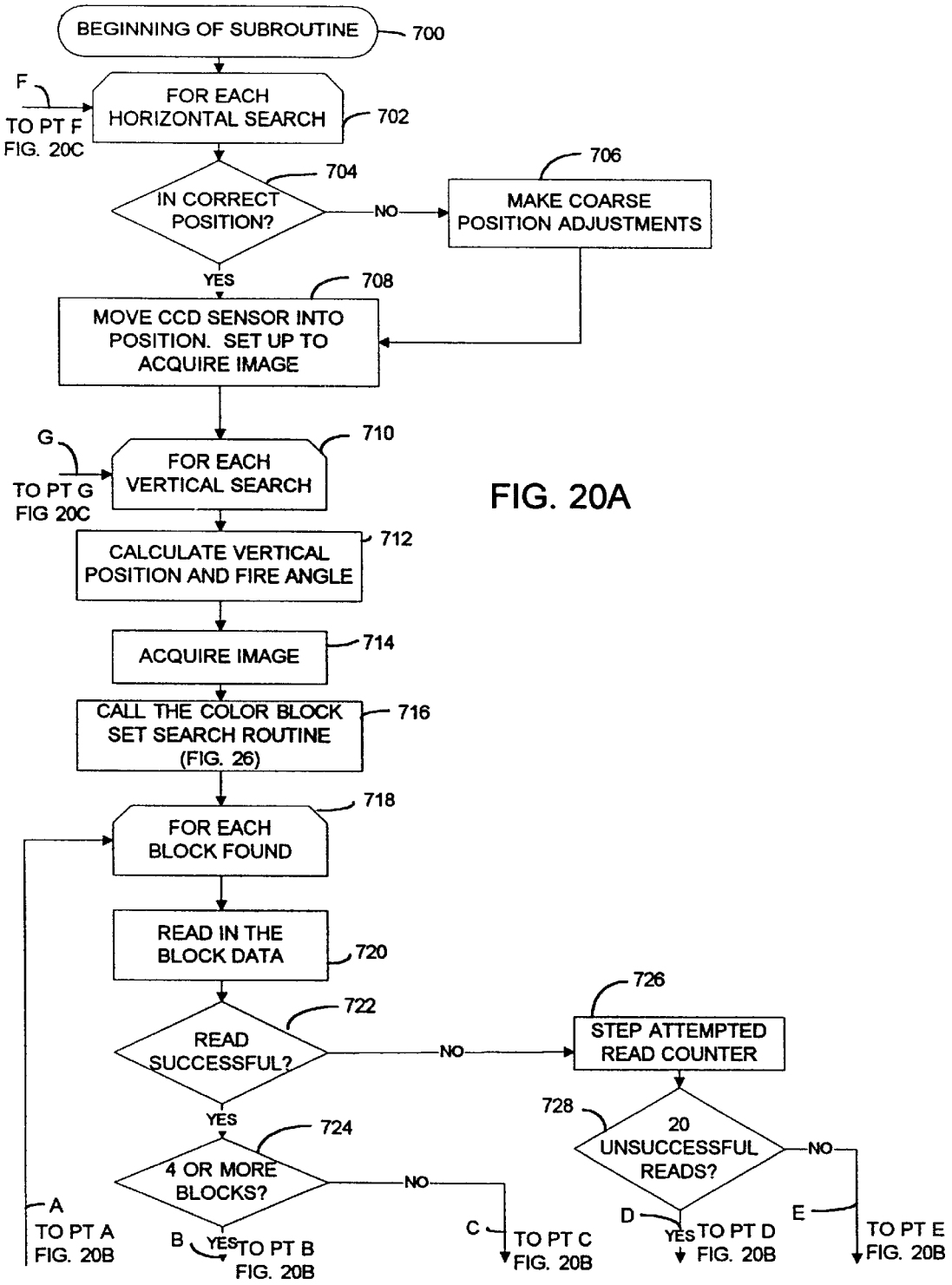
FIGS. 20A, 20B and 20C together comprise a flow chart for another software routine for searching for color blocks within a digitized image.
Figure 20B:
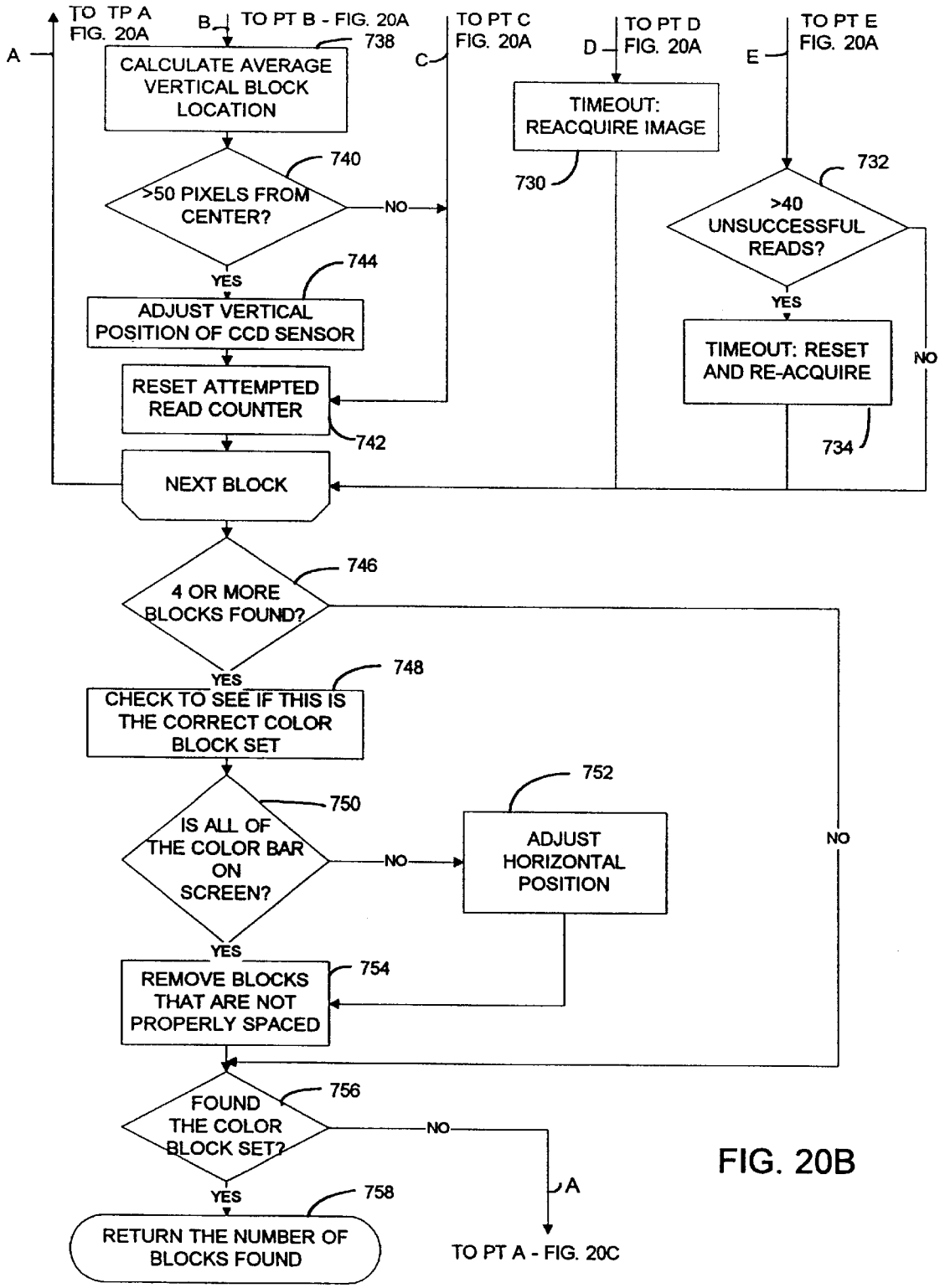
Figure 20C:
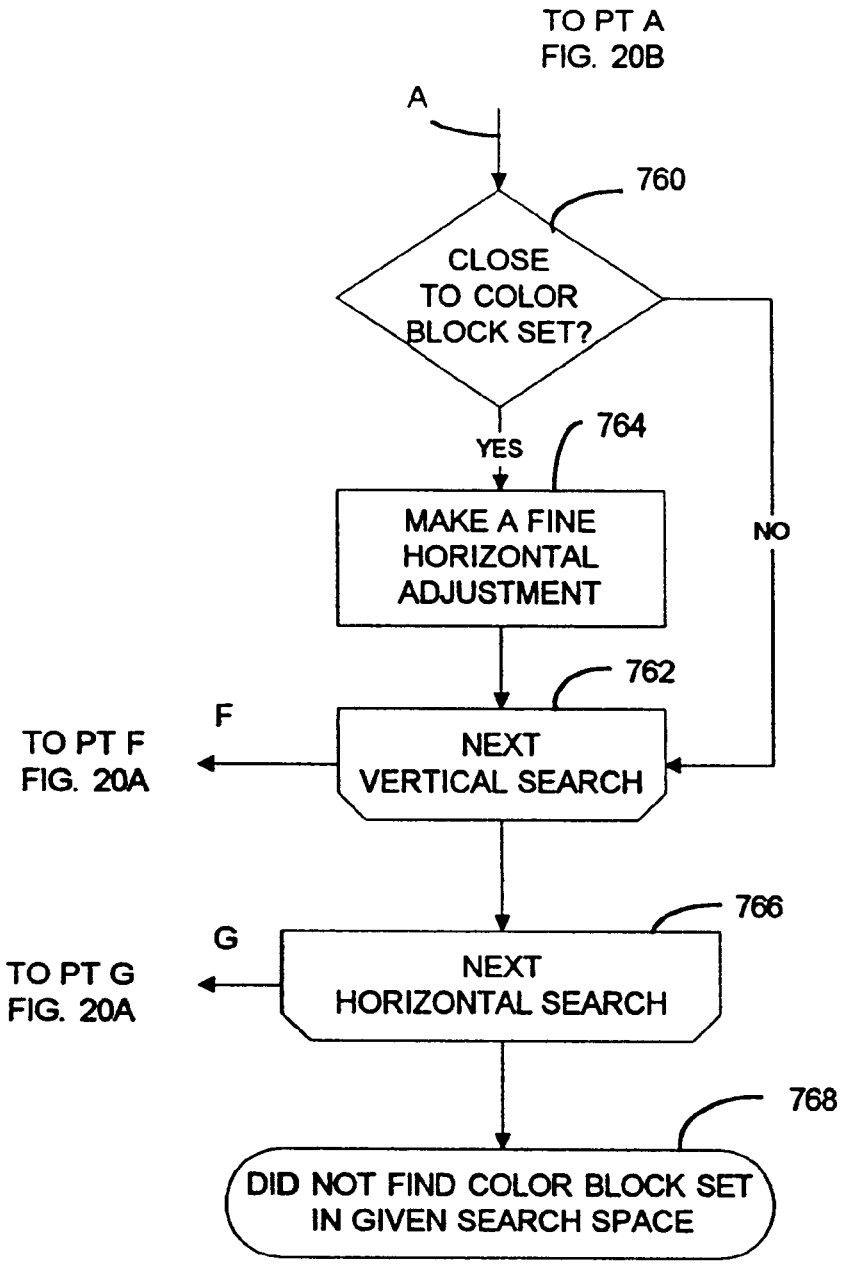

The subroutine that controls the searching to find a color block set, i.e., block 646 of FIG. 19A, is illustrated in FIGS. 20A–20C and starts at block 700. The routine of FIGS. 20A–20C therefore controls the movement of the carriage and CCD matrix sensor to locate the color block set if it has been lost. For each position where a search is done in the horizontal position (block 702), such as at locations 394 and 396, for example, in FIG. 9, the routine inquires whether the position is correct (block 704), and if not, position adjustments are made (block 706) and the CCD matrix sensor is then moved into position and is set up to acquire an image (block 708). For each vertical search, i.e., acquiring images vertically along the lines 470 and 472 of FIG. 9 (block 710), the vertical position and fire angle is calculated (block 712) and an image is acquired (block 714) after which the color block set search routine is executed (block 716).

For each block found (block 718), the data is read (block 720) and if the read was successful (block 722) the routine inquires whether there were four or more color blocks located (block 724). If the read was unsuccessful, the attempted read counter is implemented (block 726) and the routine inquires whether there have been 20 unsuccessful reads (block 728) which if there have been, the routine then times out and reacquires a image (block 730) (FIG. 20B). If there have not been 20 unsuccessful reads, then the routine inquires whether there have been more than 40 unsuccessful reads (block 732). If there are 40 unsuccessful reads, there is an assumption that the pixel data memory is malfunctioning and the routine totally resets the pixel data memory 70 and reacquires another image (block 734) and if not, proceeds to the next block 736. If there are four or more blocks located (block 724) the routine then calculates the average vertical block location (block 738) and inquires whether it is greater than 50 pixels from the center (block 740). If it is not, then the attempted read counter is reset (block 742). If it is greater than 50 pixels from the center, the program then adjusts the vertical position of the CCD matrix sensor (block 744) and resets the attempted read counter.

If four or more blocks are found (block 746), the routine checks to see if it is the correct color block (block 748) and inquires if all of the color block is on the screen (block 750) which if not, adjusts the horizontal position (block 752). The routine then removes blocks that are not properly spaced relative to one another (block 754). If the four or more blocks were not found, the routine inquires whether the color block has been found (block 756) which is also done after improperly spaced blocks have been removed. If the color block has been found, the routine returns the number of blocks that were found (block 758) and if the color block was not found, the routine inquires whether the image was close to the color block set (block 760) and if not, does the next vertical search (block 762) but if yes, makes a fine horizontal adjustment (block 764). For each vertical search, the routine returns to the routine block 710 (FIG. 20A) and if the next horizontal search is done (block 766), the routine returns to block 702 in FIG. 20A. If the color block set was not located within the given search space, the routine is then terminated.

Figure 21A:
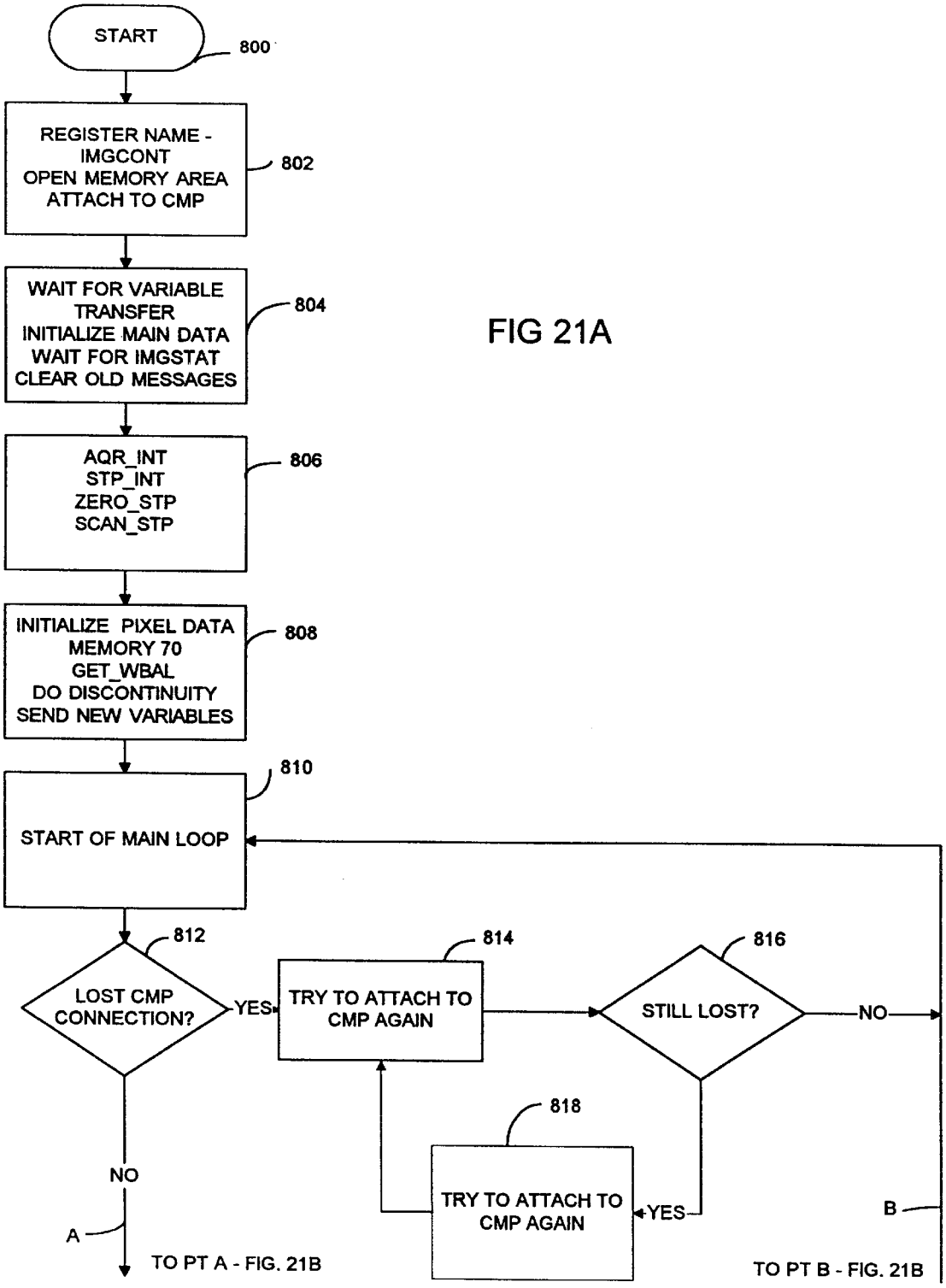
FIGS. 21A, 21B and 21C together comprise a flow chart for a software routine that is used to acquire an image, and is a more detailed illustration of the routine illustrated in FIG. 12.
Figure 21B:
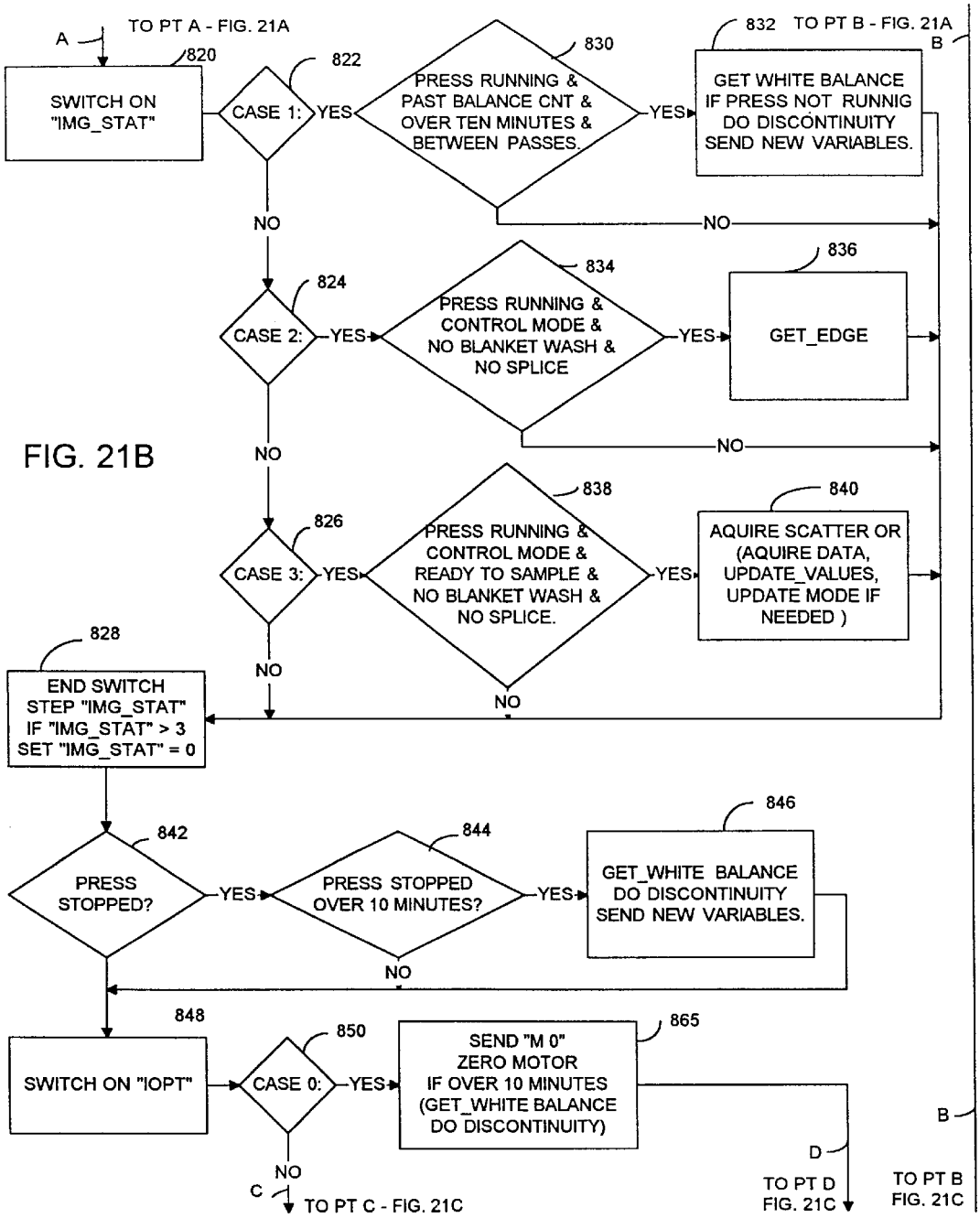
Figure 21C:
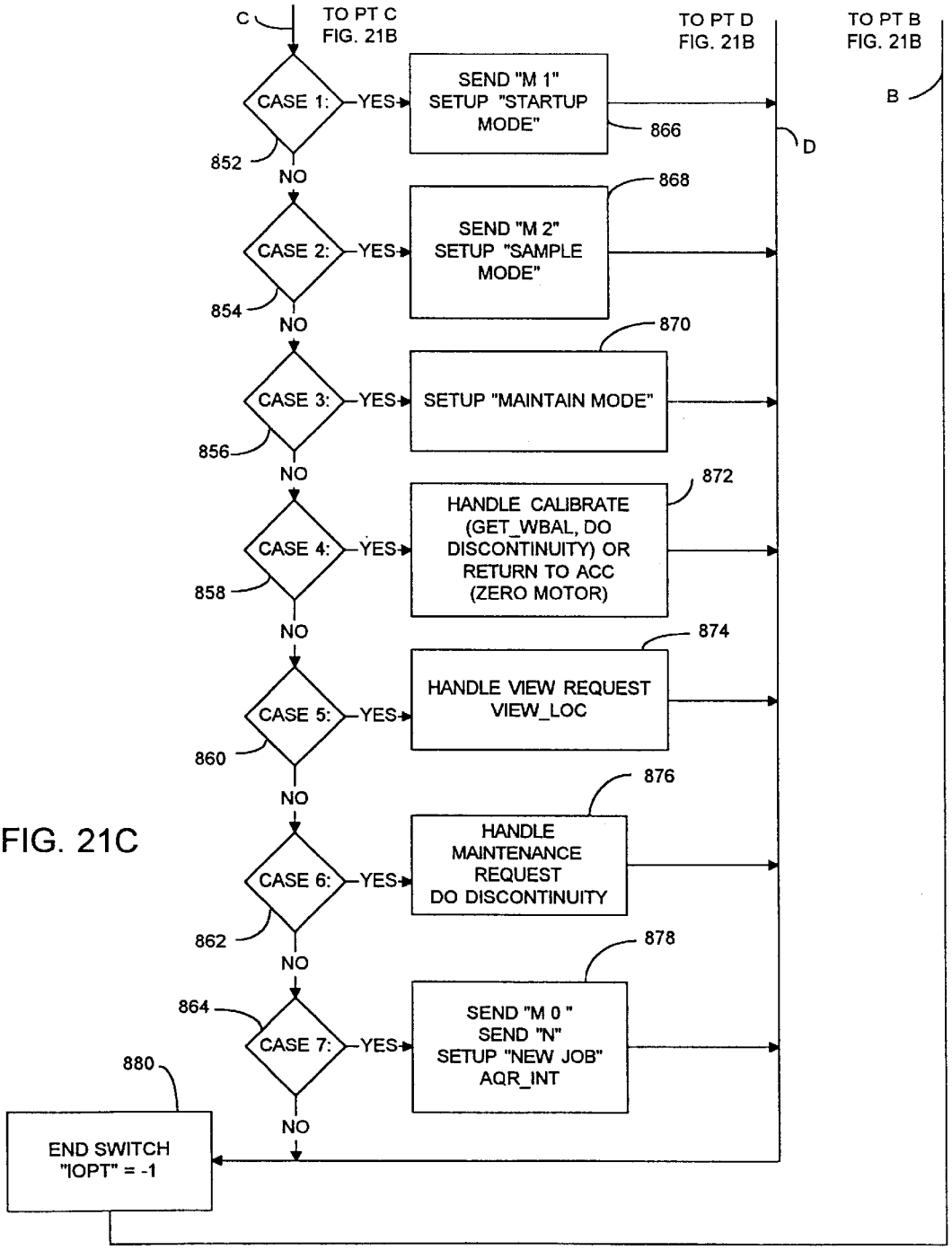

The manner in which the apparatus operates to acquire data as a function of timing and press conditions and operations was generally described in FIG. 12, and is set forth in greater detail in the flow chart illustrated in FIGS. 21A, 21B and 21C. The routine starts at block 800 (FIG. 21A) and sets up a name in the control system 96, opens a memory area for storing data and attaches to CMP 103 (block 802). The routine then waits for the variable transfer, initializes the main data (block 804), waits for the image status and clears old messages (block 804). The system then initializes the motor, moves it to the left-most position and a sensor module scan to make a full traverse of the carriage (block 806) then initializes the pixel data memory 70, obtains white and black calibration data and also performs the light discontinuity data acquisition analysis and sends these variables through the CMP 103 to the processor 96 (block 808). The main loop is then started (block 810) which has been described in FIGS. 18A through 18C. If the routine has lost its CMP connection (block 812), it then tries to attach to the CMP again (block 814) and if it is still lost (block 816), it again tries to attach (block 818). If it is still not lost, it returns to the main loop 810. The subloop continues to try to attach until it is successful. If it has not lost its CMP connection, the routine then proceeds to an imaging status switchable loop 820.

Press conditions determine whether case 1, case 2 or case 3 conditions exist (blocks 822, 824 and 826) and the apparatus continuously loops through this subroutine in a manner whereby each time the routine goes through the main loop, either case 1, case 2 or case 3 will be run. The image status will then be stepped. If the image status is greater than 3, then it is set to 1 (block 828). Before the end switch block is reached, if case 1 is valid, or is set, the press is running, it is past the balance count (i.e., the count for triggering recalibration), it has been over ten minutes since a calibration has occurred and the apparatus is between passes (block 830). The apparatus performs a calibration and light discontinuity analysis (block 832) before ending the switch 828.

For case 2, if the press is running and is in the control mode, there is no blanket washing being done on the press and no splice being performed (block 834), the apparatus runs the get edge routines to locate the edge (block 836) before ending the switch (block 828). With respect to case 3, if the press is running in the control mode and it is ready to sample and there is no splicing and blanket washing being performed (block 838) the apparatus then acquires light scattering data or reflective density data and updates the values (block 840). After the end switch block is reached, the routine inquires whether the press is stopped (block 842) and if yes, determines whether it has been stopped over ten minutes. If it has been, it runs the calibration and light discontinuity routines (block 846). The routine then operates to switch on an IOPT loop (block 848) which is a switchable loop that sequences through cases 0 through 7 (blocks 850 through 864). Once it has sequenced through these cases, the routine returns to the start of the main loop (block 810).

Each of the cases 0 through 7 is initiated by the operator during operation of the apparatus. If case 0 is set, the apparatus is set to idle state. If it has been more than 10 minutes, the CCD matrix sensor is recalibrated and the light discontinuity analysis performed (block 865). If case 1 is set, the apparatus sends the mode m1 status and sets up the start up mode (block 866). Case 2 sends a mode m2 command and sets up the run mode (block 868). Case 3 sets up the maintain mode (block 870). Case 4 is a user request to recalibrate the CCD matrix sensor (block 872) as well as perform a light discontinuity analysis or returns the motor to its home or zero position. Case 5 enables a view request to be handled and a particular portion of the web is located and an image acquired of that location which can be viewed by the operator. Case 6 permits a maintenance request to be handled and light discontinuity analysis to be performed (block 876). Case 7 sends a mode mo command and sets up a new job (block 878). If none of the cases are requested, the program ends the switch (block 880) and returns to the start of the main loop (block 810).

Figure 22A:
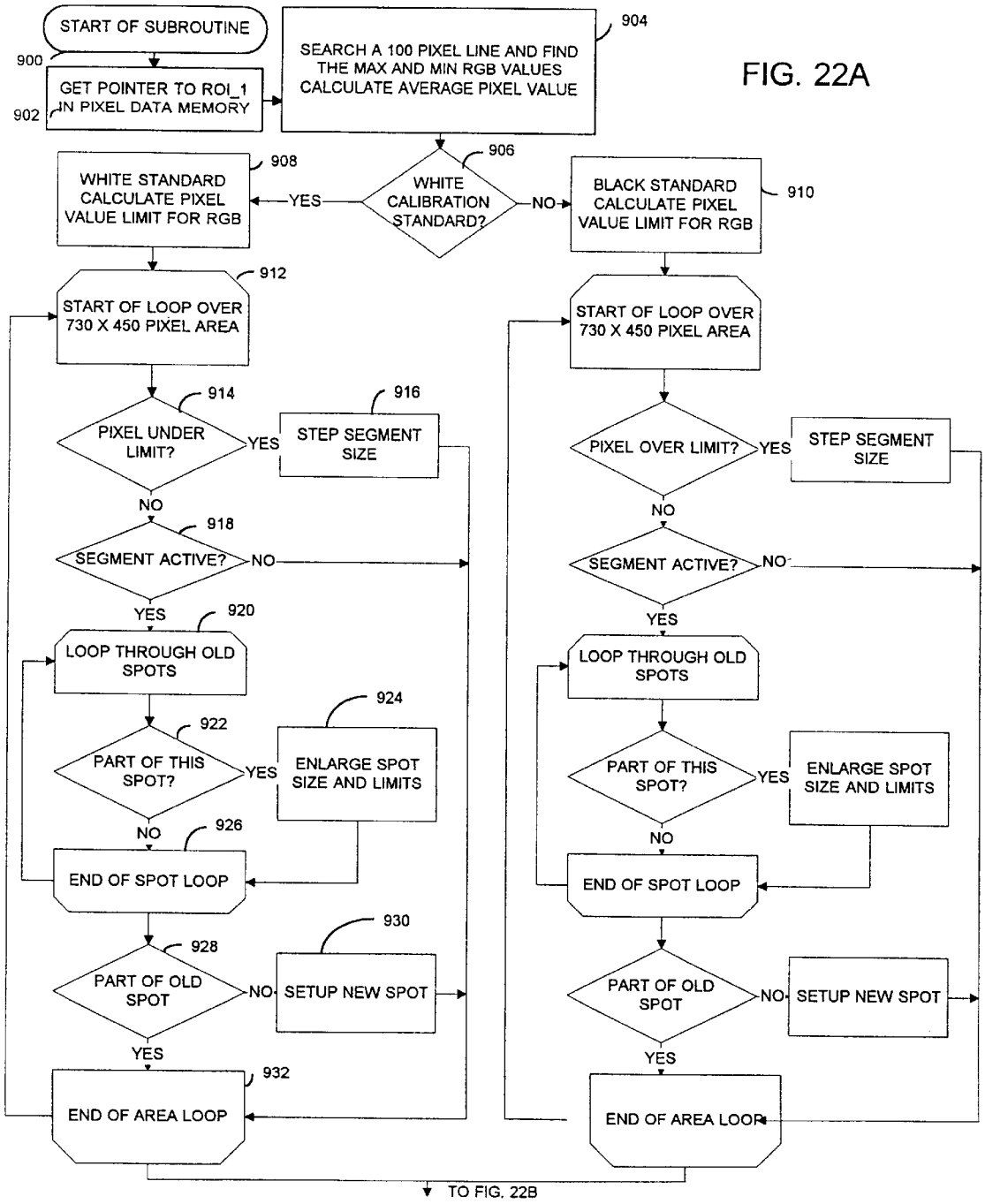
FIGS. 22A and 22B together comprise a flow chart of a software subroutine that is used to find average values during the calibration of the digitizing system.
Figure 22B:
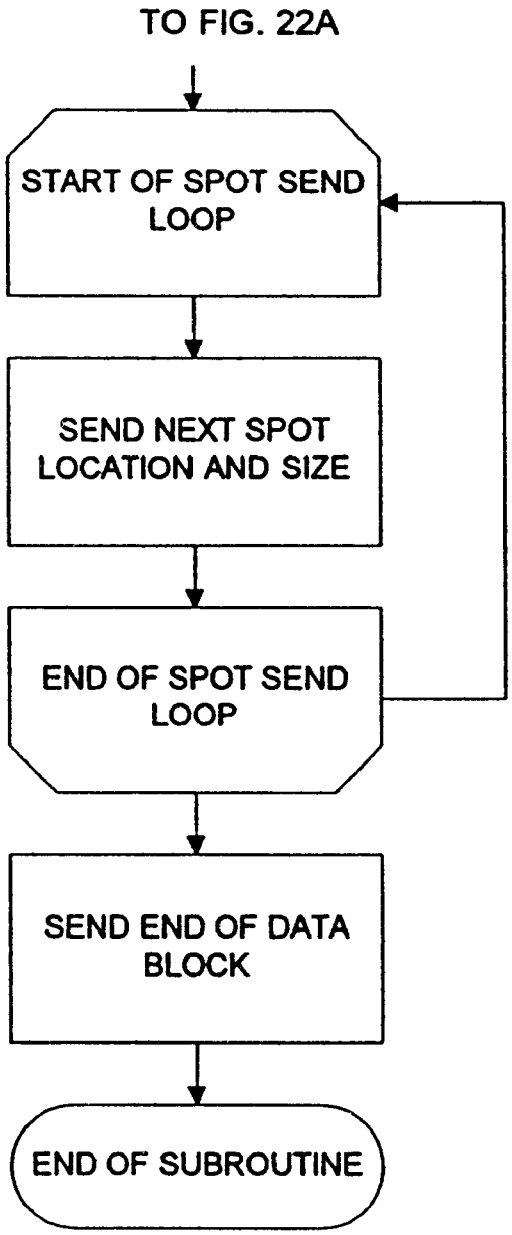

The software subroutine which calibrates the digitizing portion of the apparatus and performs spot analysis during the calibration is shown in the flow chart of FIGS. 22A and 22B and begins at block 900 which results in a pointer being established in the region of interest in the pixel data memory (block 902). The routine then searches a 100 pixel line and finds maximum and minimum red, green and blue values and calculates the average pixel value in the line (block 904). This is analyzed to determine whether the value is high enough that a white calibration standard is to be performed (block 906) and if so, the pixel value limit for the white standard in each channel is set up (block 908) and if not, the black standard pixel value limit for red, green and blue is established (block 910). The portion of the routine below the block 908 is virtually identical to that below the block 910 except for the distinction that pixels over a limit are not counted for the black standard, while pixels under the limit are not counted for the white standard. The steps that are carried out with respect to the white standard will only be described.

The routine starts to examine each pixel of a 730 by 450 pixel area (block 912) and determines whether each pixel is under the limit of approximately 120 (block 914). If it is under the limit, then the pixel is added to a segment indicating that a spot is present. If the pixel is a pixel of the white standard, then the routine inquires whether a segment is active (block 918). If it is active, the routine loops through known old spots 920, inquires whether the segment is part of a known spot (block 922) and if yes, enlarges the spot size before ending the spot loop (block 926). The routine inquires whether the segment is part of an old spot (block 928) and if not, it establishes a new spot (block 930). If it is part of an old spot, then that is the end of the area loop (block 932). The block 932 is connected to the block 912 and it should be understood that the entire pixel area must be analyzed. After the area loop is searched (block 932), a spot send loop is started (block 934) which forwards information relating to the spots to the processor 88. The routine sends the location size of the next spot 936 until the send spot loop is ended (block 938). The routine then sends the end of the data (block 940) and ends the subroutine (block 942).

The manner in which the apparatus performs the search for the color blocks and does the reflective density analysis is set forth in FIGS. 23A through 23E which starts at block 1000 and immediately sets a pointer to a region of interest in the pixel data memory and initializes the data to be analyzed (block 1002). Referring to FIG. 5C which illustrates a single bar, it is analyzed in the manner set forth in the flow chart of FIGS. 23A through 23E. The routine sets up a vertical search from the center out (block 1004) and may start at a point 1006 in FIG. 5C. The top of a vertical search loop is shown in block 1008 and the routine sets up a pointer to start a line horizontal search also from the center out such as at point 1006 in FIG. 5C (block 1010). The top of the horizontal search loop is indicated in block 1012 and the routine obtains red, green and blue averages for groups of four pixels at the start position (block 1014).

The routine then determines whether any of the three channel's average (red, green and blue) is below the white limit (block 1016) and if so, it determines the color of the average (block 1018). In this regard, the color block found will be one of the three color channels and the channel of the color that is the color of the actual color block being examined will be significantly lower in intensity level than the other two channels. If the block is black, then all three channels will be low and the apparatus uses a single channel for black color blocks.

In this regard, each channel receives only one of the colors of red, green and blue, and if the corresponding ink color which takes away from the signal level on the channel is present, then that channel will be low. The apparatus takes advantage of that fact by utilizing an exclusive-OR function in each channel, it can determine if that color is present. This is done by setting one input high (1) and if that color is present, a low (0) output from the exclusive-OR will be obtained. If the low output is not produced, then it is known that the particular color is no longer present or being measured.

After it has determined which color is being analyzed, the routine inquires whether this color has already been found (block 1020). If not, the routine sets up the various limits for block searches (block 1022) and sets up to search from the point 1005 in FIG. 6 to the left to determine the left edge 144 of the block (block 1024). The routine then steps left 5 pixels to get the RGB averages for the four pixels at that location (block 1026), determines whether they are within limits (block 1028), and if not, steps back within the block and the search of the left edge is completed (block 1030). If all pixels are within limit, the pixels are summed into the count (block 1032) and the routine inquires whether the analysis is at the edge of the image (block 1034) and if so, it sets the position to the edge of the image, and the search is completed (block 1036). If not at the edge of the image, then the routine inquires whether the search is completed (block 1038) and if not, it returns to block 1026 to step five pixels further left until the left edge is located.

Figure 28A:
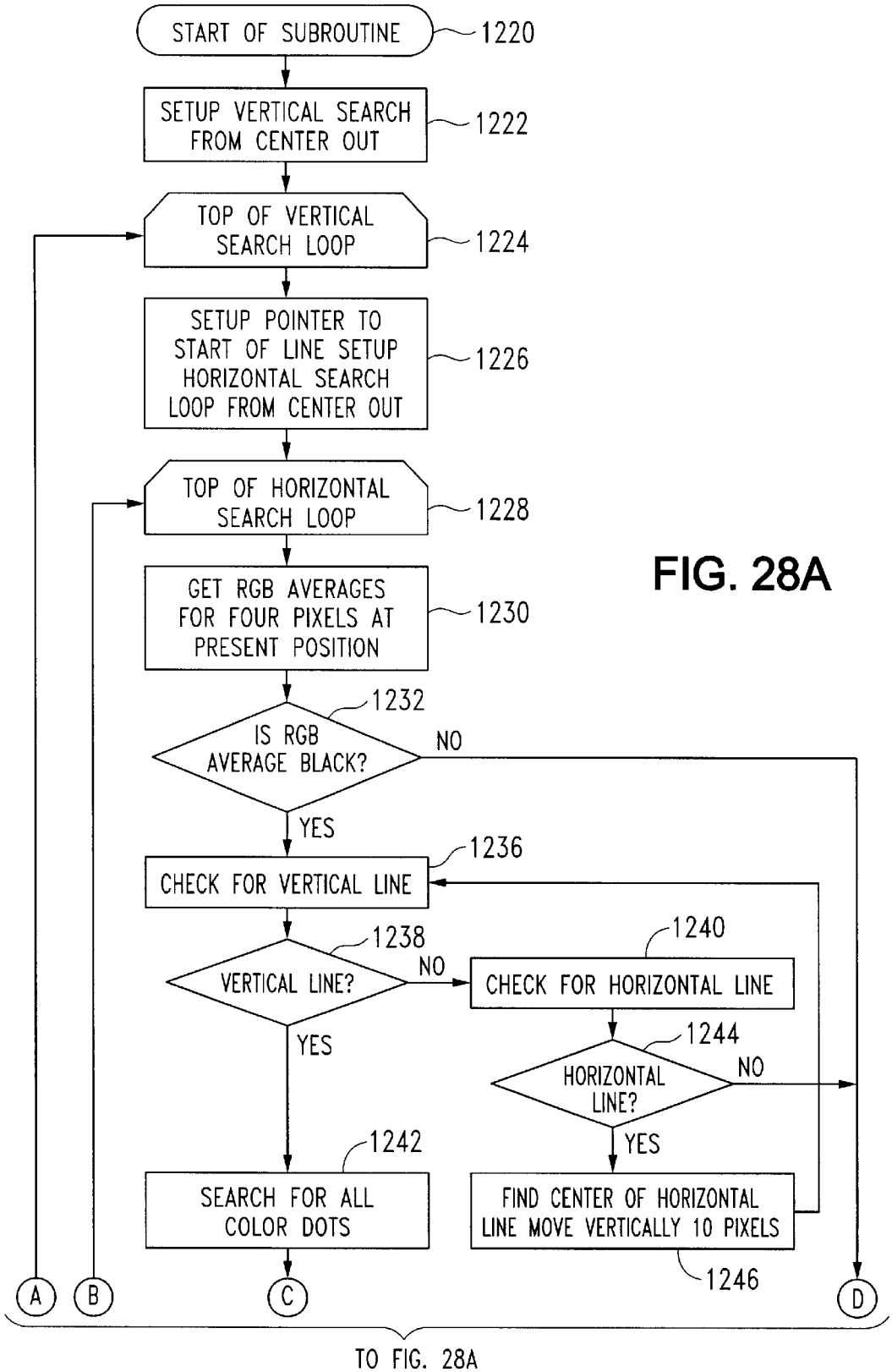
FIGS. 28A and 28B together comprise a flow chart for another software routine for searching for the register target pattern shown in FIG. 5A.
Figure 28B:
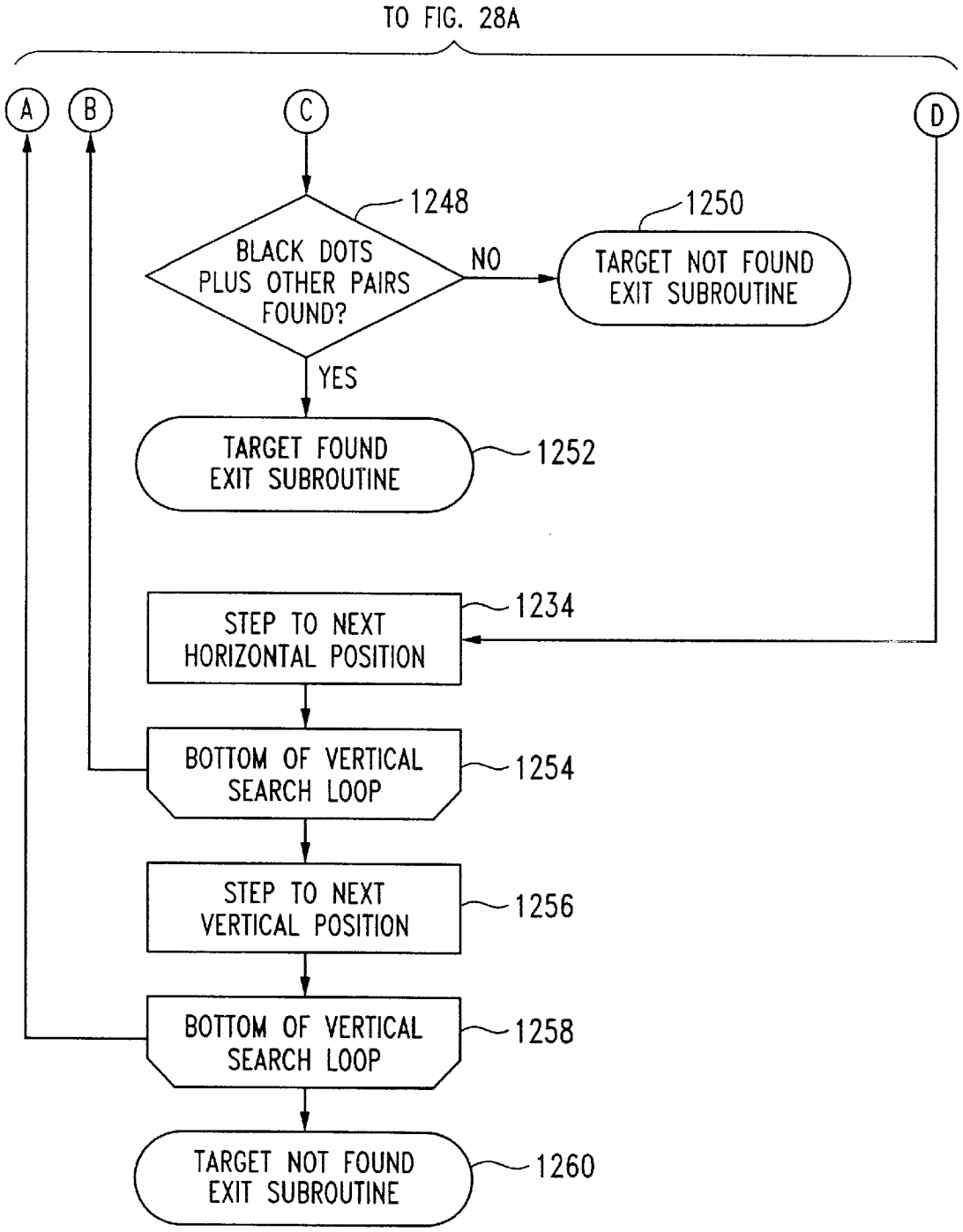

In accordance with an important aspect of the present invention, and referring to block 1036 (which appears at four locations in FIGS. 27B and 27C), it is important for the purposes of determining registration that the edges of the blocks be determined with more accuracy that five pixel steps. This is necessary so that an accurate registration measurement can be made. To obtain accurate edges of a block, the subroutine shown in FIGS. 28A and 28B is run in connection with each block 1036, which subroutine will be hereinafter described.

Figure 23A:
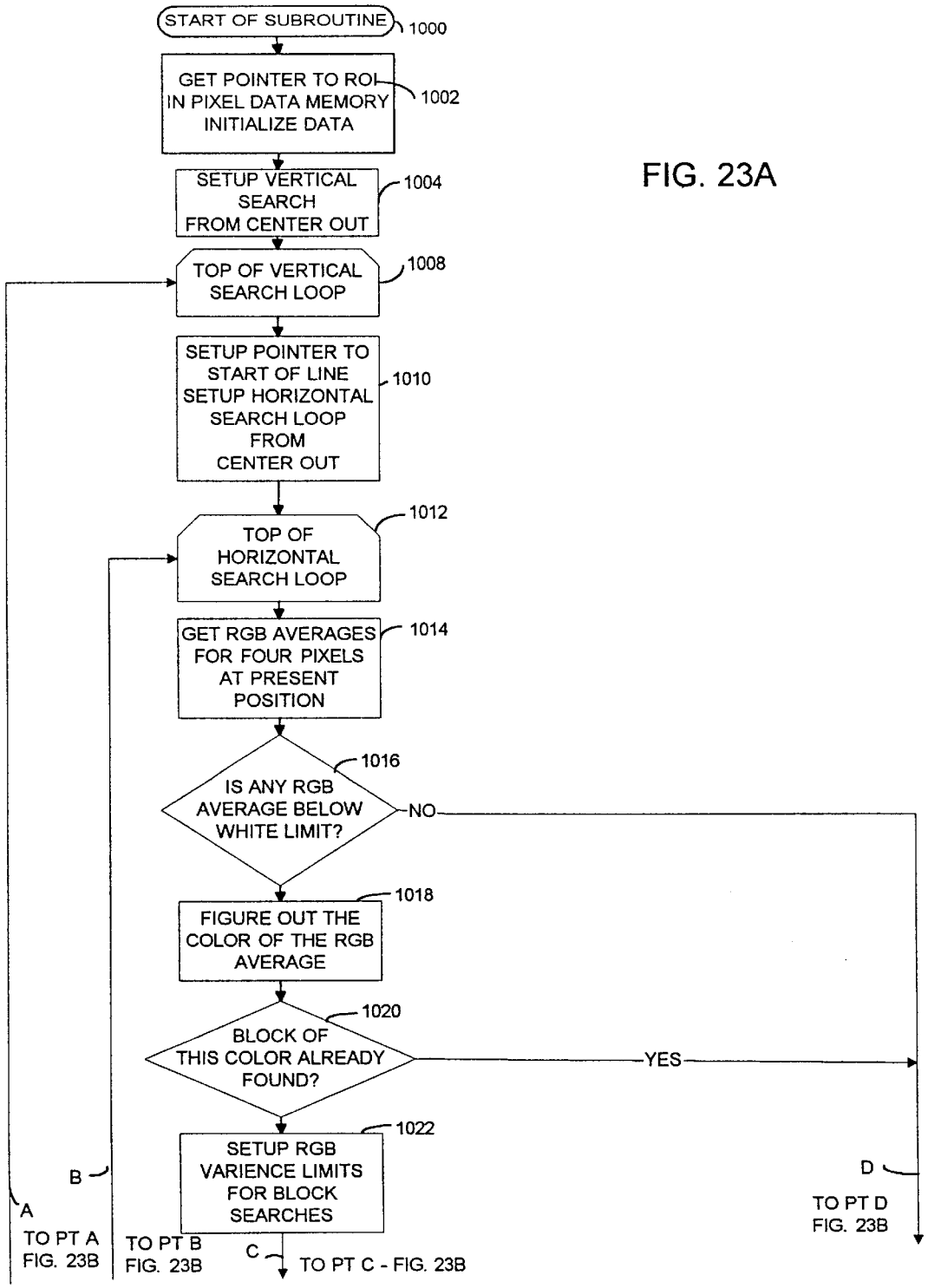
Figure 23B:
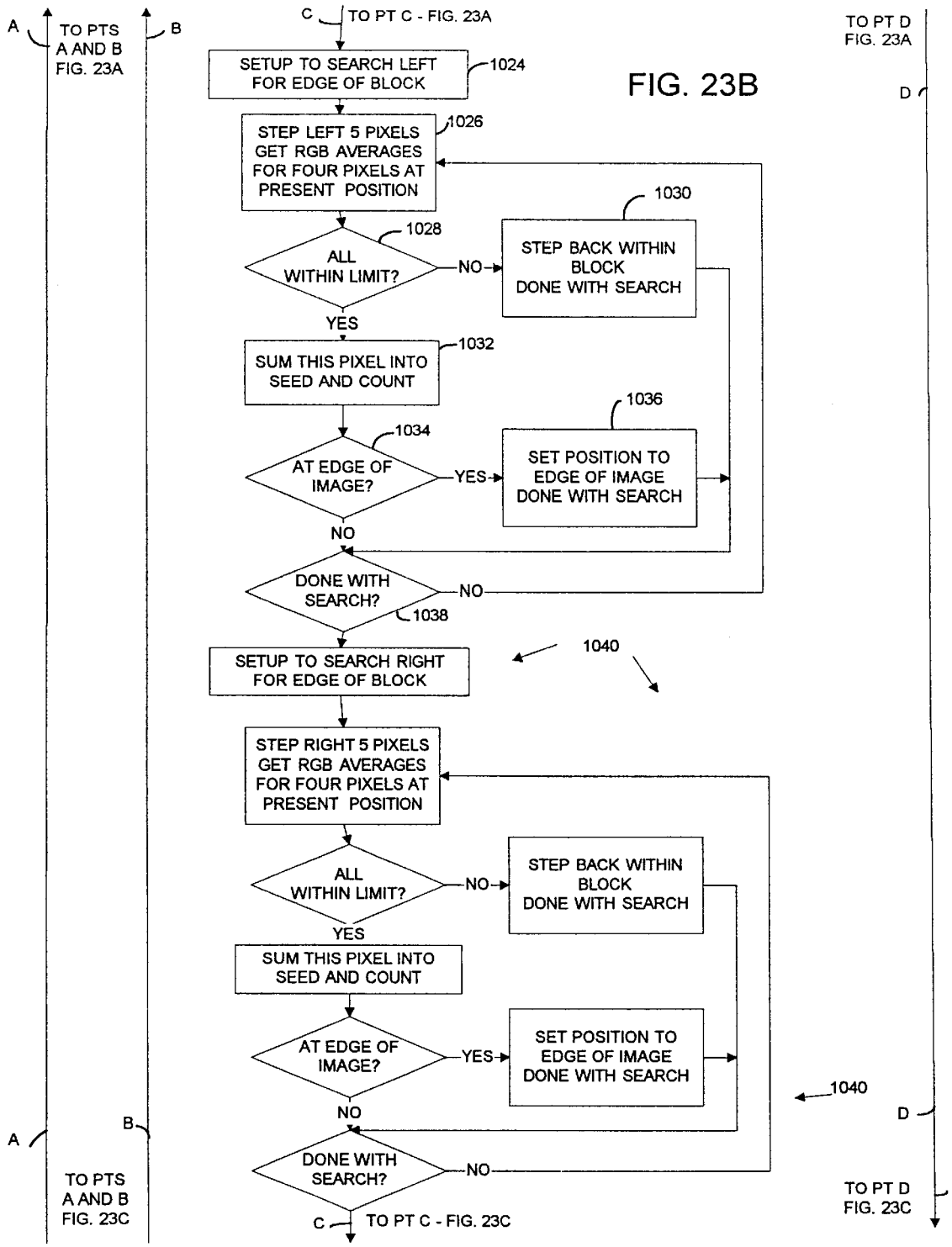
Figure 23C:
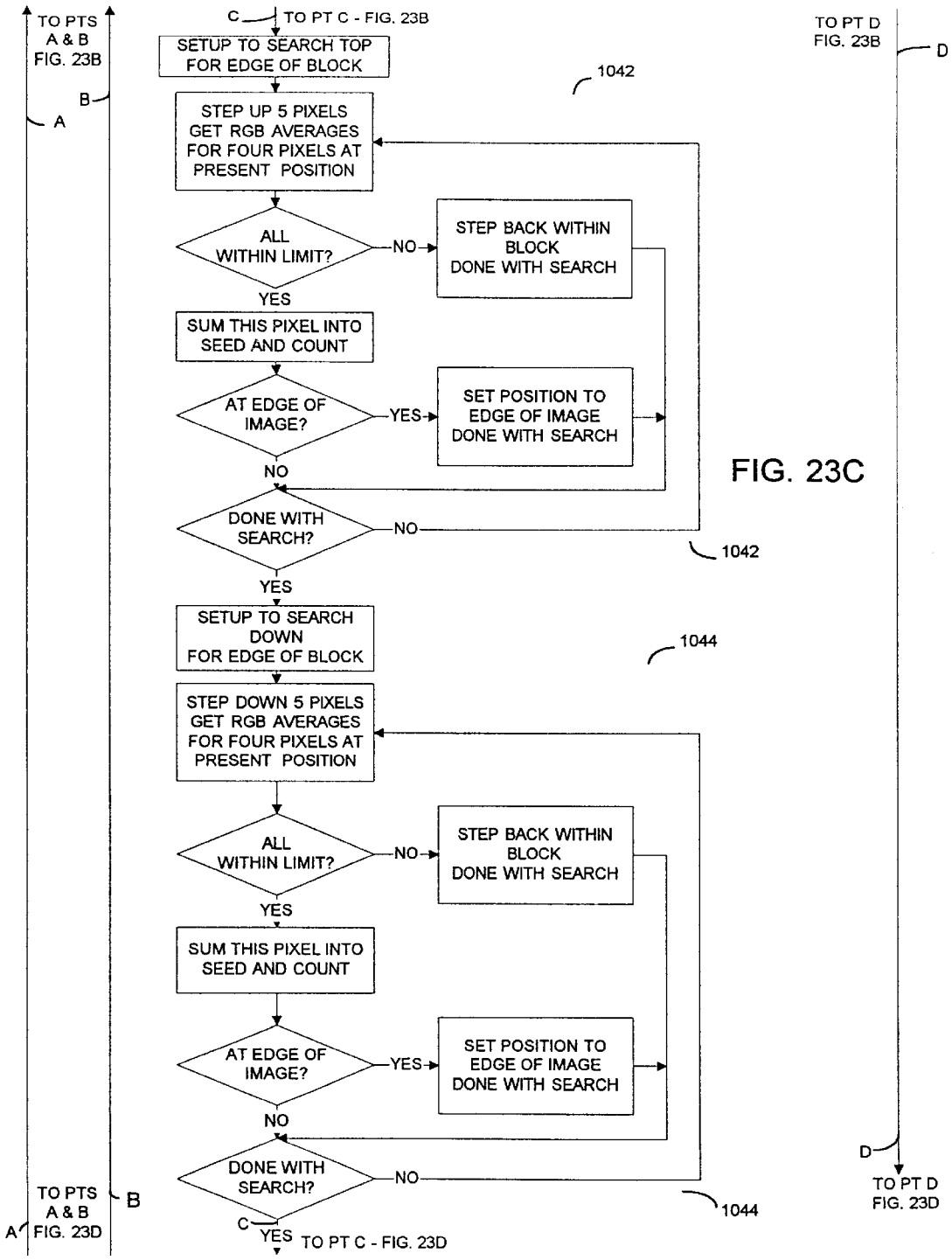
Figure 23E:
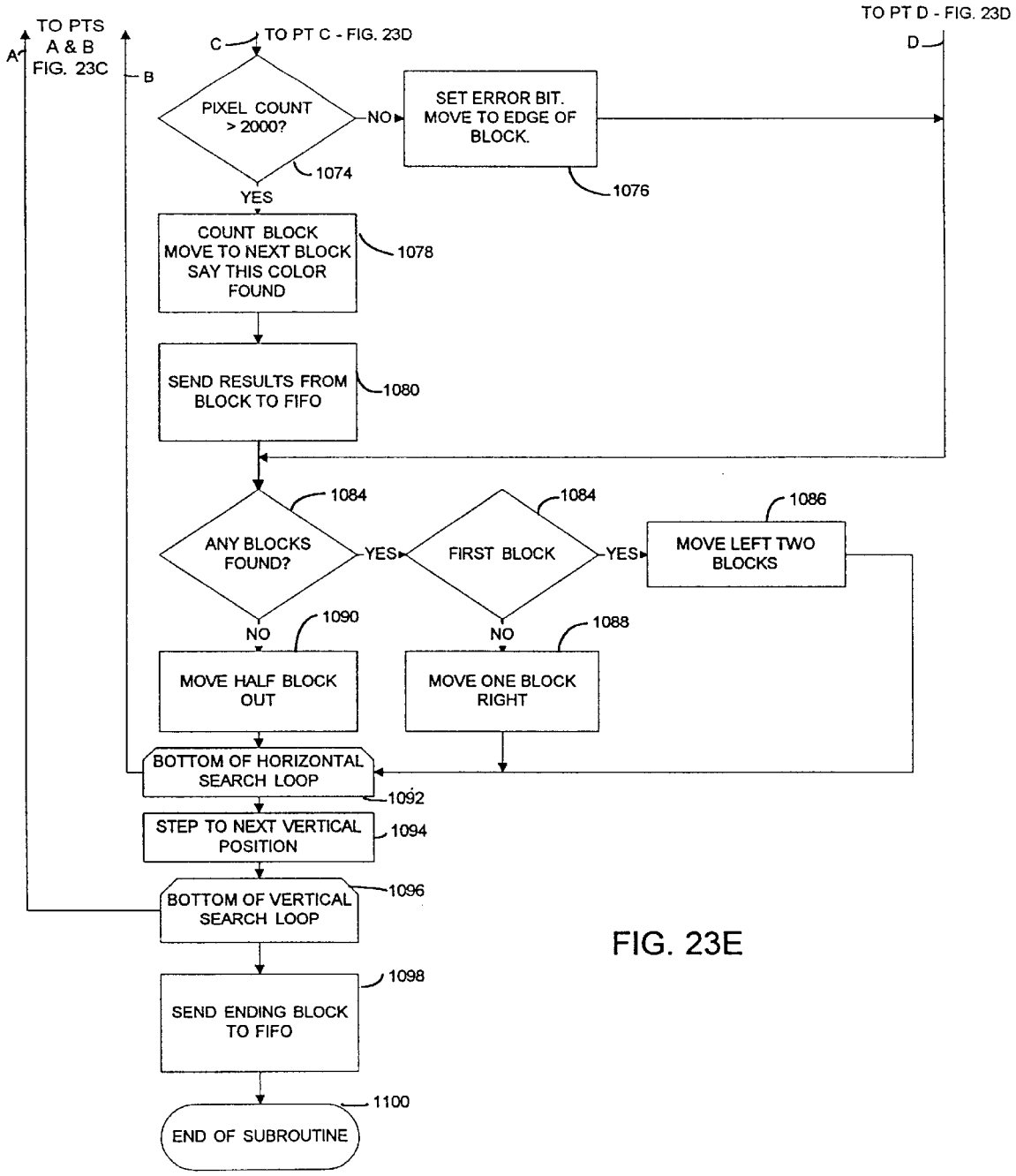

Returning to FIG. 27B, after the left edge is located, the routine then searches in the rightward direction to locate the edge 146 of the color block and this is accomplished using the same steps as has been described in blocks 1024 through 1038, with these steps being identified at 1040 in FIG. 23B. Similarly, the routine searches for the top edge 140 shown in FIG. 6 by carrying out the sets identified at 1042 in FIG. 23C followed by a search for the bottom edge 140 which is carried out by the steps identified at 1044 in FIG. 23C. Having identified each of the four boundaries of the color block 136, the routine then calculates the size of the color block (block 1046 in FIG. 23D) and determines whether the block is within desired dimensional limits (block 1048). In other words, the routine determines if a good color block has been identified. If it is within limits (including having a tab on a black block), the routine calculates the center of the block and the size of a search area (block 1050). It calculates the average of the pixels that were found and also upper and lower limits for the color that is being analyzed (block 1052). It then clears the pixel sum and sets up loop counters (block 1054) that will be used in connection with performing the reflective density analysis of the color of the color block.

The routine then starts a vertical loop (block 1056), a horizontal loop (block 1058) and steps to the next pixel (block 1060), inquires whether it is within limits (block 1062) and if so, adds that pixel value into the sum and counts the pixel (block 1064), which ends the horizontal loop (block 1066) and the vertical loop (block 1068). The area that is analyzed from blocks 1056 through 1068 is also shown in FIG. 6 to comprise an area defined by the square 651 that is approximately 52 by 52 pixels in size. If the analysis area 651 has spots such as spots 1072, the pixels in the spots will not be counted into the number of pixels that are counted and their values will not be included. Effectively, the spots are ignored from being averaged. After the total good pixel count has been averaged, the routine determines if the pixel count is greater than 2000 (block 1074).

If there are less than 2000 pixels and are used in the average, the routine sets an error bit 1076 and moves to the edge of the rectangle 1070. It is believed that a pixel count in excess of 2000 is necessary to insure reliable reflective density readings. If the count is greater than 2000, then the analysis is counted (block 1078) and this color is then considered to be found and measured. The results are sent to the FIFO buffer (block 1080).

The routine then makes a general inquiry as to whether any blocks within the color block sets have been found (block 1082) and if yes, was this the first color block (block 1084). If yes, then move left two color blocks (block 1086) or right one color block if not (block 1088). If no color blocks were found, then the analysis is moved one half color block outwardly (block 1090) and the bottom of the horizontal search loop is reached (block 1092). The routine then steps to the next vertical position (block 1094) and the bottom of the vertical loop is reached (block 1096). The ending color block is then sent to the FIFO buffer (block 1098) and the routine ended (block 1100).

The subroutine which searches for the register target pattern 110 is illustrated in FIGS. 28A and 28B. At the start of the subroutine (block 1222), a vertical search is set up which searches from the center out. This essentially sets up the data pointer and loop counters for a vertical search from the center of the screen to the edges of the screen. A return point to the top of the vertical search loop is indicated (block 1224) and a setup of the pointer to the start of the line and setup of the horizontal loop counter to search from the center out is carried out (block 1226). A top of the horizontal search loop is indicated (block 1228) before RGB averages of four pixels around this point are obtained (block 1230). In this regard, it should be understood that a single pixel may not provide any significant or reliable information and for that reason, the system averages the values of four pixels around the point of interest to obtain a reliable indication of the actual value in this immediate area. If the RGB average value is not black, then the subroutine steps to the next horizontal position (block 1234). If the RGB average value is black (block 1232), the subroutine then checks to determine the present position to see if it is a vertical line (block 1236). If it is not vertical line (block 1238), then it checks to determine if it is a horizontal line (block 1240). If it is a vertical line, then it searches for all color dots (block 1242). However, if the check for whether it was a horizontal line determines that it is not horizontal line (block 1244), then it again steps to the next horizontal position (block 1234). If it is a horizontal line, then the subroutine finds the center of the horizontal line and loops back to (block 1236) to determine if it is a vertical line.

If it is a vertical line, then a search is conducted for all color dots (block 1242), and a determination is made as to whether black dots plus other dot pairs were found (block 1248). If no black dots or other pairs were found, then the subroutine is exited (block 1250). However, if there were targets found, the subroutine is also exited (block 1252). After the step to the next horizontal position is done in block 1234, the subroutine reaches the bottom of the horizontal search loop. If the horizontal search is not completed, then the subroutine returns to block 1228. However, if it has, then it the routine steps to the next vertical position (block 1256). It then performs the vertical search loop (block 1258) which if not completed, returns to block 1254, but if it has been, it exits the subroutine (block 1260).

To determine whether any adjustment needs to be made by the registration adjustment system 14, the color density and registration measurement and control apparatus 16 performs an analysis of image data that it has acquired. Referring to FIG. 29, a subroutine takes the dot positions of the registration pattern 110 or the block positions of the density targets 112 found previously to determine if any register motor activation or moves need to be made. For all dot pairs or color blocks, except for the control color (which must exist for others to be compared to), the system compares the found position to the desired position. If the difference between the found position to the desired position is greater than a dead band or zone, then a registration motor move signal is generated and sent to the motor controller for the appropriate color print station. The subroutine starts (block 1270) and sets up the data pointer and loop counters (block 1272). A return point for the loop on dot pairs or color blocks is provided (block 1274) and a test is provided to determine if the initial dot pair is a control color (block 1276). If it is, then the routine steps to the next dot pair (block 1280). If it is not, then its position is compared to the desired position (block 1278). The distance between the actual position and the desired position is then computed and the result of that computation is compared with a dead band or dead zone air (block 1286). If it is within the dead zone, then the subroutine steps to the next dot pair. However, if it is not, then it calculates the move size by subtracting the dead zone magnitude from the register error (block 1288) and sends the result to the motor controller (block 1290) to activate the appropriate motor. After that, the subroutine moves to the next dot pair and then to the bottom of the dot pair loop (block 1282). If all of the dot pairs have been examined, the subroutine ends (block 1284).

Figure 27A:
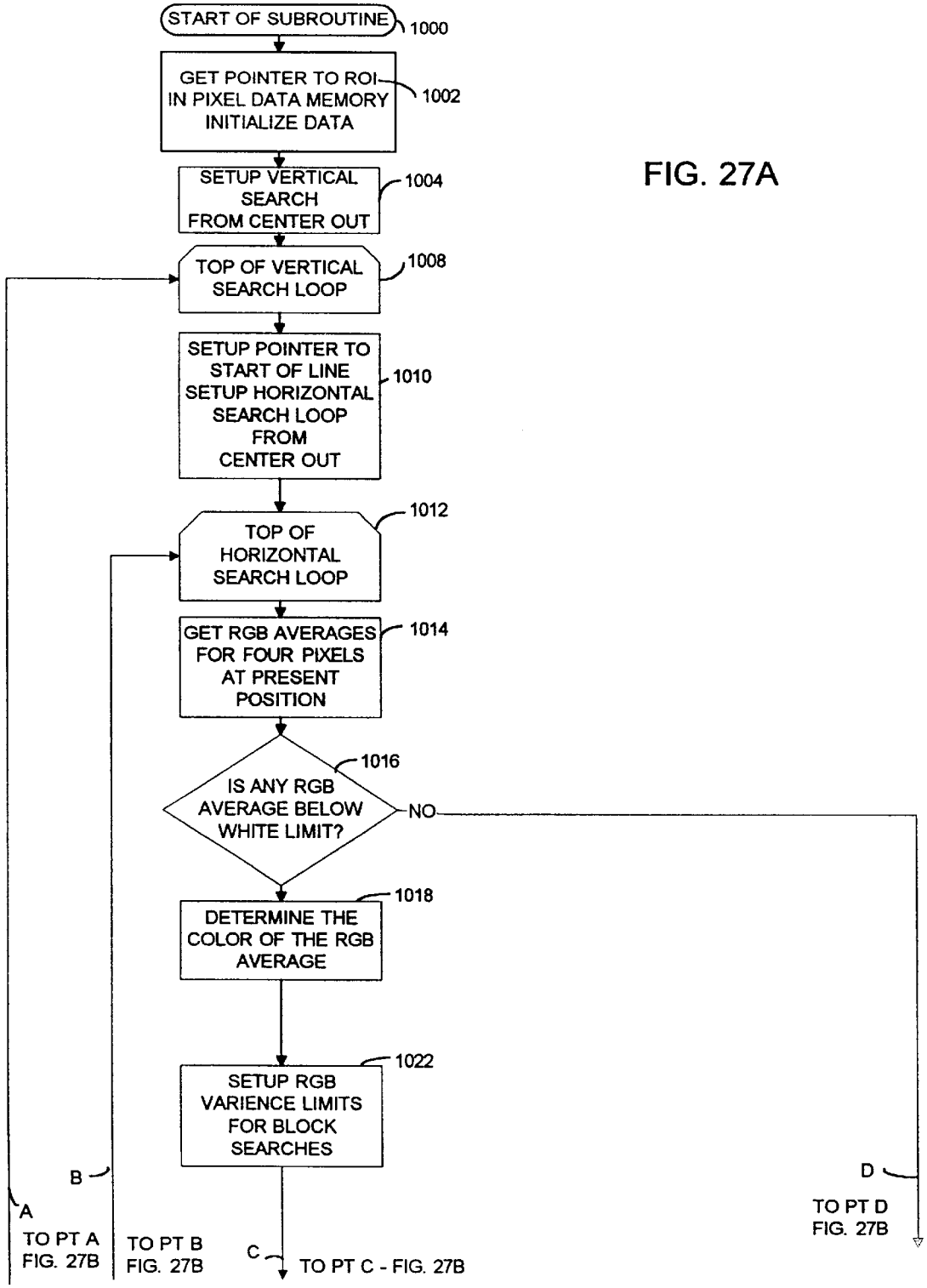
FIGS. 27A, 27B, 27C and 27D together comprise a flow chart for another software routine for searching for the locations of color blocks.
Figure 27B:
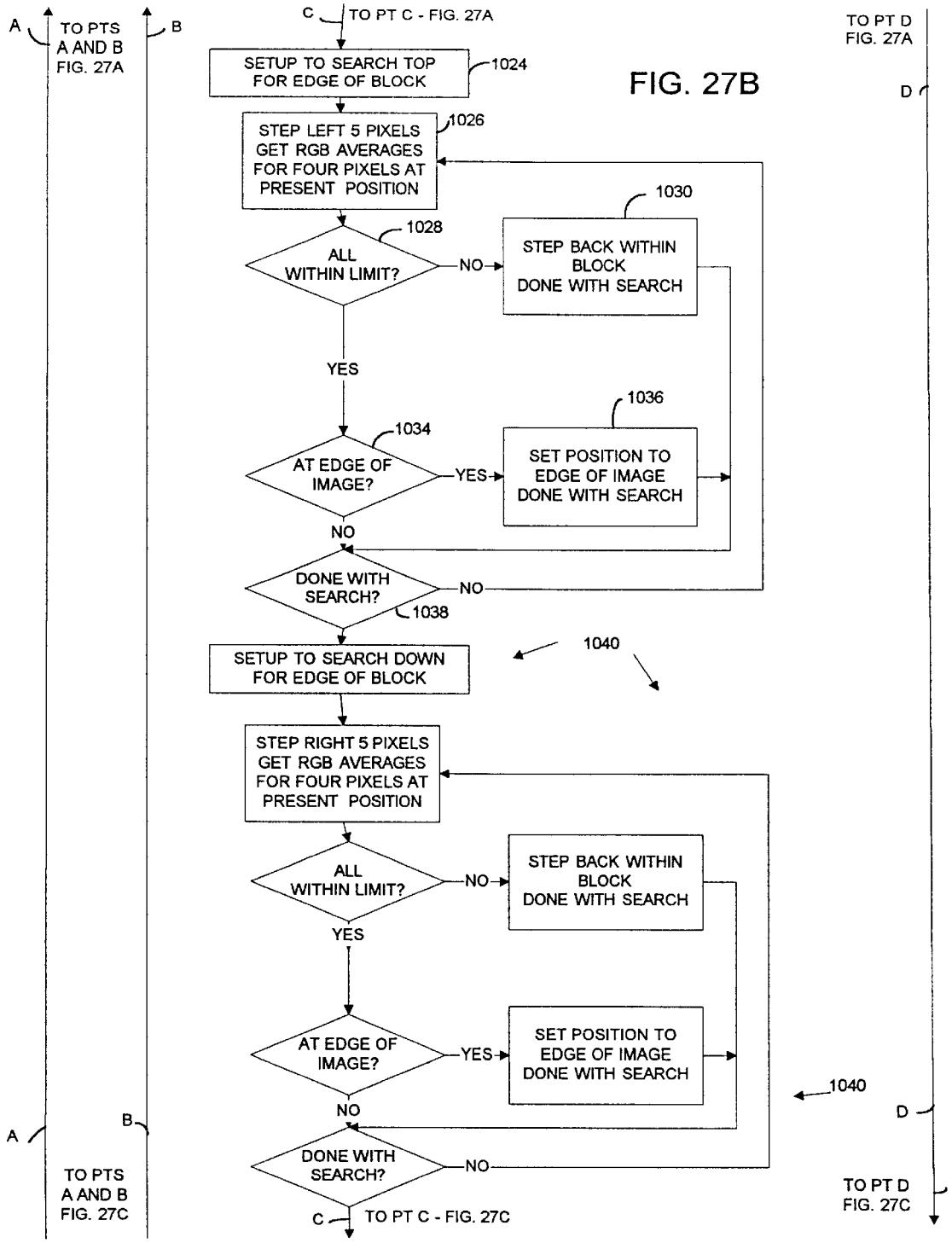
Figure 27C:
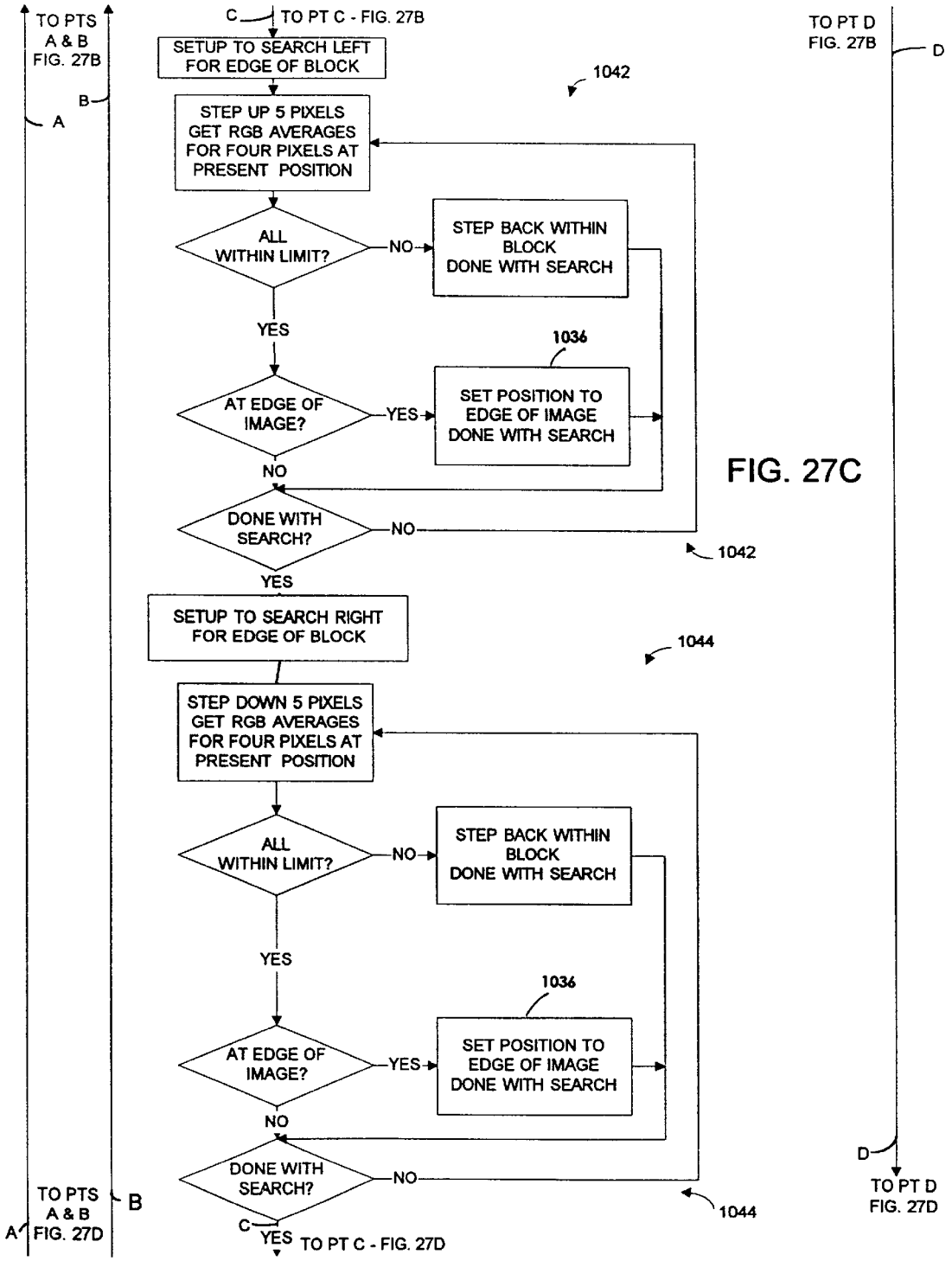
Figure 27D:
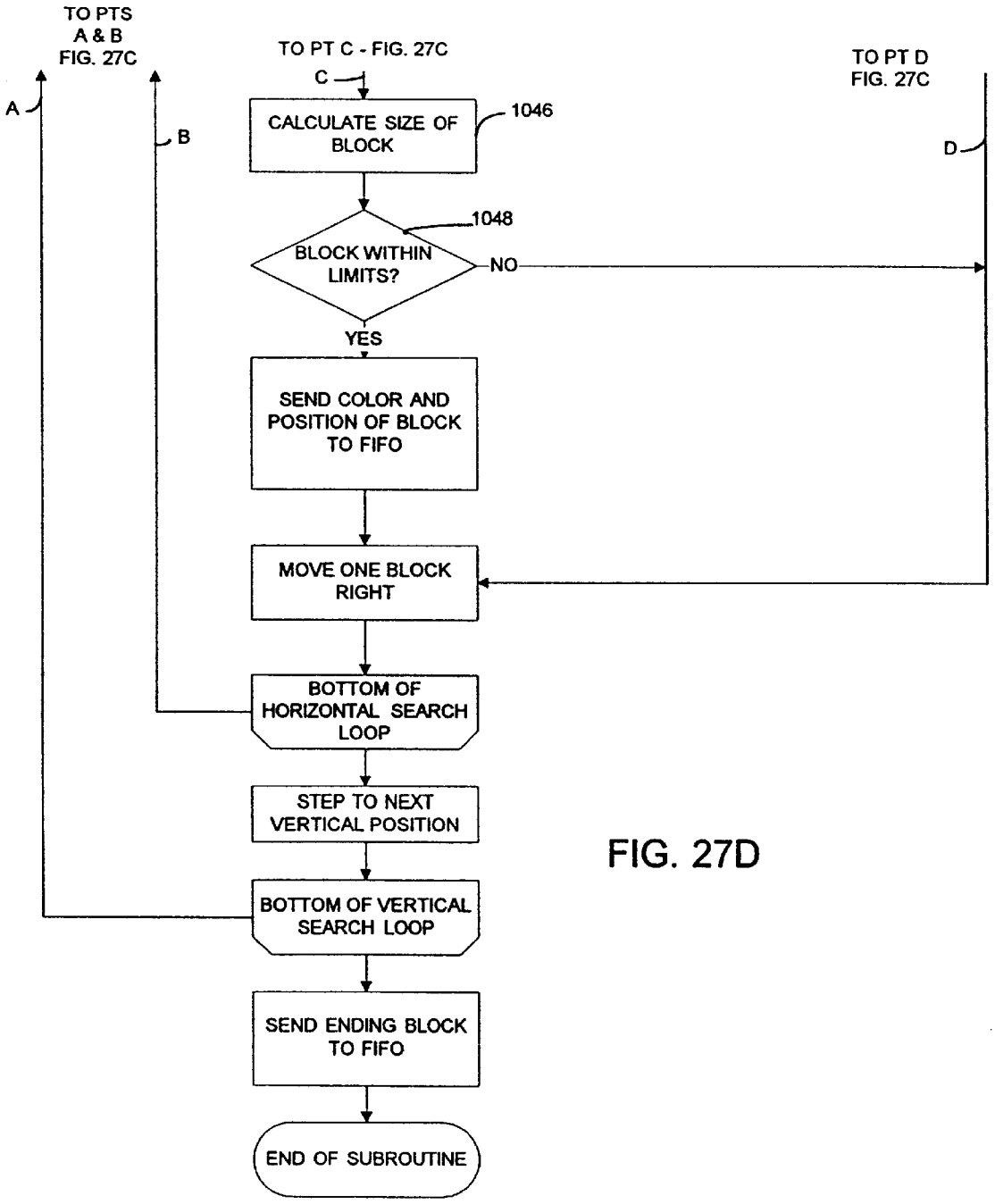

FIGS. 23A through 23E finds the color blocks by starting from the center and working out rather than working across the screen. If it finds one of each color and analyzes it, the reflective density analysis is carried out. Another routine that is very similar to that shown in FIGS. 23A–23E is shown in FIGS. 27A–27D, which operates to locate all color blocks in an image, but does not perform any reflective density analysis. The reference numbers of identical steps of the routine shown in FIGS. 23A–23E are used in FIGS. 27A–27D, and the final steps shown in FIG. 27D are apparent and do not need additional description. The routine of FIGS. 27A–27D is also used by the get edge routine shown in FIGS. 16A through 16C to find the color block set.

Figure 24:
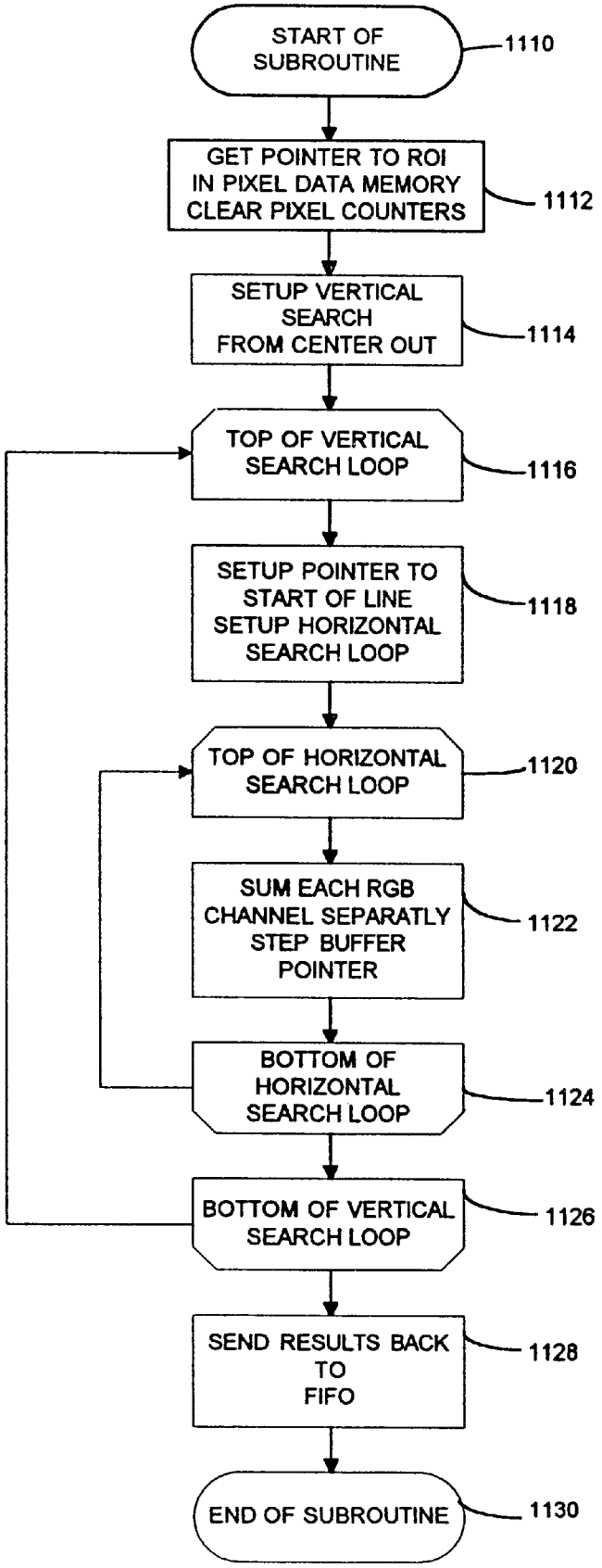
FIG. 24 is a flow chart of a software subroutine for finding the average of a 300 by 300 pixel area.

The apparatus also utilizes a number of averaging subroutines which are similar to one another. The 300 by 300 pixel averaging routine of FIG. 24 is used in the light discontinuity analysis. Referring to the averaging routine of FIG. 24, it starts at 1110, obtains the pointer through the region of interest in the buffer and clear pixel counters (block 1112), sets up a vertical search from the center out (block 1114) and starts at the top of the vertical search loop (block 1116). The routine sets the pointer to the start of a line and sets the horizontal search loops (block 1118) beginning at the top of the horizontal search loop (block 1120). The routine then sums each RGB channel separately and steps the buffer pointer after each pixel is summed (block 1122) and the routine then reaches the bottom of the horizontal search loop (block 1124) as well as the bottom of the vertical search loop (block 1126) and it sends the results back to the FIFO buffer (block 1128) before ending the subroutine (block 1130).

Figure 25:
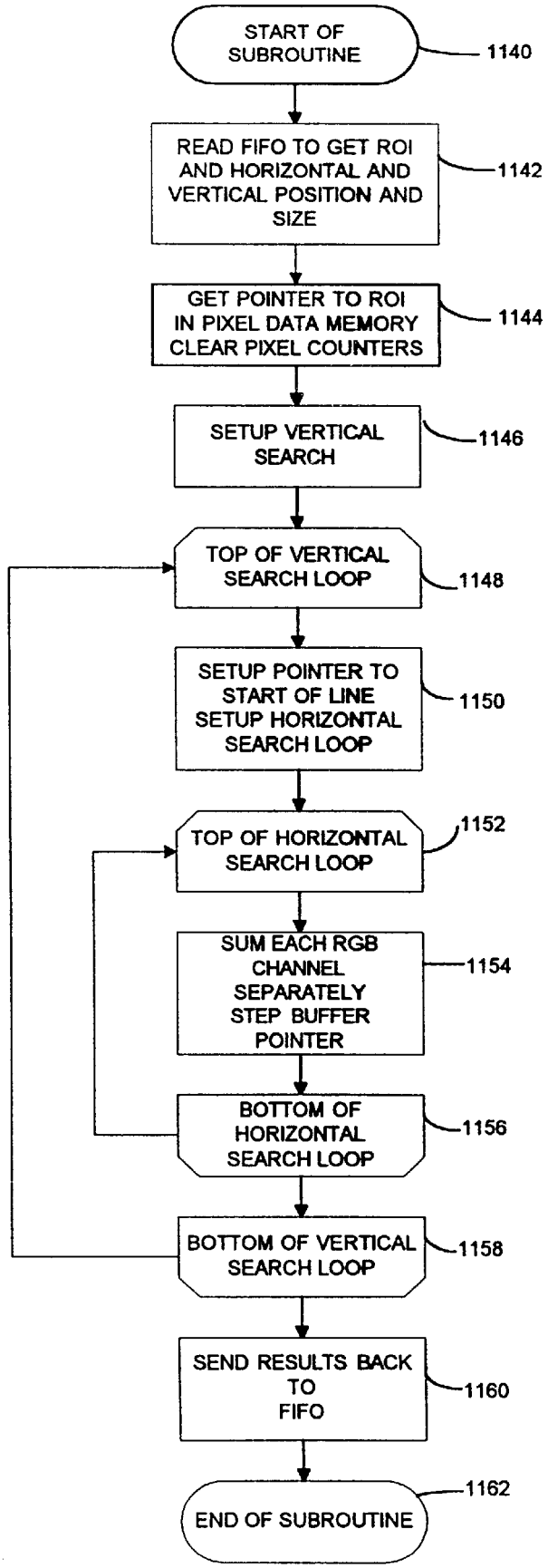
FIG. 25 is a flow chart of a software subroutine for determining the average of pixel values for any area requested.

A routine for averaging any area request is illustrated in FIG. 25 which starts at block 1140 wherein a region of interest as well as horizontal and vertical position and size to be searched is read from the FIFO buffer (block 1142) and the pointer is set to a region of interest in the pixel data memory and the pixel counters cleared (block 1144). The routine then sets up a vertical search (block 1146), goes to the top of the vertical search loop (block 1148), sets up pointers to start a line and sets up the horizontal search loop (block 1150), goes to the top of that horizontal search loop (block 1152), sums each RGB channel separately and steps the buffer pointer as it does so. The routine then reaches the bottom of the horizontal search loop (block 1156) as well as the vertical search loop (block 1158), sends the results back to the FIFO buffer (block 1160) and ends the subroutine (block 1162).

Figure 26:
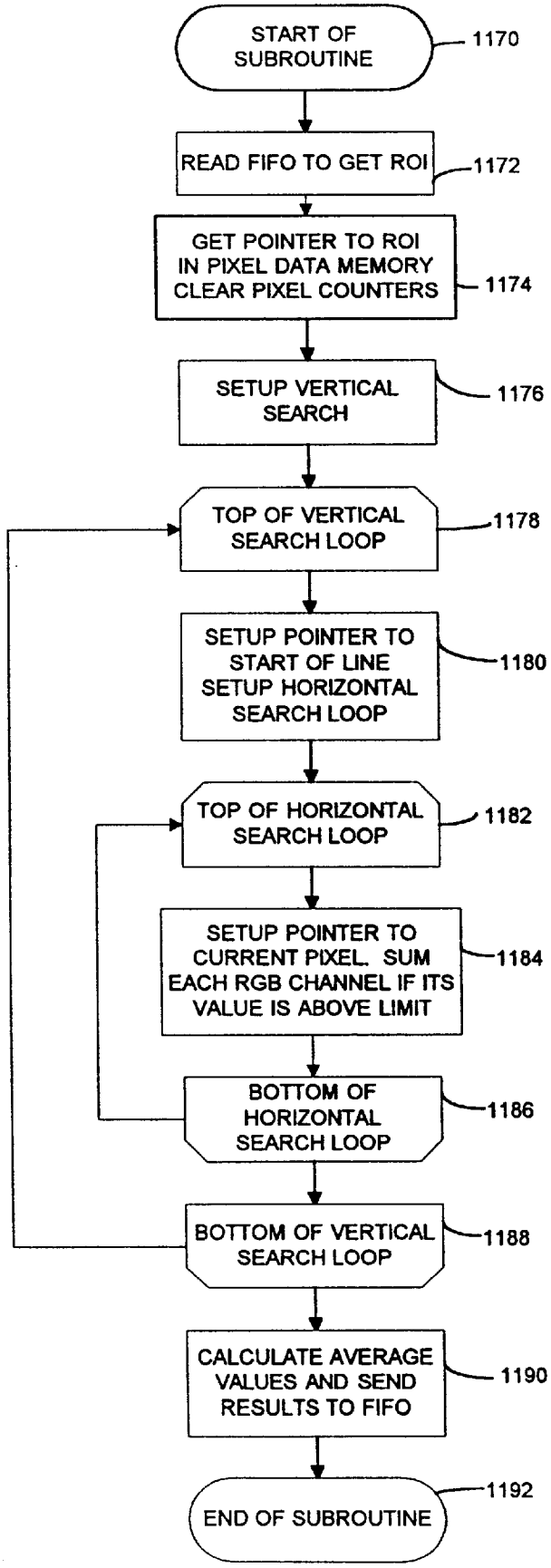
FIG. 26 is a flow chart for a software subroutine that sums pixels that are determined to be white within a digitized image.

Another averaging subroutine is illustrated in FIG. 26 which is a flow chart that of a subroutine that is used to determine how many pixels are white in the image that is acquired during the light scattering compensation analysis. The subroutine starts at (block 1170) and the FIFO buffer is read to obtain the region of interest (block 1172). The routine then sets the pointer to the region of interest in the pixel data memory (block 1174) and it clears the counters. A vertical search is then set up (block 1176) and the routine proceeds to the top of the vertical search loop (block 1178) followed by setting up a pointer to start at a line and set up a horizontal search loop (block 1180) and proceed to the top of the horizontal search loop (block 1182). The routine then sets up the pointer to a current pixel and sums each RGB channel if its value is above the limit, preferably 120 in intensity (block 1184). The bottom of the horizontal search loop is reached (block 1186) as is the bottom of the vertical search loop (block 1188). The routine then calculates the average values and sends the results to the FIFO buffer (block 1190) and the subroutine has ended (block 1192).

It is comfortable for press operators who have used conventional handheld densitometers for many years to have a densitometer reading produced by the present apparatus that is the equivalent of the densitometer reading that would be obtained from the hand-held units. Such a conversion is necessary in the strict sense of providing a reflective density analysis value that is accurate, it can be provided by the equation:

$$\text{Reflective density} = -\text{Log}_{10}[(\text{value} - B_{level})/(W_{level} - B_{level})]$$

where the $B_{level)}$ equals the pixel value for no reflection and the $W_{Level)}$ equals the pixel value for 100% reflectance. Since the white level is preferably calibrated to be within the range of 200 to 240 and the black level within the range of 0 to 63, this is for standards that are not perfectly reflective (white) or perfectly nonreflective (black). The values can be further refined to a white level of 242 and a black level of 4, and if this is done, the expression above generally becomes $$\text{Reflective density} = -\text{Log}_{10}[(\text{value} - 4)/242].$$

The apparatus reliably produces measurements that are substantially comparable to those produced by an accurately calibrated hand-held densitometer.

While there are many other subroutines which are utilized in the reflective density measurement and control apparatus they are relatively straightforward in their structure and operation and are known to those of ordinary skill in the art and are therefore not set forth in detail herein.

In yet another important aspect, and referring to FIG. 11, the nozzle 34 is designed to prevent admission of dust and other particles into the center thereof which could obstruct the lens of the CCD matrix sensor 32 and reduce the number of pixels that would be included in the various analyses that have been described above. The nozzle 34 has a pair of ports 1200 to which a air hoses 1202 are attached, and the hoses are connected to a source of positive air pressure so that air is admitted to the nozzle 34. The nozzle has an internal annular chamber 1204 with an inner wall 1206 which has a number of openings 1208 which direct the air into the center of the nozzle 34. The air is directed toward the main central opening and the openings 1208 are slightly angled relative to the center line of the CCD matrix sensor to create a swirling effect. The air stream thereby tends to restrict entrance of particles into the nozzle where they could reach the lens.

From the foregoing description, it should be understood that a system for controlling a web printing press has been shown and described which has many advantages and positive attributes. The system is capable of reliably operating to measure and control reflective density and also measure and control registration of the modern presses which have a very small gap area as well as a small test print area area within an impression. A particularly desirable attribute is that the system can control reflective density and registration on a resolution of up to a key-by-key basis across the entire width of the web which facilitates high quality printing production. Moreover, the process manager supplies data for presetting jobs, and enables efficiently press make-readies. The process manager also gathers time based operating data on the press and its systems, and builds a database which provides an accurate historical account of each job, and which can be used to provide reports to customers.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. A system for dynamically monitoring and controlling a web printing press of the type which has a plurality of print stations each of which is adapted to print a distinctive color and which has a register adjusting mechanism for adjusting the circumferential timing and the lateral positioning of the print application and/or path length through the print station and an adjustable ink zone control mechanism for controlling the amount of ink of said distinctive color that is available to be transferred to the web at spaced locations across the width of the press during a printing operation and which has a printing roller which transfers ink to the web, there being a predetermined height test print area within a print impression that extends in the lateral direction across the web, the press printing at least one type of target pattern in the test print area of the web generally at each spaced location, each target pattern type including components of predetermined size and shape printed by each printing station, said system comprising:

means for acquiring a digitized image of predetermined size of the web, said image being comprised of a plurality of individual pixels, each having an intensity value within a predetermined range;

strobe means for illuminating at least the area of the web from which an image is acquired during the acquisition of the image;

memory means for storing said acquired digitized images;

processing means being adapted to analyze individual components of a first type of target contained in said acquired digitized image and produce a reflective density value for each said component, and generate a control signal for application to the ink zone control mechanism for correcting any detected incorrect reflective density values for respective components of said first type of target;

said processing means being adapted to analyze individual components of a second type of target to determine the relative positions of all of the components of said second type of target and to selectively generate control signals for application to the respective register adjusting mechanisms to reduce register misalignment.

2. The system as defined in claim 1 wherein said acquiring means includes a charge coupled device (CCD) sensor means that is adapted to acquire said digitized image.

3. The system as defined in claim 2 further including carriage means for mounting said CCD matrix sensor means and said strobe means and for moving the same across the width of the web for acquiring digitized images of desired areas of the web.

4. A system for dynamically monitoring and controlling a web printing press of the type which has a plurality of print stations each of which is adapted to print a distinctive color and which has a register adjusting mechanism for adjusting the circumferential timing and the lateral positioning of the print application and/or path length through the print station and an adjustable ink zone control mechanism for controlling the amount of ink of said distinctive color that is available to be transferred to the web at spaced locations across the width of the press during a printing operation and which has a printing roller which transfers ink to the web, there being a predetermined height test print area within a print impression that extends in the lateral direction across the web, the press printing at least one type of target pattern in the test print area of the web generally at each spaced location, each target pattern type including components of predetermined size and shape printed by each printing station, said system comprising:

means for acquiring a digitized image of predetermined size of the web, said image being comprised of a plurality of individual pixels, each having an intensity value within a predetermined range;

strobe means for illuminating at least the area of the web from which an image is acquired during the acquisition of the image;

memory means for storing said acquired digitized images;

processing means being adapted to analyze individual components of a first type of target contained in said acquired digitized image and produce a reflective density value for each said component, and generate a control signal for application to the ink zone control mechanism for correcting any detected incorrect reflective density values for respective components of said first type of target;

said processing means being adapted to analyze individual components of a second type of target to determine the relative positions of all of the components of said second type of target and to selectively generate control signals for application to the respective register adjusting mechanisms to reduce register misalignment; and, a process managing means operably connected to said processing means and adapted to receive informational data relating to print jobs, download preset data to said processing means for presetting the register adjusting mechanism and the adjustable ink zone control mechanism, and receives data concerning the operation of the processing means and its control of the register adjusting mechanism and the adjustable ink zone control mechanism.

5. The system as defined in claim 4 wherein said preset data is in the CIP-3 protocol.

6. The system as defined in claim 4 wherein said process managing means compiles a time based database relating to the operation of the press.

7. The system as defined in claim 4 wherein said process managing means monitors said data concerning the operation of the processing means and generates an alert signal for alerting a press operator when said data indicates that the operation of the press is outside of predetermined operating tolerances.

8. The system as defined in claim 2 wherein said CCD matrix sensor means comprises at least one CCD matrix sensor having a lens and internal means for separating the light passing through the lens into three paths, each respectively containing red, green and blue light, said CCD matrix sensor means thereby having three channels, with each channel providing a digitized image of its color, said processing means analyzing substantially all of the pixels of a digitized image of each of the channels, said processing means thereby storing a light scattering compensation signal for said color block set.

9. The system as defined in claim 8 wherein said CCD matrix sensor means acquires a matrix image comprised of at least approximately 760 by 480 individual pixels, said range of intensity values being from 0 to at least 255 before said predetermined values are generated for said first and second standards.

10. The system as defined in claim 1 wherein said first type of target is a register target pattern wherein said components comprise a plurality of dot pairs arranged in two horizontal rows, there being a pair of dots of each distinctive color.

11. The system as defined in claim 10 wherein said second type of target is a density target pattern wherein said components comprise a number of blocks arranged in a horizontal row within the test print area, there being at least one block of each distinctive color.

12. The system as defined in claim 11 wherein each of the blocks of said density target pattern are substantially the same size, one of said blocks having at least one tab located on a corner thereof.

13. The system as defined in claim 11 wherein one of said register target patterns is printed in said test print area and at least said density target pattern is printed at each spaced location in said test print area.

14. The system as defined in claim 13 wherein said system is adapted to selectively generate control signals for application to the respective register adjusting mechanisms to reduce register misalignment at each spaced location as a result of analyzing individual components of said density target patterns and said register target pattern.

15. A system for dynamically monitoring and controlling a web printing press of the type which has a plurality of print stations, each of which is adapted to print a distinctive color and which has a register adjusting mechanism for adjusting the circumferential timing and the lateral positioning of the print application and/or path length through the print station and an adjustable ink zone control mechanism for controlling the amount of ink of said distinctive color that is available to be transferred to the web at spaced locations across the width of the press during a printing operation and which has a printing roller which transfers ink to the web, there being a predetermined height test print area within a print impression that extends in the lateral direction across the web, the press printing at least two types of target patterns in the test print area of the web, including a register type of target pattern wherein said components comprise at least one dot of each distinctive color and at least one density type target pattern wherein said components comprise a number of blocks arranged in a horizontal row within the test print area, there being at least one block of each distinctive color, said system comprising:

means for acquiring a digitized image of predetermined size of the web, said image being comprised of a plurality of individual pixels, each having an intensity value within a predetermined range;

strobe means for illuminating at least the area of the web from which an image is acquired during the acquisition of the image;

memory means for storing said acquired digitized images;

processing means being adapted to analyze individual components of said density target pattern contained in said acquired digitized image and produce a reflective density value for each said component, and generate a control signal for application to the ink zone control mechanism for correcting any detected incorrect reflective density values for respective components of a target;

said processing means being adapted to analyze individual components of said register target pattern to determine the relative positions of all of the components of the register target pattern and to selectively generate control signals for application to the respective register adjusting mechanisms to reduce register misalignment.

* * * * *